US009560451B2

(12) United States Patent
Eichfeld et al.

(10) Patent No.: US 9,560,451 B2
(45) Date of Patent: Jan. 31, 2017

(54) CONVERSATION ASSISTANCE SYSTEM

(71) Applicant: Bose Corporation, Framingham, MA (US)

(72) Inventors: Jahn Dmitri Eichfeld, Natick, MA (US); William M. Rabinowitz, Bedford, MA (US); William Berardi, Grafton, MA (US); John Trotter, Sudbury, MA (US); Michael Shay, Uxbridge, MA (US)

(73) Assignee: Bose Corporation, Framingham, MA (US)

( * ) Notice: Subject to any disclaimer, the term of this patent is extended or adjusted under 35 U.S.C. 154(b) by 72 days.

(21) Appl. No.: 14/618,889

(22) Filed: Feb. 10, 2015

(65) Prior Publication Data

US 2015/0230026 A1 Aug. 13, 2015

Related U.S. Application Data

(60) Provisional application No. 61/937,873, filed on Feb. 10, 2014.

(51) Int. Cl.

| | |
|---|---|
| ***H04R 5/027*** | (2006.01) |
| ***G10L 21/02*** | (2013.01) |
| *H04R 25/00* | (2006.01) |

(52) U.S. Cl.

CPC ..... *H04R 5/027* (2013.01); *G10L 21/02* (2013.01); *H04R 25/407* (2013.01); (Continued)

(58) Field of Classification Search

None

See application file for complete search history.

(56) References Cited

U.S. PATENT DOCUMENTS 5,289,544 A 2/1994 Franklin
5,479,522 A 12/1995 Lindemann et al.
(Continued)

FOREIGN PATENT DOCUMENTS

EP 0855130 B1 3/2004
EP 1305975 B1 11/2011
(Continued)

OTHER PUBLICATIONS

Phonak Insight, "Binaural Directionality", white paper, Jul. 2010, pp. 1-4.

(Continued)

*Primary Examiner* — Brenda Bernardi

(74) *Attorney, Agent, or Firm* — Brian M. Dingman; Dingman IP Law, PC

(57) ABSTRACT

A conversation assistance system with a bi-lateral array of microphones arranged externally of a space that does not include any array microphones, where the space has a left side, a right side, a front and a back, the array comprising a left side sub-array of multiple microphones and a right side sub-array of multiple microphones, where each microphone has a microphone output signal, and a processor that creates from the microphone output signals a left-ear audio signal and a right-ear audio signal. The left-ear audio signal is created based on the microphone output signals from one or more of the microphones of the left-side sub-array and one or more of the microphones of the right-side sub-array and the right-ear audio signal is created based on the microphone output signals from one or more of the microphones of the left-side sub-array and one or more of the microphones of the right-side sub-array.

29 Claims, 52 Drawing Sheets

(52) U.S. Cl.
CPC ..... *H04R 25/405* (2013.01); *H04R 25/552* (2013.01); *H04R 2201/403* (2013.01); *H04R 2430/25* (2013.01)

(56) References Cited

U.S. PATENT DOCUMENTS

| | | | | |
|---|---|---|---|---|
| 6,549,633 | B1 | 4/2003 | Westermann | |
| 6,983,055 | B2 | 1/2006 | Luo | |
| 7,031,483 | B2 | 4/2006 | Boone et al. | |
| 8,126,153 | B2 | 2/2012 | Fischer | |
| 8,270,642 | B2 * | 9/2012 | Kuhn | H04S 7/30 381/17 |
| 8,275,161 | B2 | 9/2012 | Fischer et al. | |
| 2007/0098192 | A1 | 5/2007 | Sipkema et al. | |
| 2008/0013762 | A1 | 1/2008 | Roeck et al. | |
| 2009/0304188 | A1 | 12/2009 | Mejia et al. | |
| 2009/0304203 | A1 | 12/2009 | Haykin et al. | |
| 2011/0091057 | A1 * | 4/2011 | Derkx | H04R 25/407 381/313 |
| 2012/0008807 | A1 | 1/2012 | Gran | |
| 2012/0243698 | A1 * | 9/2012 | Elko | H04M 9/082 381/66 |
| 2012/0321091 | A1 | 12/2012 | Fischer et al. | |
| 2012/0321092 | A1 | 12/2012 | Fischer et al. | |
| 2013/0064375 | A1 * | 3/2013 | Atkins | H04S 7/301 381/17 |
| 2013/0208896 | A1 | 8/2013 | Chatlani et al. | |
| 2015/0030162 | A1 * | 1/2015 | Luo | H04R 25/552 381/23.1 |
| 2015/0110275 | A1 * | 4/2015 | Tammi | H04S 7/301 381/26 |
| 2015/0163602 | A1 * | 6/2015 | Pedersen | H04R 25/554 381/315 |
| 2016/0088403 | A1 * | 3/2016 | Lambe | H04R 25/40 381/315 |

FOREIGN PATENT DOCUMENTS

| | | | |
|---|---|---|---|
| WO | 2009153718 | A1 | 12/2009 |
| WO | 20090153718 | A1 | 12/2009 |
| WO | 2013065010 | A1 | 5/2013 |

OTHER PUBLICATIONS

Jorge Meija et al., "The Effect of a Linked Bilateral Noise Reduction Processing on Speech in Noise Performance", Proceedings of ISAAR 2011, 2012, pp. 401-408, ISBN 87-990013-3-0, The Danavox Jubilee Foundation.

The International Search Report and the Written Opinion of the International Searching Authority issued on May 18, 2015 (May 18, 2015) for corresponding PCT Application No. PCT/US2015/015271.

Yoiti Suzuki, et al: "Paper Special Section on Advanced Signal Processing Techniques for Analysis of Acoustical and Vibrational Signals New Design Method of a Binaural Microphone Array Using Multiple Contraints", IEICE Trans. Fundamentals, Apr. 1, 199 (Apr. 1, 1999), XP055184552, Retrieved from the Internet: URL:http://citeseerx.inst.psu.edu/viewdoc/download?doi=10.1.1.29.7694&rep=rep1&type=pdf [retrieved on Apr. 12, 2015].

Nishimura R, et al "A new adaptive binaural microphone array system using a weighted least squares algorithm", 2002 IEEE International Conference on Acoustics, Speech, and Signal Processing. Proceedings. (ICASSP). Orlando, Fl, May 13-17, 2002; [IEEE International Conference on Acoustics, Speech, and Signal Processing (ICASSP0), New York, NY: IEEE, US, May 13, 2002 (May 13, 2002), pp. II-1925, XP032015179, DOI: 10.1109/ICASSP.2002.5745005 ISBN: 978-0-7803-7402-7.

* cited by examiner

CONVERSATION ASSISTANCE SYSTEM

CROSS-REFERENCE TO RELATED APPLICATION

This application claims priority of Provisional Patent Application Ser. No. 61/937,873, filed on Feb. 10, 2014, the entire contents of which are incorporated herein by reference.

BACKGROUND

Conversation assistance devices aim to make conversations more intelligible and easier to understand. These devices aim to reduce unwanted background noise and reverberation. One path toward this goal concerns linear, time-invariant beamforming with a head-mounted microphone array. Application of linear beamforming to conversation assistance is, in general, not novel. Improving speech intelligibility with directional microphone arrays, for example, is known.

For a directional microphone array aimed at a talker in the presence of diffuse noise, an increase in array directivity yields an increase in talker-to-noise ratio (TNR). This increase in TNR can lead to an increase in speech intelligibility for a user listening to the array output. Excluding some complexities discussed later, increasing array directivity increases speech intelligibility gain.

Consider the four microphone array 10 in FIG. 1 located on the head of a user. In a prior art beamforming approach, the arrays are designed assuming the individual microphone elements are located in the free field. An array for the left ear is created by beamforming the two left microphones 20 and 21. The right ear array is created by beamforming the two right microphones 22 and 23. Well-established free field beamforming techniques for such simple, two-element arrays can create hypercardioid free-field reception patterns, for example. Hypercardioids are common in this context, as in the free-field they produce optimal TNR improvement for a two element array for an on-axis talker in the presence of diffuse noise. Arrays such as array 10 when designed for free field performance may not meet performance criteria when placed on the head because of the acoustic effects of the head on sound received by the microphone elements that make up the array. Further, arrays such as array 10 may not provide sufficiently high directivity to significantly improve speech intelligibility.

Head-mounted arrays, especially those with high directivity, can be large and obtrusive. An alternative to head-mounted arrays are off-head microphone arrays, which are commonly placed on a table in front of the listener or on the listener's torso, after which the directional signal is transmitted to an in-ear device commonly employing hearing-aid signal processing. Although these devices are less obtrusive, they lack a number of important characteristics. First these devices are typically monaural, transmitting the same signal to both ears. These signals are devoid of natural spatial cues and the associated intelligibility benefits of binaural hearing. Second, these devices may not provide sufficiently high directivity to significantly improve speech intelligibility. Third, these devices do not rotate with the user's head and hence do not focus sound reception toward the user's visual focus. Also, the array design may not take into account the acoustic effects or the structure that the microphones are mounted to.

White noise gain (WNG) describes the amplification of uncorrelated noise by the array processing and is well defined in the art. WNG is essentially the ratio of total array filter energy to received pressure through the array for an on-axis source. This quantity describes how array losses due to destructive interference will increase the system noise floor, for example. A simple hypercardioid array is a lossy array which may yield too much self-noise when equalized for flat on-axis response. Failure to consider the WNG of a particular array design can result in a system with excessive self-noise.

SUMMARY

All examples and features mentioned below can be combined in any technically possible way.

In one aspect a conversation assistance system includes a bi-lateral array of microphones arranged externally of a space that does not include any array microphones, where the space has a left side, a right side, a front and a back, the array comprising a left side sub-array of multiple microphones and a right side sub-array of multiple microphones, where each microphone has a microphone output signal. There is a processor that creates from the microphone output signals a left-ear audio signal and a right-ear audio signal. The left-ear audio signal is created based on the microphone output signals from one or more of the microphones of the left-side sub-array and one or more of the microphones of the right-side sub-array and the right-ear audio signal is created based on the microphone output signals from one or more of the microphones of the left-side sub-array and one or more of the microphones of the right-side sub-array.

Examples of the system may include one of the following features, or any combination thereof. The processor may comprise a filter for the output signal of each microphone that is involved in the creation of the audio signals. These filters may be created using at least one polar specification comprising the magnitude and phase of idealized output signals of one or both of the left-side sub-array and the right-side sub-array as a function of frequency. There may be separate polar specifications for each sub-array. The processor may create both the left- and right-ear audio signals based on the microphone output signals from all of the microphones of the left-side sub-array and all of the right-side sub-array. The processor may create both the left- and right-ear audio signals based on the microphone output signals from all of the microphones of the left-side sub-array and all of the right-side sub-array, but only below a predetermined frequency. A polar specification may include a horizontal angle over an angular range at zero degrees azimuth.

In one non-limiting example a polar specification is based on polar head-related transfer functions of each ear of a binaural dummy. In another non-limiting example a polar specification is based on polar head-related transfer functions of each ear of a person's head. In another non-limiting example a polar specification is based on a model.

Examples of the system may include one of the following features, or any combination thereof. The processor may create both the left- and right-ear audio signals based on the microphone output signals from one or more of the microphones of the left-side sub-array and one or more of the microphones of the right-side sub-array, but only below a predetermined frequency. Above the predetermined frequency the processor may create the left-ear audio signal based only on the microphone output signals from microphones of the left-side sub-array and may create the right-ear audio signal based only on the microphone output signals from the microphones of the right-side sub-array.

The left side sub-array may be arranged to be worn proximate the left side of a user's head and the right side sub-array may be arranged to be worn proximate the right side of the user's head. The left side sub-array microphones may be spaced along the left side of the space and the right side sub-array microphones may be spaced along the right side of the space. The array of microphones may further comprise at least one microphone located along either the front or back of the space. In a specific non-limiting example, the array of microphones comprises at least seven microphones, with at least three spaced along the left side of the space, at least three spaced along the right side of the space, and at least one at the front or back of the space.

Examples of the system may include one of the following features, or any combination thereof. The processor may be configured to attenuate sounds arriving at the microphone array from outside of a predetermined pass angle from a primary receiving direction of the array. The predetermined pass angle may be from approximately +/−15 degrees to approximately +/−45 degrees from the primary receiving direction. The conversation assistance system may further comprise functionality that changes the predetermined pass angle. The predetermined pass angle may in one case be changed based on movements of a user. The predetermined pass angle may in one case be changed based on tracking movements of a user's head.

Examples of the system may include one of the following features, or any combination thereof. The processor may be configured to process the microphone signals to create specific polar interaural level differences (ILDs) between the left and right ear audio signals. The processor may be configured to process the microphone signals to create specific polar interaural phase differences (IPDs) between the left and right ear audio signals. The processor may be configured to process the microphone signals to create specific polar ILDs and specific polar IPDs in the left and right ear audio signals, as if the sound source was at an angle that is different than the actual angle of the sound source to the array. The processor may be configured to process the microphone signals to create left and right ear audio signals, as if the sound source was at an angle that is different than the actual angle of the sound source to the array.

Examples of the system may include one of the following features, or any combination thereof. The microphone array may have a directivity that establishes the primary receiving direction of the array, and the conversation assistance system may further comprise functionality that changes the array directivity. The conversation assistance system may further comprise a user-operable input device that is adapted to be manipulated so as to cause a change in the array directivity. The user-operable input device may comprise a display of a portable computing device. The array directivity may be changed automatically. The array directivity may be changed based on movements of a user. The array directivity may be changed based on likely locations of acoustic sources determined based on energy received by the array. The array can have multiple directivities. The conversation assistance system may comprise a binaural array with ILDs and IPDs that correspond to the orientation angle for each array directivity.

Examples of the system may include one of the following features, or any combination thereof. The left side sub-array may be coupled to left side of a cell phone case that is adapted to hold a cell phone. The right side sub-array may be coupled to the right side of the cell phone case. The array may be constrained to have a maximum white noise gain (WNG). The maximum WNG may be determined based on a ratio of environmental noise to array induced noise.

Examples of the system may include one of the following features, or any combination thereof. A sound source at one angle may be reproduced by a binaural beamformer with IPDs and ILDs that correspond to a different angle. The IPD and ILD may be processed to match a perceived angle that is different than the angle from which the energy was actually received by the array. The perceived angle may be greater than or less than the angle from which the energy was actually received.

Examples of the system may include one of the following features, or any combination thereof. The system may be used with active noise reducing (ANR) electroacoustic transducers (e.g., ANR headphones or earbuds). The array may have a directivity index (DI), and the amount of noise reduction accomplished with the electroacoustic transducers may be equal to or greater than the DI of the array. At least some of the system processing may be accomplished by a processor of a portable computing device, such as a cell phone, a smart phone or a tablet, for example. The conversation assistance system may comprise at least two separate physical devices each with a processor, where the devices communicate with each other via wired or wireless communication. One device may comprise a head worn device. One device may be adapted to perform hearing aid like signal processing. The devices may communicate wirelessly.

Examples of the system may include one of the following features, or any combination thereof. The apparent spatial width of the array may be increased by non-linear time-varying signal processing. The processor may be configured to process the microphone signals to create specific polar ILDs and specific polar IPDs in the left and right ear audio signals, to better match the physical orientations of desired talkers to a user of the system.

In another aspect a conversation assistance system includes a bi-lateral array of microphones arranged externally of a space that does not include any array microphones, where the space has a left side, a right side, a front and a back, the array comprising a left side sub-array of multiple microphones and a right side sub-array of multiple microphones, where each microphone has a microphone output signal, and a processor that creates from the microphone output signals a left-ear audio signal and a right-ear audio signal. The left-ear audio signal is created based on the microphone output signals from one or more of the microphones of the left-side sub-array and one or more of the microphones of the right-side sub-array, but only below a predetermined frequency, and the right-ear audio signal is created based on the microphone output signals from one or more of the microphones of the left-side sub-array and one or more of the microphones of the right-side sub-array, but only below a predetermined frequency. Above the predetermined frequency the processor creates the left-ear audio signal based only on the microphone output signals from microphones of the left-side sub-array and creates the right-ear audio signal based only on the microphone output signals from the microphones of the right-side sub-array. The processor is configured to process the microphone signals to create specific polar interaural level differences (ILDs) and specific polar interaural phase differences (IPDs) between the left and right ear audio signals.

In another aspect a conversation assistance system includes a bi-lateral array of microphones that are coupled to a portable device and arranged on the portable device, the array comprising a left side sub-array of multiple microphones and a right side sub-array of multiple microphones, wherein the microphone array has a directivity that establishes the primary receiving direction of the array, and wherein each microphone has a microphone output signal, and a processor that creates from the microphone output signals a left-ear audio signal and a right-ear audio signal. The left-ear audio signal is created based on the microphone output signals from one or more of the microphones of the left-side sub-array and one or more of the microphones of the right-side sub-array, but only below a predetermined frequency. The right-ear audio signal is created based on the microphone output signals from one or more of the microphones of the left-side sub-array and one or more of the microphones of the right-side sub-array, but only below a predetermined frequency. Above the predetermined frequency the processor creates the left-ear audio signal based only on the microphone output signals from microphones of the left-side sub-array and creates the right-ear audio signal based only on the microphone output signals from the microphones of the right-side sub-array. The processor is configured to process the microphone signals to create specific polar interaural level differences (ILDs) and specific polar interaural phase differences (IPDs) between the left and right ear audio signals. There is a user-operable input device that is adapted to be manipulated so as to cause a change in the array directivity.

DETAILED DESCRIPTION

One class of beamforming is known in the art as superdirective. Superdirective beamformers are those with inter-microphone spacing, d, less than half a wavelength, λ, of incident sound ($d<\lambda/2$), and which utilize destructive interference between filtered microphone signals to obtain high array directivity. Arrays for conversation assistance may utilize superdirective beamforming in most of the array bandwidth for two complimentary reasons. First, due to the size of the human head the inter-microphone spacing of a head-worn array is small relative to incident wavelengths of sound of lower frequencies in the speech band. Second, high array directivity is needed in order to substantially reduce background noise and reverberation, increase the TNR, and improve intelligibility and ease of understanding in noisy environments.

High array directivity from superdirective beamforming comes at the cost of destructive interference within the array. This destructive interference not only reduces the received magnitude of signals from unwanted angles, but also from desired angles. Reduction of desired, or on-axis, signal magnitudes can be corrected by equalizing the array output or normalizing array filters to unity gain on-axis, for example. For unconstrained superdirective arrays, the resulting equalization filter or normalized array filter magnitudes can climb without hound. In practice such high gains result in array instability due to microphone sensitivity drift and excessive amplification of noise uncorrelated across microphones in the array. Examples of uncorrelated noise sources include microphone self-noise, the noise floor of electronics attached to each microphone, wind noise, and noise from mechanical interaction with the array. This noise sensitivity, also known as white noise gain (WNG), is given by:

$$\Psi=RR^H/(RS_0S_0^HR^H),$$

where R is the 1×L vector of complex filter coefficients applied to each of L microphones, $S_0$ is the L×1 vector of on-axis acoustic responses of each of L microphones, and H is the Hermetian or conjugate transpose operator. Each coefficient is a function of frequency, however, frequency is suppressed in the notation for simplicity. WNG describes the amplification of uncorrelated noise relative to the on-axis gain of the array. Arrays with excessive WNG can result in, for example, audible noise on the array output, excessive amplification of wind noise, and poor directivity due to a small drift in inter-microphone sensitivity.

Figure 2A:
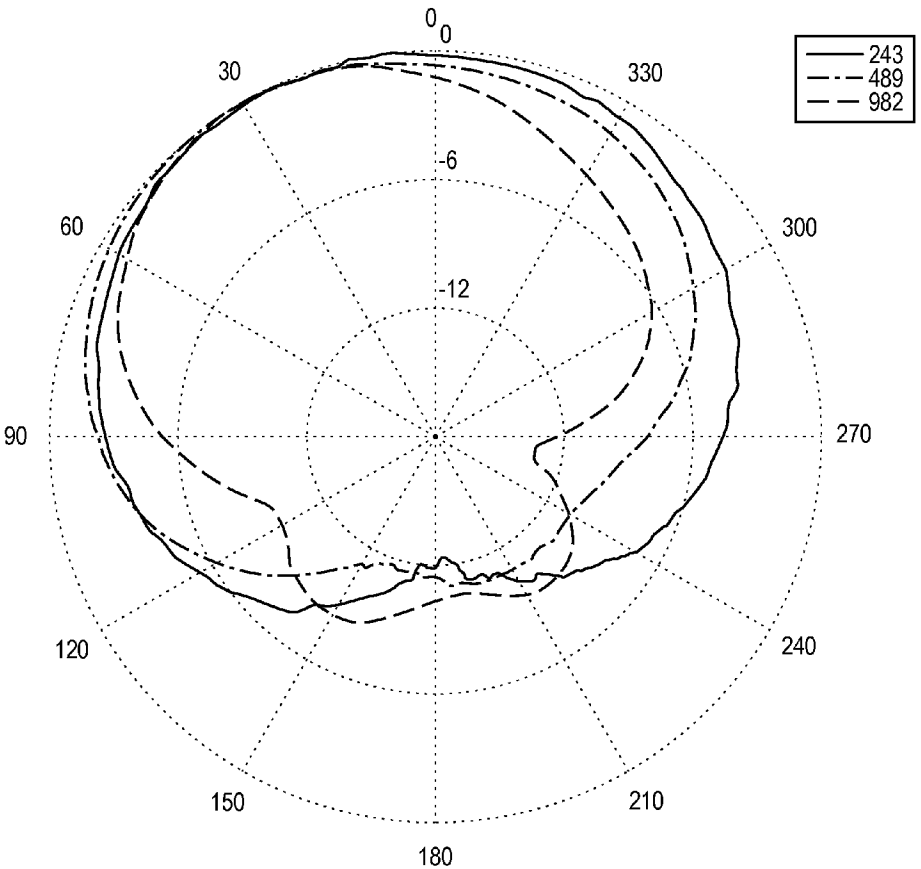
FIGS. 2A and 2B illustrate the approximately hypercardioid on-head polar response of the left-ear two-element (i.e., one sided) array of FIG. 1 with and without a 15 dB maximum WNG constraint, respectively. The polar plots herein, including those of FIG. 2, plot dB vs. angle, with the plotted frequencies given in the key.
Figure 2B:
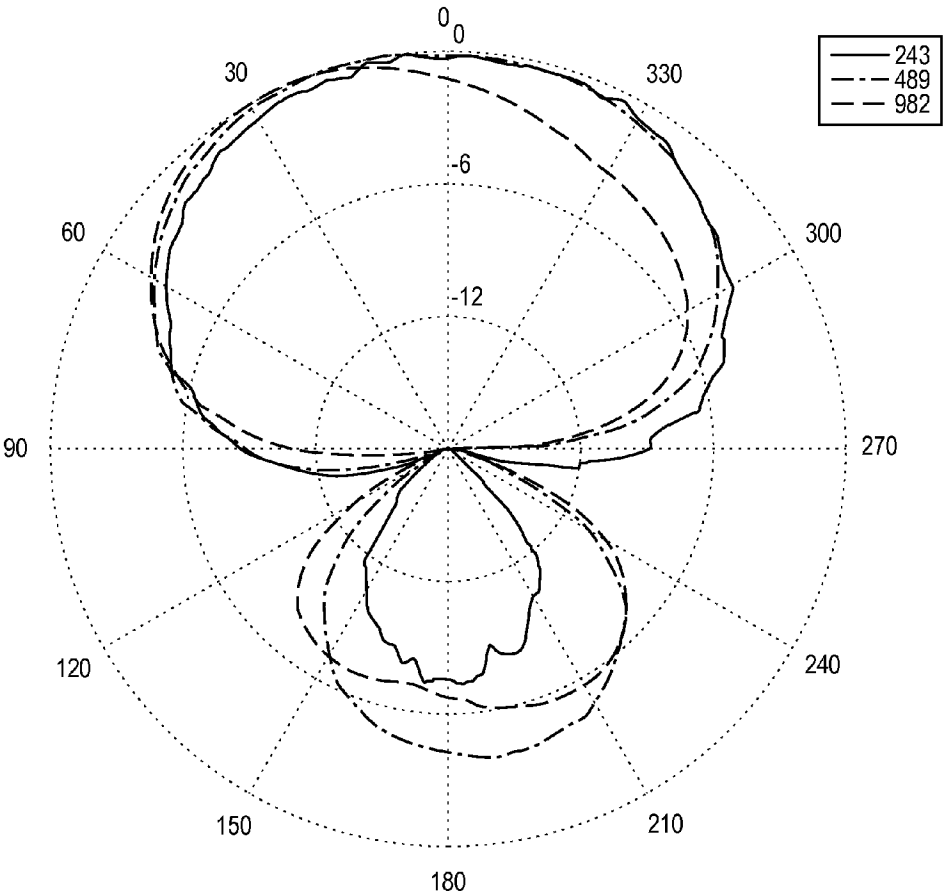

In some examples, it may be desirable to limit or constrain the WNG of an array to a predetermined value. A method of accomplishing an array design where the WNG is so limited using an array filter design process is discussed later. Limiting array WNG not only reduces the deleterious effects of excessive WNG, but also reduces array directivity at frequencies where the array would otherwise have WNG in excess of the specified WNG maximum. In other words, WNG and array directivity present a design trade-off. FIG. 2 shows the on-head response (dB vs. angle plotted) of an approximately hypercardioid (in the free-field) array with (in FIG. 2A) and without (in FIG. 2B) a WNG limitation of approximately 15 dB. The plotted frequencies of these and the other polar plots are set forth in the key. The WNG-limited array of FIG. 2A has lower directivity, however, this array will not amplify uncorrelated noise to the extent of the unconstrained array.

Unbiased comparisons of array directional performance should take into account the directivity and WNG trade-off. In the following sections, each array will be limited to a maximum WNG of 15 dB. This constraint is based on audibility of self-noise from microphones and electronics typical of hearing assistance applications. This constraint is exemplary and does not limit the scope of the disclosure. The WNG-constrained array in FIG. 2A thus represents an on-head, directional performance benchmark typical of simple, two-element arrays.

The WNG limitation may be selected based on other considerations beyond electrical self-noise. Arrays used in presence of wind, for example, may require a lower maximum WNG constraint to limit sensitivity to noise excited by turbulent air flow over microphones in the array. In this case, a WNG limitation of less than 5 to 10 dB, or some amount less than 15 dB may be desirable. Other considerations, such as loud environmental noise, may allow for higher WNG constraints. If the spectrum of environmental noise significantly overlaps the noise spectrum due to WNG, and if the environmental noise level is significantly higher than that caused by WNG, the environmental noise will mask the WNG-related noise. In this case, a higher maximum WNG constraint may be used to increase array directivity without causing audible noise on the array output. The ratio of environmental noise to array-induced (WNG) noise can be used to find a reasonable value for the WNG constraint.

In the following sections, all comparisons of array directional performance will be based on on-head data unless stated otherwise. In this way the relevant, potentially deleterious acoustic effects of the head are included.

In order to more clearly show the benefits of using on-head data for array design, array filters designed using on-head data and array filters designed using free-field (off-head) data where applicable are in some cases contrasted with each other. In the following sections, the design condition of array filters will be noted.

The output of a microphone array must be played back to the user through electroacoustic transduction. For a conversation enhancement system, the playback system can comprise headphones. The headphones may be over the ear or on the ear. The headphones may also be in the ear. Other sound reproduction devices may have the form of an ear bud that rests against the opening of the ear canal. Other devices may seal to the ear canal, or may be inserted into the ear canal. Some devices may be more accurately described as hearing devices or hearing aids. In the following sections, use of noise reducing (e.g. noise isolating or active noise reduction) headphones is assumed unless otherwise mentioned. Applications of non-noise cancelling headphones with conversation assistance systems will also be discussed later.

Two-Sided Beamforming

Throughout the discussion of two-sided beamforming, array filters have been designed using free-field microphone response data and an array filter design process (which is discussed later). The calculated array performance shown in polar plots and directivity indices, however, shows on-head performance to more closely represent array performance when the device is worn on-head.

In an earlier example, the design of single sided arrays was described. Single sided arrays are formed using two or more microphone elements that are located only on one side of the head to generate the ipsilateral array output signal.

Two-sided beamforming of the arrays of microphones on the left and right sides of the head involves utilizing at least one (and preferably all) of the microphones on both sides of the head to create both the left- and right-ear audio signals. This arrangement may be termed a "two-sided array." Preferably but not necessarily the array comprises at least two microphones on each side of the head. Preferably but not necessarily the array also comprises at least one microphone in front of and/or behind the head. Other non-limiting examples of arrays that can be employed in the present disclosure are shown and described below. Two sided arrays can provide improved performance compared to one sided arrays by increasing the number of elements that can be used and increasing the spacing of at least some of the individual elements relative to other elements (elements on opposite sides of the head will be spaced farther apart than elements on the same side of the head).

Figure 3:
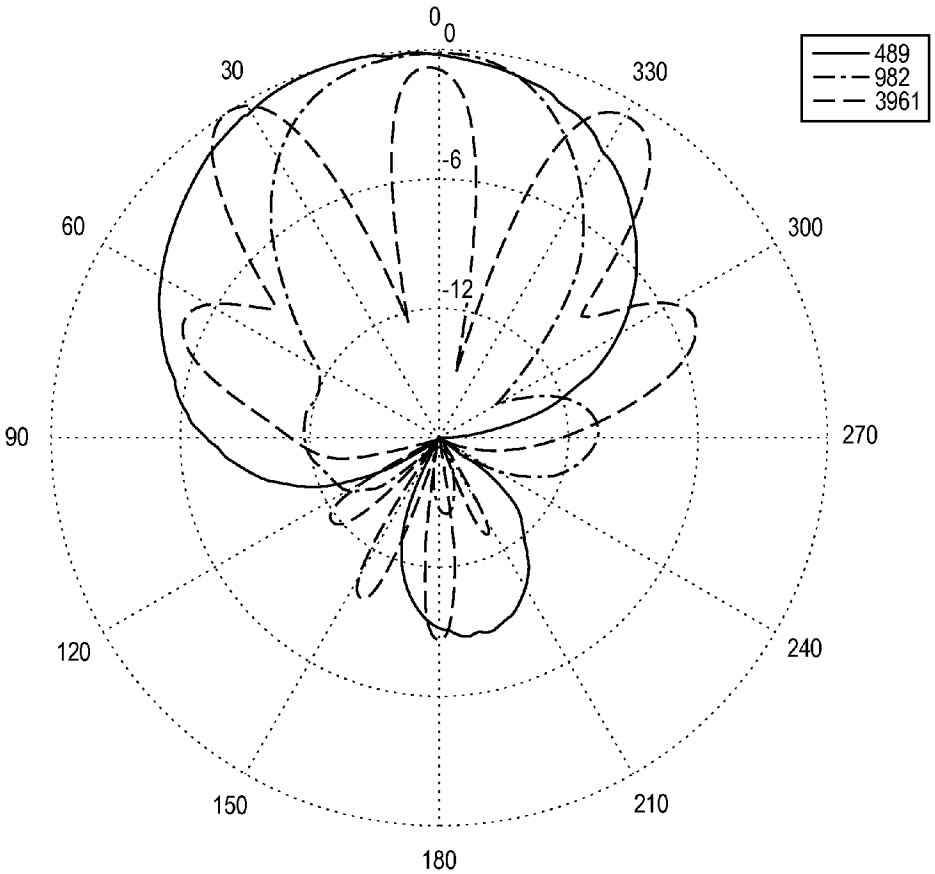
FIG. 3 illustrates the on-head polar response of the left ear of an array that uses all four microphones (i.e., two sided) of the array of FIG. 1.
Figure 4:
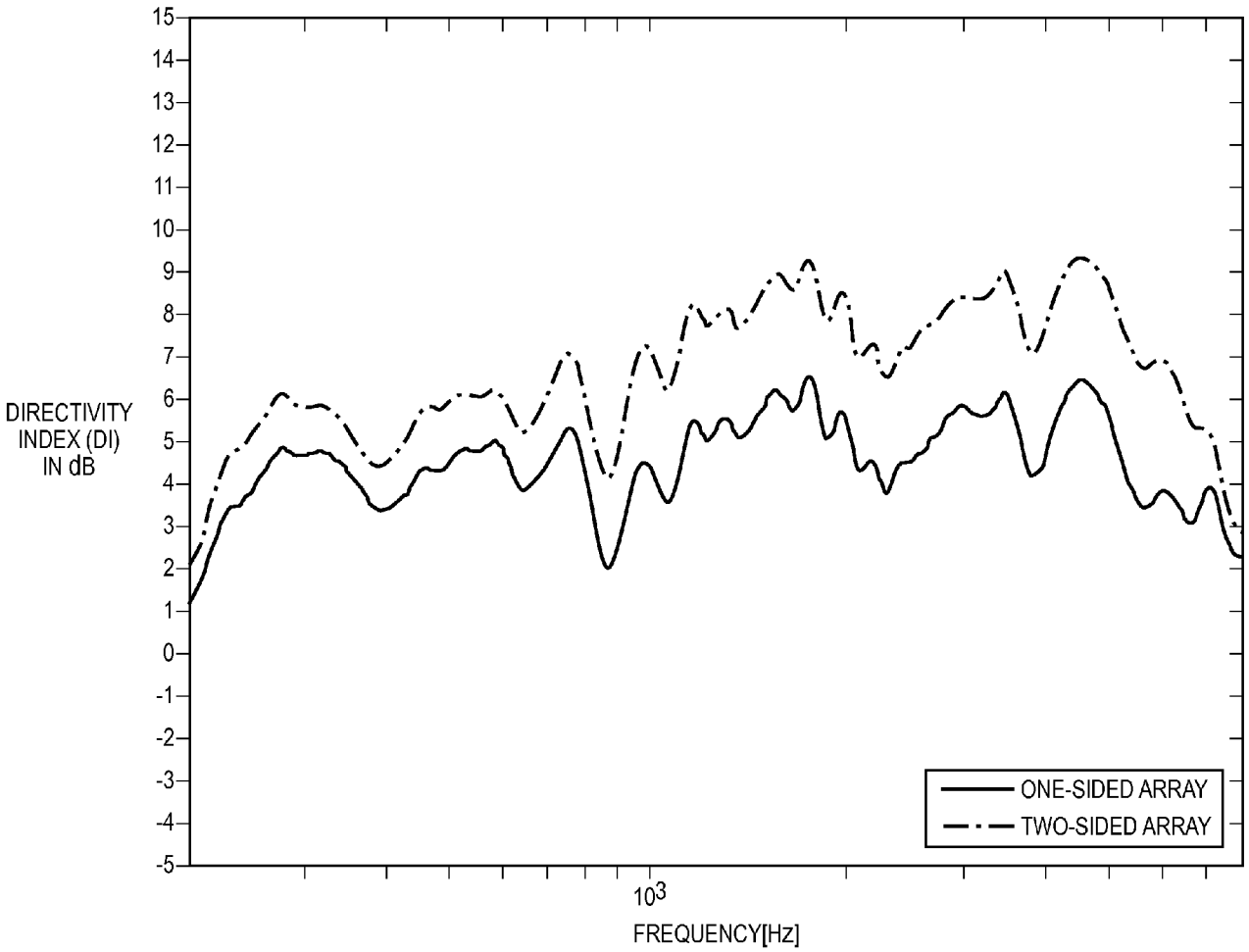
FIG. 4 illustrates the on-head 3L) directivity indices (DI) (frequency vs. DI (in dB)) of one-sided and two-sided arrays for the array of FIG. 1. Each curve represents the average DI of the respective left- and right-ear arrays.
Figure 5:
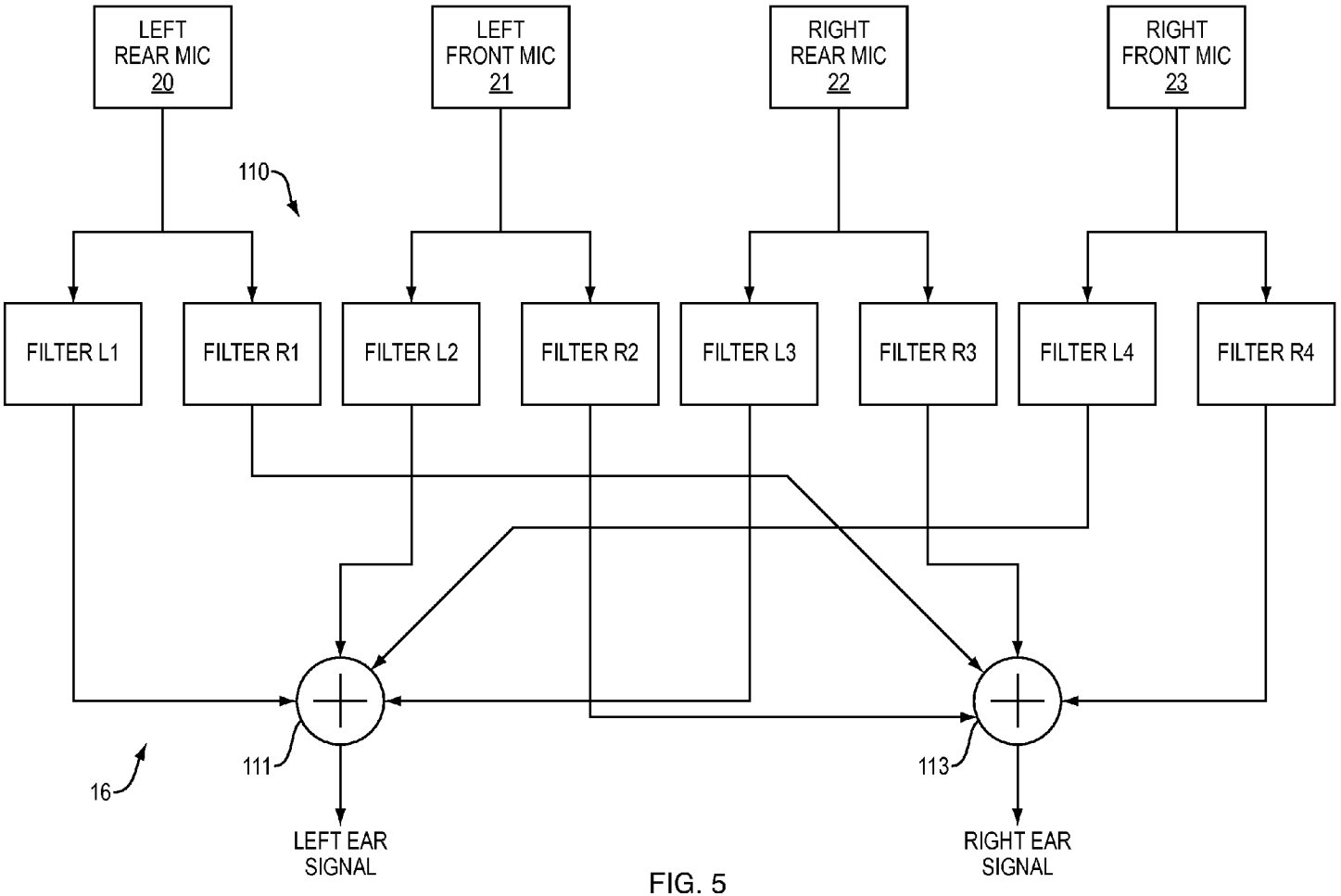
FIG. 5 is a simplified schematic block signal processing diagram for a system using a two-sided four-element array.

Using all microphones in the array to create the audio signal for each ear can substantially increase the ability to meet design objectives when coupled with an array filter design process, discussed below. One possible design objective is for increased directivity. FIG. 3 shows the on-head polar response of a two-sided array. FIG. 4 shows on-head, 3D directivity indices (DIs) for one- and two-sided arrays (both using array 10, FIG. 1). The two-sided approach where all four microphones are used to create both the left and right-ear audio signals yields up to a 3 dB increase in directivity index (DI). FIG. 5 is a simplified block signal-processing diagram 16 showing an arrangement of filters for such a two-sided array. The figure omits details such as A/Ds, D/As, amplifiers, non-linear signal processing functions such as dynamic range limiters, user interface controls and other aspects which would be apparent to one skilled in the art. It should also be noted that all of the signal processing for the conversation enhancement device including the signal processing shown in FIG. 5 (and signal processing omitted from the figure, including the individual microphone array filters, summers that sum the outputs of the individual array filters, equalization for each ear signal, non-linear signal processing such as dynamic range limiters and manual or automatic gain controls, etc.) may be performed by a single microprocessor, a DSP, ASIC, FPGA, or analog circuitry, or multiple or combinations of any of the above. Set of array filters 110 includes a filter for each microphone, for each of the left and right audio signals. The left ear audio signal is created by summing (using summer 111) the outputs of all four microphones 20-23 filtered by filters L1, L2, L3 and L4, respectively. The right ear audio signal is created by summing (using summer 113) the outputs of all four microphones 20-23 filtered by filters R1, R2, R3 and R4, respectively. Development of the array filters is discussed below.

As noted previously, equalization may be needed to equalize the on axis output of the array processing. This equalization can be done as part of each individual microphone array filter, or can be done after summers 111 and 113. Additionally, dynamic range or other non-linear signal processing may be applied to each individual microphone signal, on the output of each summer, or on combinations of both. Such known processing details can be accomplished by any manner known in the art and are not limitations of the present disclosure.

As noted previously, there is a tradeoff between the array directivity achieved and the WNG of the array. The improvement described above by using two sided arrays can be used to improve directivity, to improve WNG, or can be split between both objectives. By using two sided arrays, combinations of constraints on directivity and WNG can be met that would not be possible with a single sided array.

Figure 6:
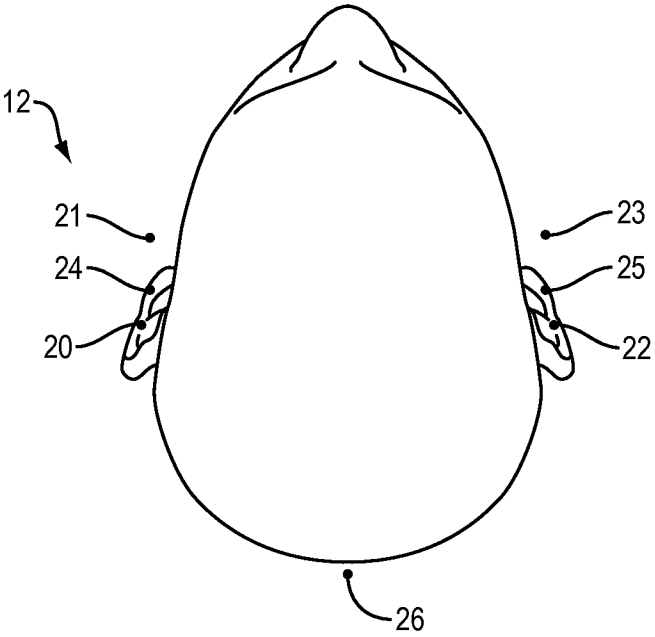
FIG. 6 illustrates one non-limiting microphone placement for a seven-element array.
Figure 7:
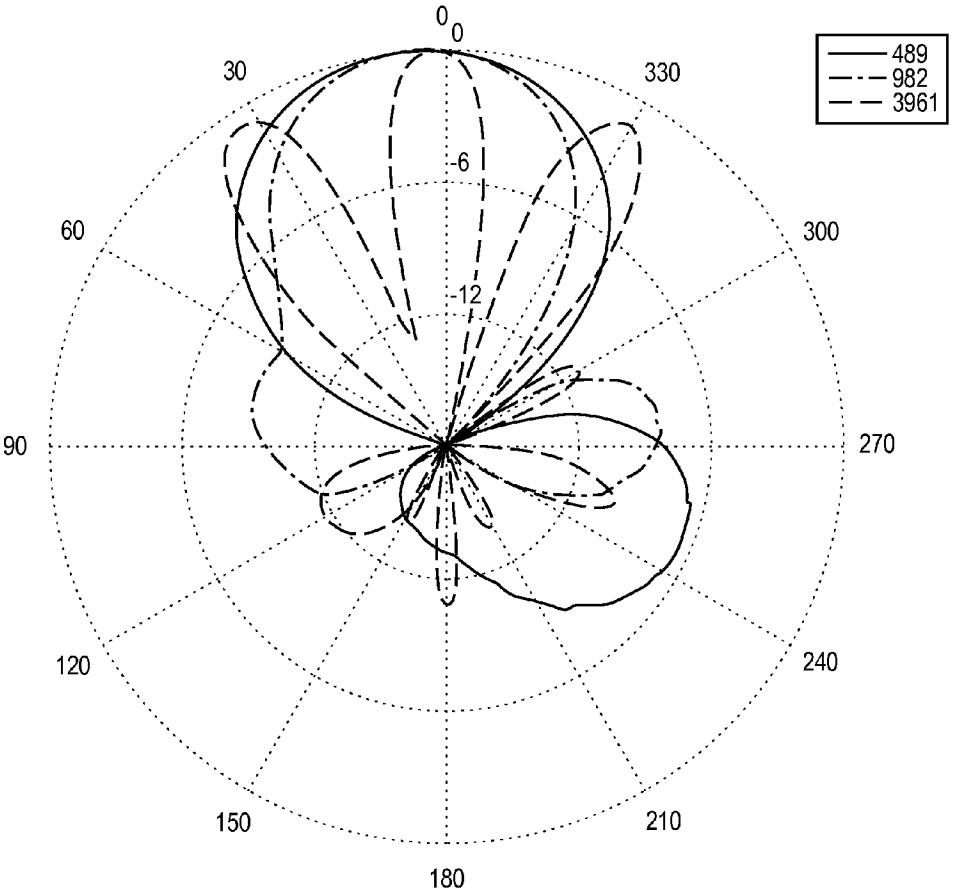
FIG. 7 illustrates the on-head polar response for the left ear of a two-sided array that uses all seven microphones of the array of FIG. 6.
Figure 8:
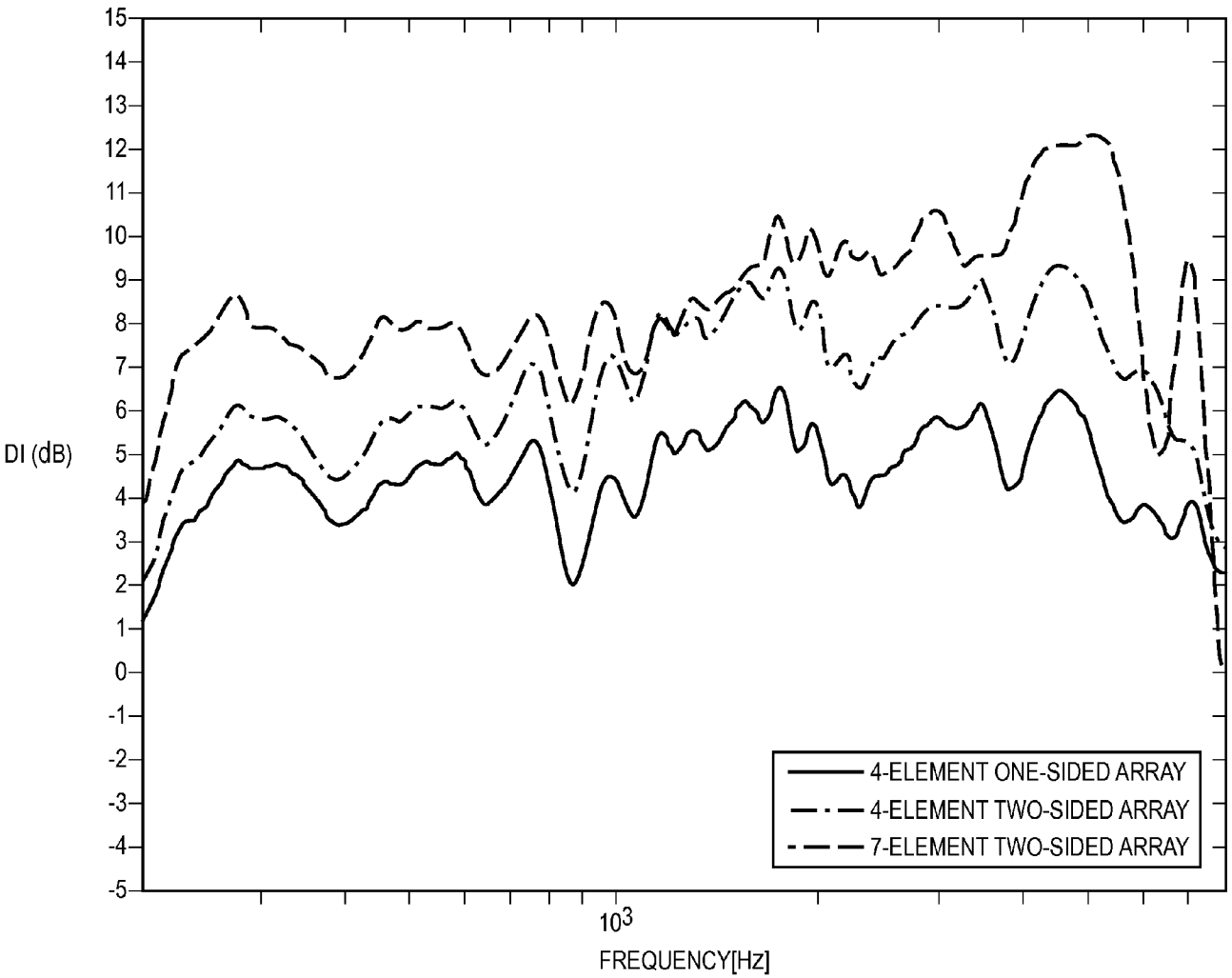
FIG. 8 illustrates the on-head three-dimensional DIs of the arrays of FIGS. 1 and 6, where each curve represents the average DI of the respective left- and right-ear array.

Two-sided beamforming can be applied to arrays of any number of elements, or microphones. Consider an exemplary, non-limiting seven-element array 12 as shown in FIG. 6, with three elements on each side of the head and generally near each ear (microphones 20, 24 and 21 on the left side of the head and proximate the left ear and microphones 22, 25 and 23 on the right side of the head and proximate the right ear) and one 26 behind the head. Note that there can be two or more elements on each side of the head, and microphone 26 may not be present, or it may be located elsewhere spaced from the left and right-side arrays, such as in front of or on top of the head, or on the bridge of a pair of eyeglasses. These elements may but need not all lie generally in the same horizontal plane. Also, mics may be located vertically above one another. FIG. 7 shows the on-head polar pattern resulting from two-sided beamforming with the seven-element array of FIG. 6, where all seven elements contribute to the creation of both the left and right-ear audio signals. FIG. 8 compares directivity indices of the different arrays (prior art four element one-sided array, and the four and seven element two sided arrays of the present disclosure, discussed above); as described above the WNG is 15 dB (maximum) at each frequency.

Note that in the example of one-sided four element array, the two left microphones proximate to the left ear are beamformed to create the left ear audio signal and the two right microphones proximate to the right ear are used to create the right ear audio signal. Although this array is referred to as a four-element array since there is a total of four microphones, only microphones on one side of the head are beamformed to create an array for the respective side. This differs from two-sided beamforming, where all microphones on both sides of the head are beamformed together to create both the left and right ear audio signals.

Figure 9:
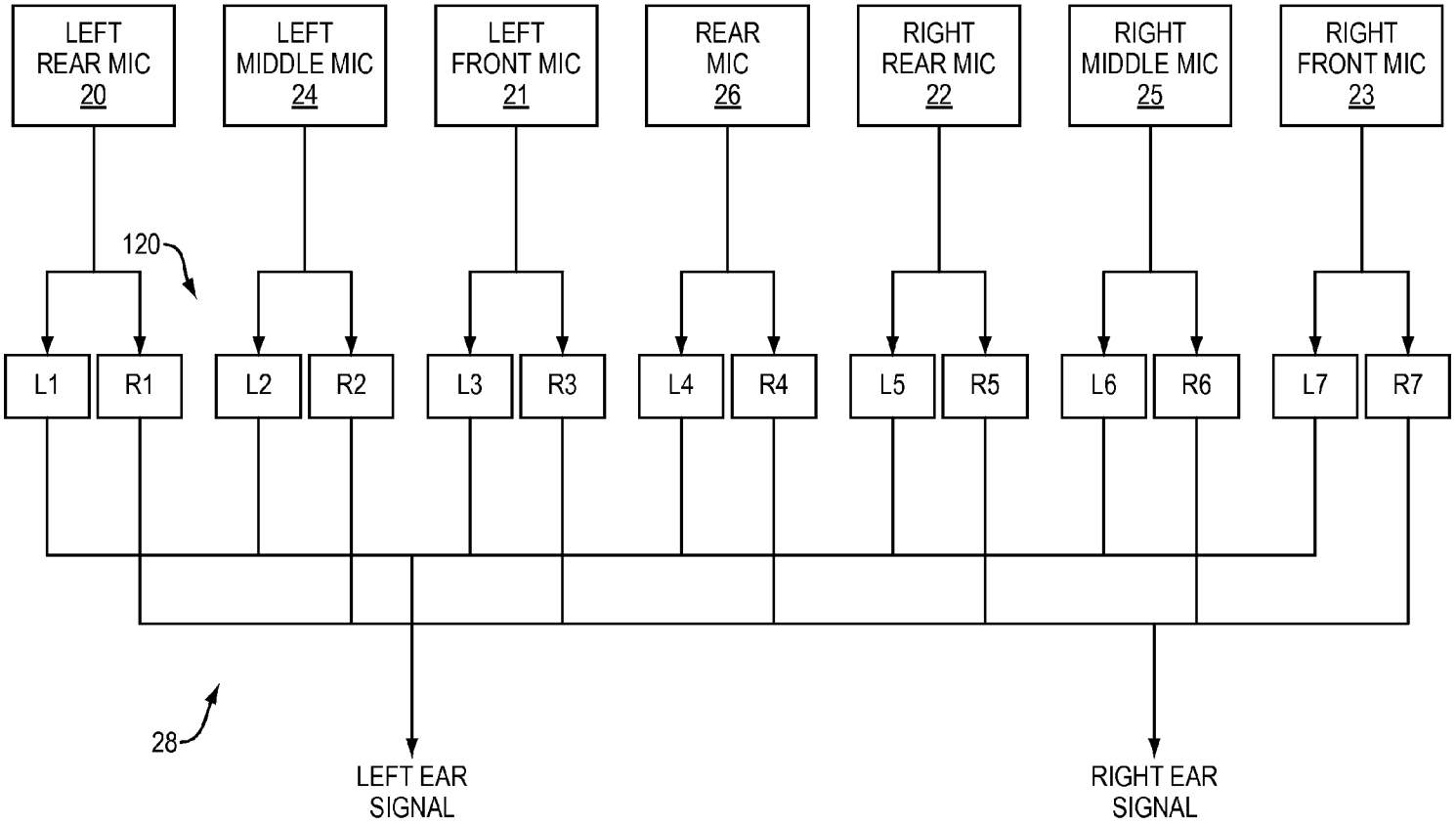
FIG. 9 is a simplified schematic block signal processing diagram for a conversation assistance system using a two-sided seven-element array.
Figure 10A:
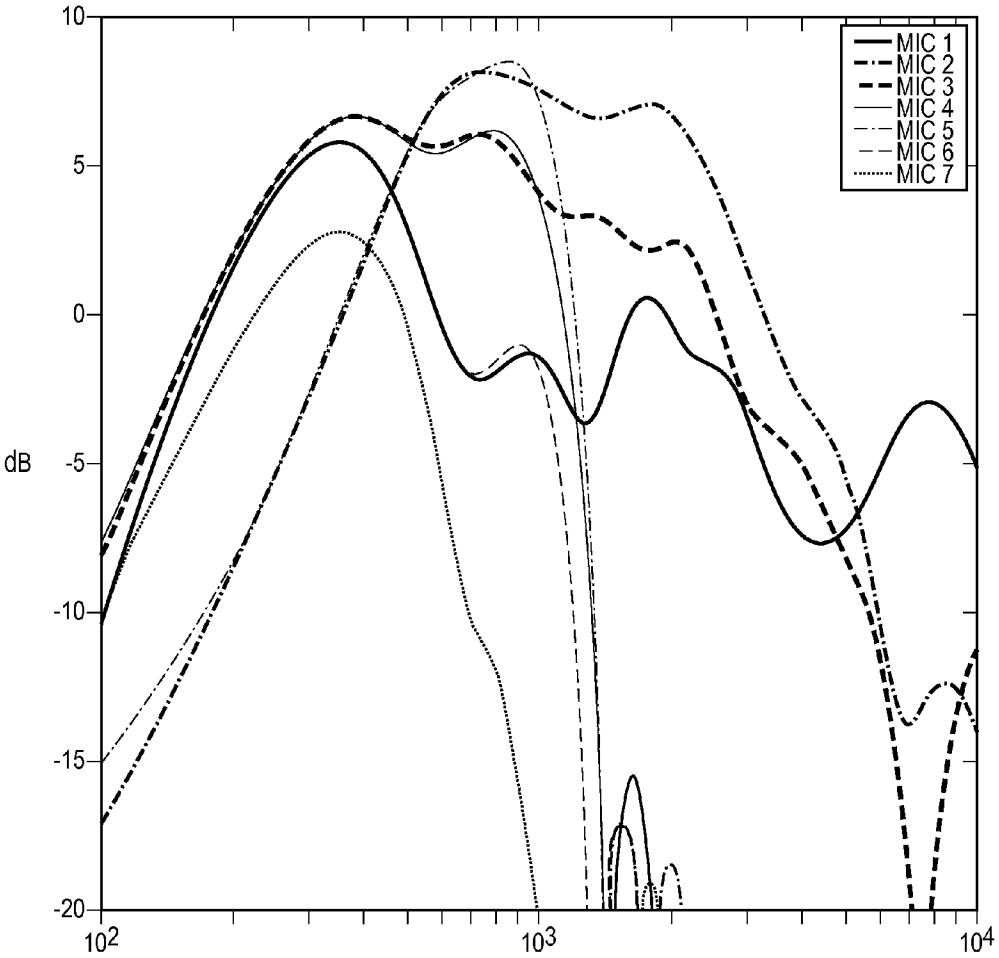
FIGS. 10A and 10B illustrate exemplary array filters for a seven-element two-sided array; the left and right ear array filters are shown separately in FIGS. 10A and 10B, respectively. Note: mic1=left front mic; mic2=left middle mic; mic3=left rear mic; mic4=right rear mic; mic5=right middle mic; mic6=right front mic; mic7=behind-head mic.
Figure 10B:
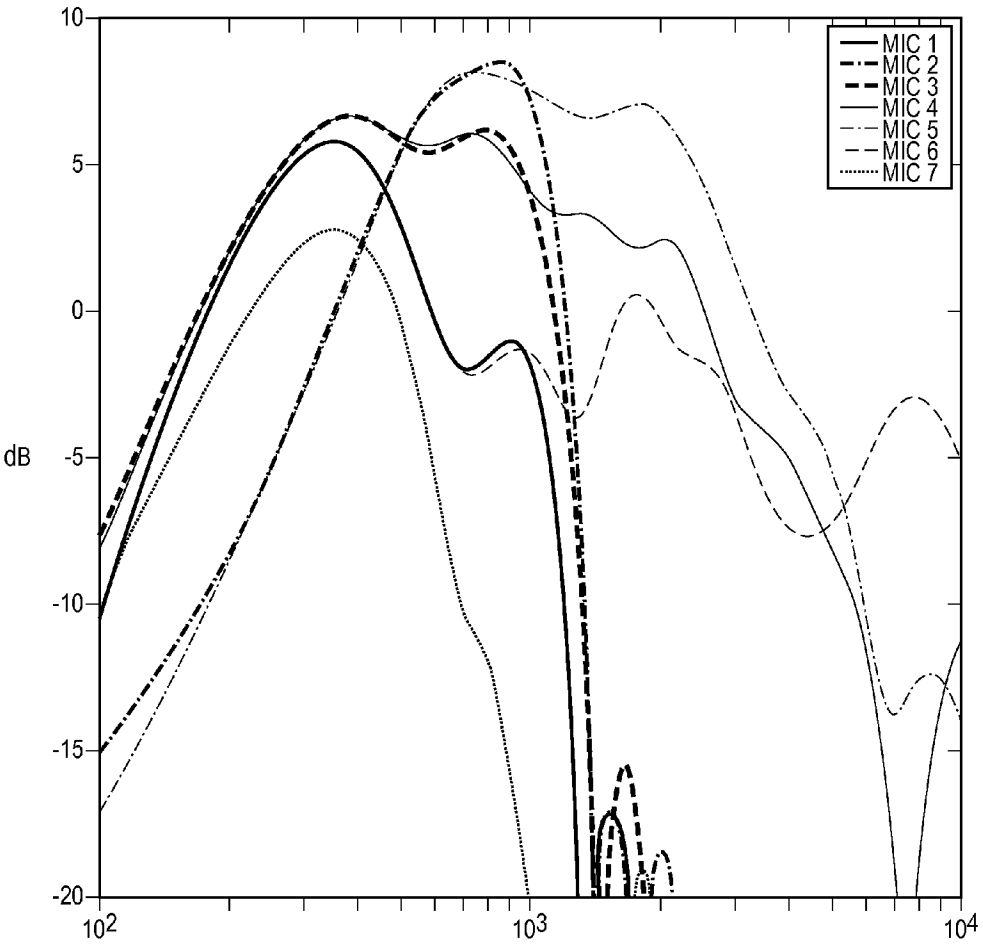

Microphones on the left side of the head are too distantly spaced from microphone elements on the right side of the head for desirable array performance above approximately 1200 Hz, for an array that combines outputs of the left and right side elements. To avoid polar irregularities, referred to as "grating lobes" in the literature, at higher frequencies, one side of two-sided arrays can be effectively low-passed above approximately 1200 Hz. In one non-limiting example, below a low pass filter corner frequency of 1200 Hz, both sides of the head are beamformed, while above 1200 Hz, the array transitions to a single-sided beamformer for each ear. In order to preserve spatial cues (e.g., differences in interaural levels and phase (or equivalently, time), the left-ear array uses only left-side microphones above 1200 Hz. Similarly, the right-ear array uses only right-side microphones above 1200 Hz. Each ear signal is formed from all array elements for frequencies below 1200 Hz. This bandwidth limitation can be implemented using the array filter design process discussed later, or can be implemented in other manners. FIG. 9 (which is simplified in a manner similar to that of FIG. 5) shows an extended signal processing diagram 28 for such a two-sided array comprising seven microphones 20-26 with a set 120 of left and right filters; filters 120 are used in the same manner as are the filters in FIG. 5. FIGS. 10A and 10B show an example set of array filters for a seven-element two-sided array (left filters in FIG. 10A and right filters in FIG. 10B). Note in FIGS. 10A and 10B that the 1200 Hz low-pass is effectively implemented within the array filters themselves. Alternatively, the low-pass could be implemented as a second filter stage.

Figure 11:
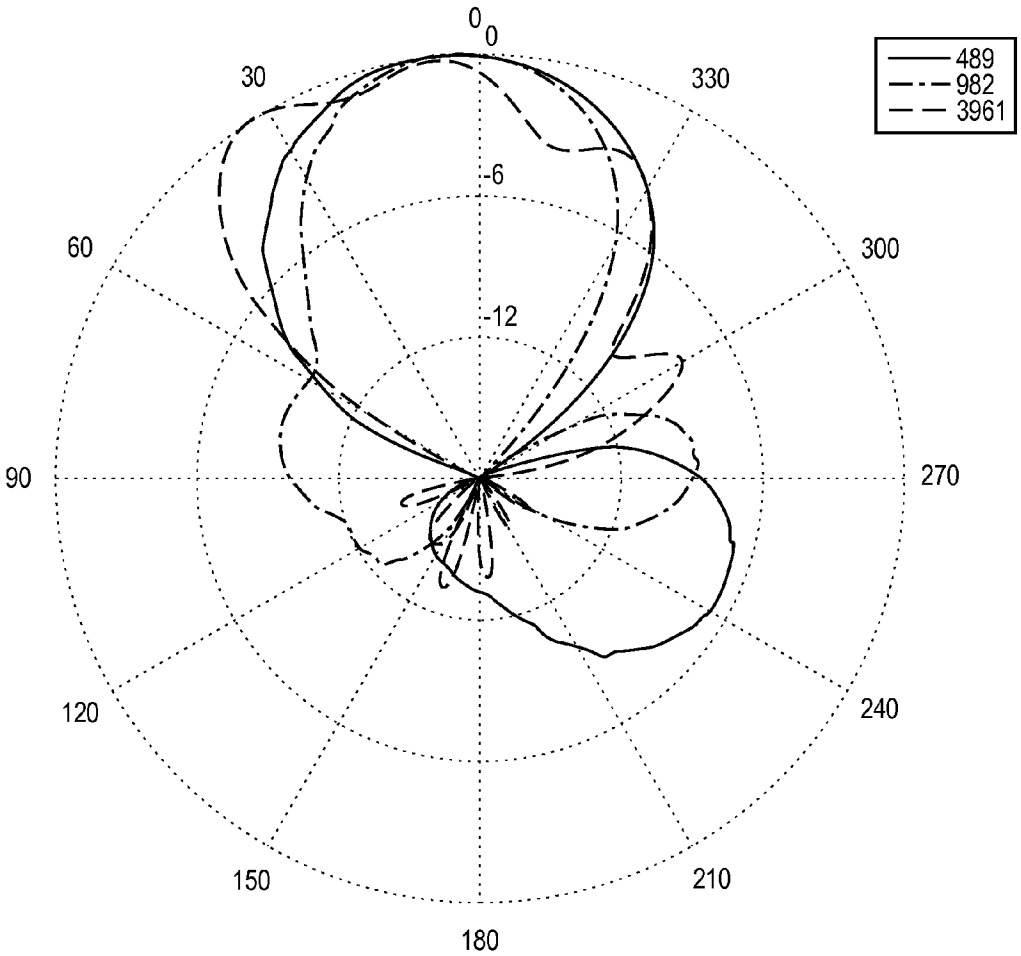
FIG. 11 illustrates the on-head polar response of the left ear of a two-sided array that uses all seven microphones of the array of FIG. 6, and using the filters of FIG. 10.

FIG. 11 shows the resulting polar performance of the same seven-element array with the left ear filters of FIG. 10 (which includes the low pass filtering described earlier), at three frequencies. The performance of the band limited two sided array shown in FIG. 11 can be contrasted with the performance of the two sided array without band limiting shown in FIG. 7. The behavior at higher frequencies (for example, as shown at about 4 KHz) is much more controlled and regular in the band limited two sided array of FIG. 11 than in the non-band limited two sided array of FIG. 7.

Figure 12:
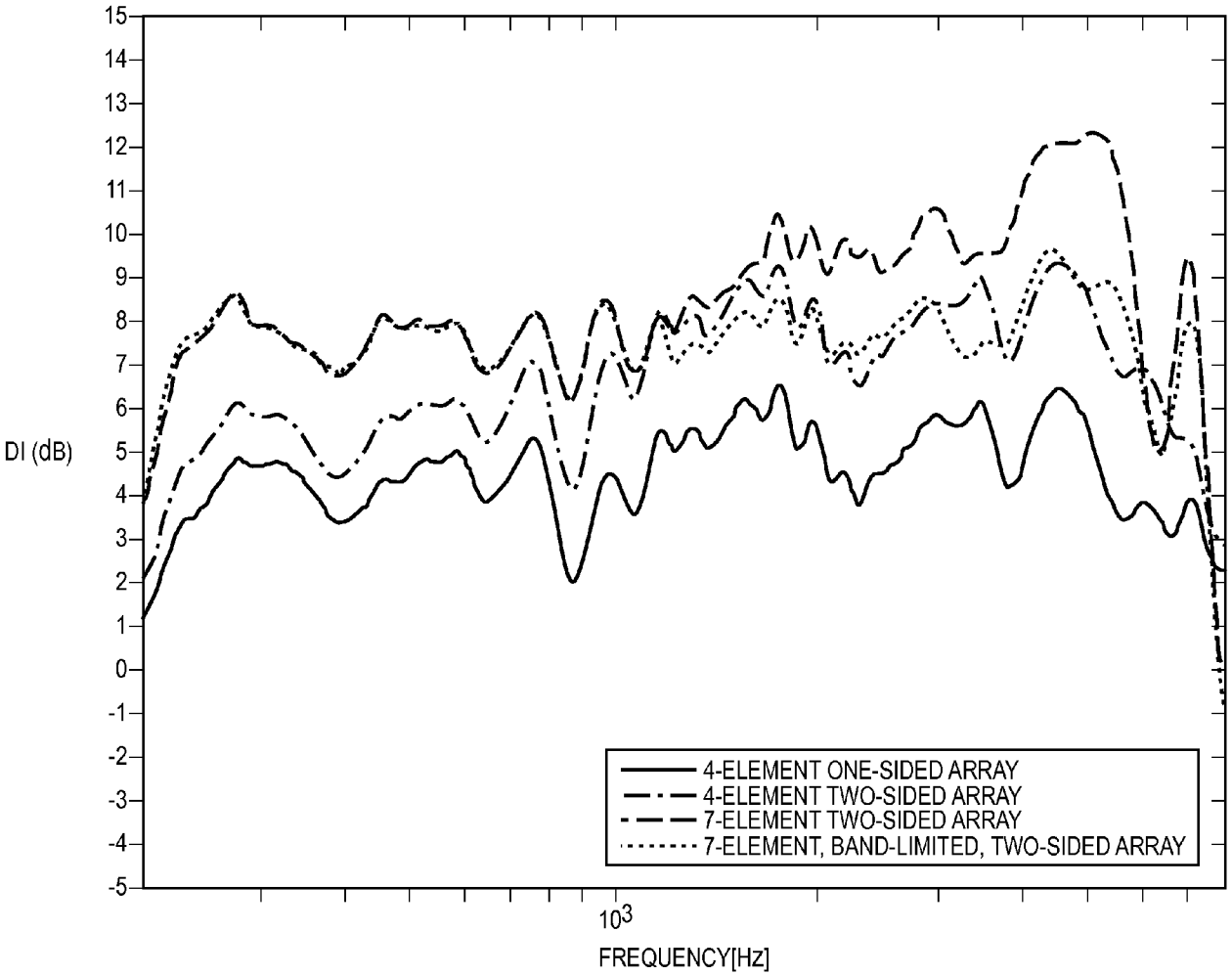
FIG. 12 illustrates the on-head three-dimensional DIs for four and seven-element arrays. The seven-element array uses the filters of FIG. 10. Each curve represents the average DI of the respective left- and right-ear array.

FIG. 12 shows the 3D on-head directivity indices for all of the above arrays including the one- and two-sided four-element arrays. Although a more regular polar response results by transitioning to a single-sided array at higher frequencies, the directivity index is accordingly lower. Values other than 1200 Hz may be appropriate depending on the desired directivity of the array. For less directional arrays, a lower cross-head corner frequency is desirable, such as 900 Hz. For more directional arrays, a higher corner frequency is desirable, such as 2 kHz.

Figure 13A:
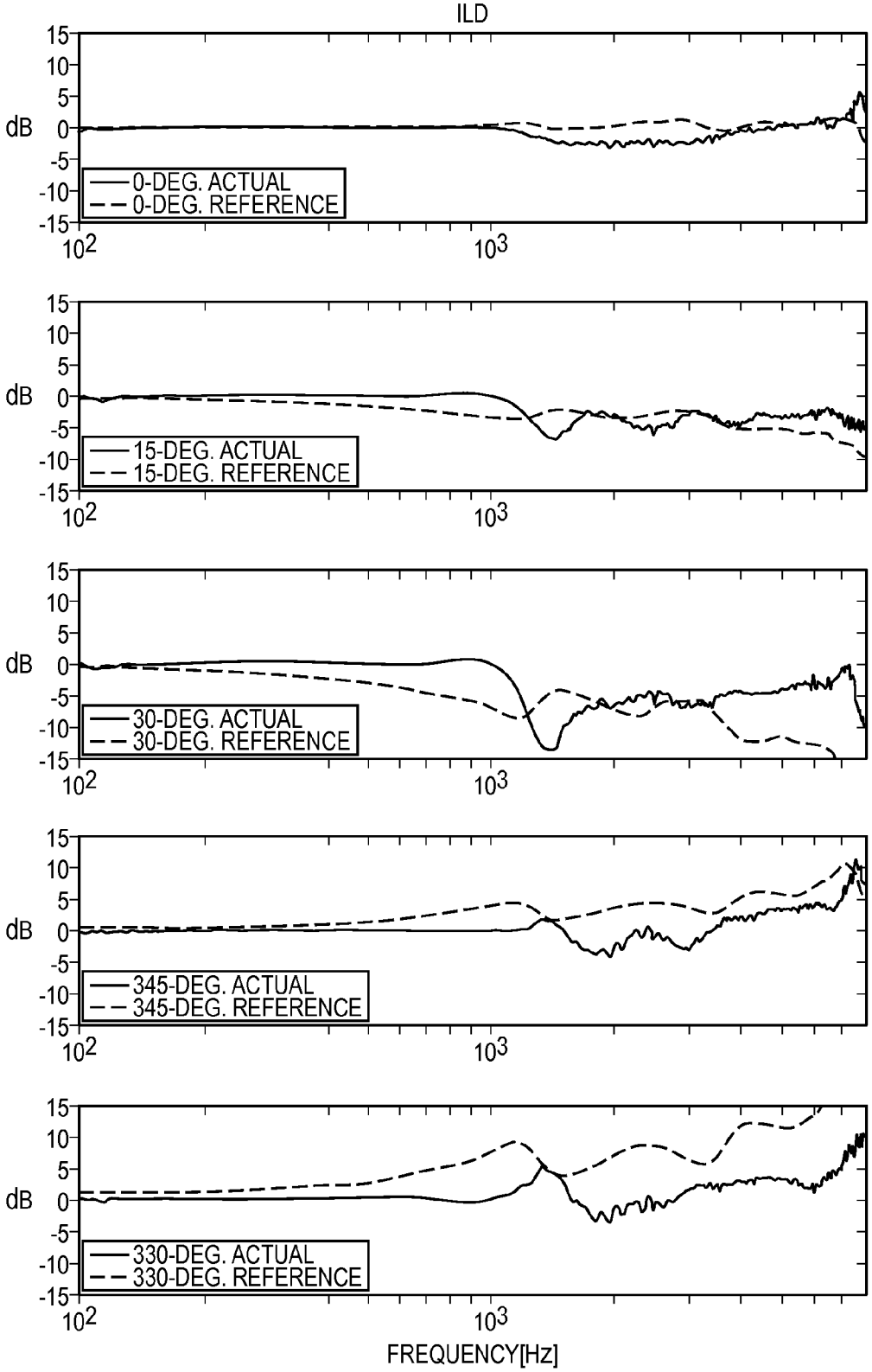
FIG. 13A illustrates the interaural level differences (ILDs)
Figure 13B:
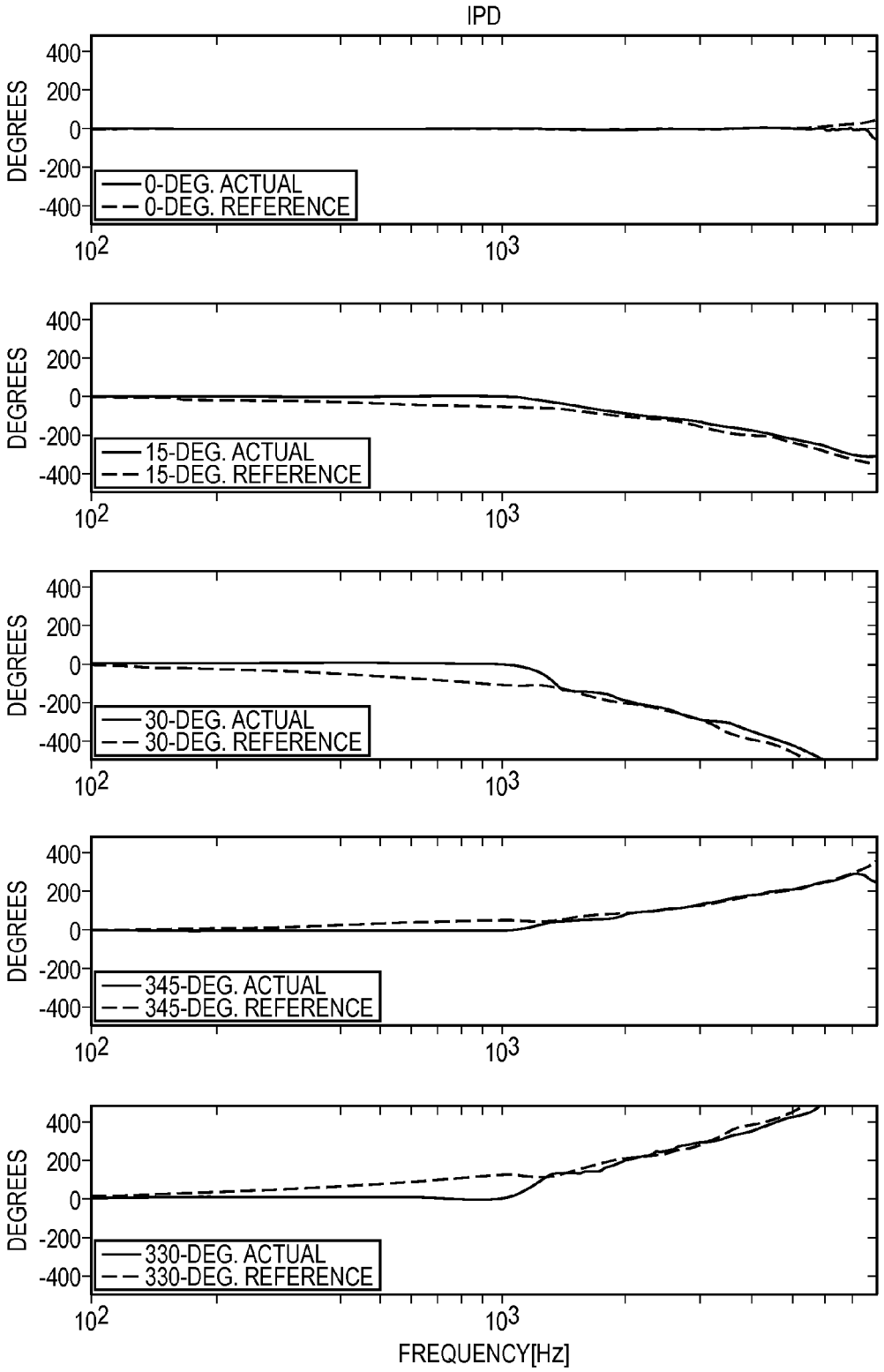
FIG. 13B illustrates the interaural phase differences (IPDs), of the seven-element, two-sided array of FIG. 6 at five different azimuth angles. Reference (target) ILDs and IPDs of an unassisted binaural dummy are also shown.

Without further modification, two-sided arraying may yield compromised spatial performance below the cross-head corner frequency, for example 1200 Hz. In particular, the interaural level differences (ILDs) and interaural phase differences (IPDs) are particularly small in the case of use of symmetric microphones on both sides of the head for each array. FIG. 13A shows the ILD and FIG. 13B the IPD of a seven-element, two-sided array as in FIG. 6. Binaural beamforming (below) can be used to address this issue and provide additional benefits as compared to more conventional approaches.

Figure 14:
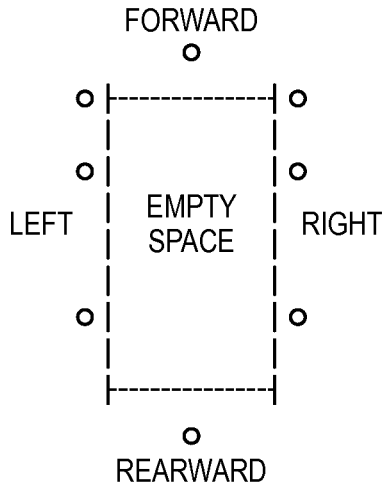
FIG. 14 is an example of an array that can be used in the conversation assistance system.

The concepts described above with regard to head mounted microphone arrays can be applied to microphone arrays used with a hearing assistance device where the array is not placed on the user's head. One example of an array that is not mounted on the head and can be used in the two-sided beamforming approach described herein, is shown in FIG. 14, where microphones are indicated by a small circle. This example includes eight microphones with three on each of the left and right sides, and one each on the forward and rearward side. The "space" is devoid of microphones but need not be empty of other objects, and indeed may include an object that carries one or more of the microphones and/or other components of the conversation assistance system; this is described in more detail below. Should this microphone array be placed on a table, the rearward mic would normally face the user, while the forward mic would most likely face in the visually forward direction.

Using all microphones for each left and right ear signal can provide improved performance compared to a line array as in the prior art. In the two-sided beamforming aspect of the subject conversation assistance system, all or some of the microphones can be used for each of the left and right ear signal, and the manner in which the microphones are used can be frequency dependent. In the example of FIG. 14 (and presuming the space is about the size of a typical smart phone (such as about 15×7 cm)), the microphones on the left side of the array may be too distant from right side microphones for desirable performance above about 4 kHz. In other words, the left and right side microphones when combined would cause spatial aliasing above this frequency. Thus, the left ear signal can use only left-side, front, and back microphones above this frequency, and the right ear signal can use only right-side, front, and back microphones above this frequency. The maximum desired crossover frequency is a function of the distance between the left side and right side microphones, and the geometry of any object that may be between the left and right side arrays. However, a lower crossover frequency may be chosen, for example if a wider polar receive pattern is desired. Since a cell phone case is narrower than the space between the ears of a typical user, the crossover frequency is higher than it is for a head mounted device. However, non-head worn devices are not limited in their physical size, and may have wider or narrower microphone spacing than shown for the device in FIG. 14.

Binaural Beamforming

Two sided beamforming in a conversation enhancement system allows design of arrays with higher directivity at lower WNG than would otherwise be possible using single sided arrays. However, two sided arrays also can negatively impact spatial cues at lower frequencies where array elements on both sides of the head are used to form individual ear signals. This impact can be ameliorated by introduction of binaural beamforming, which is described in more detail below.

Spatial cues, such as ILDs and IPDs, are desirable to maintain in a conversation assistance system for several reasons. First, the extent to which listeners perceive their audible environment as spatially natural depends on characteristics of spatial cues. Second, it is well known in the art that binaural hearing and its associated spatial cues increase speech intelligibility. Creating beneficial spatial cues in a conversation assistance system may thus enhance the perceived spatial naturalness of the system and provide additional intelligibility gain.

Figure 15:
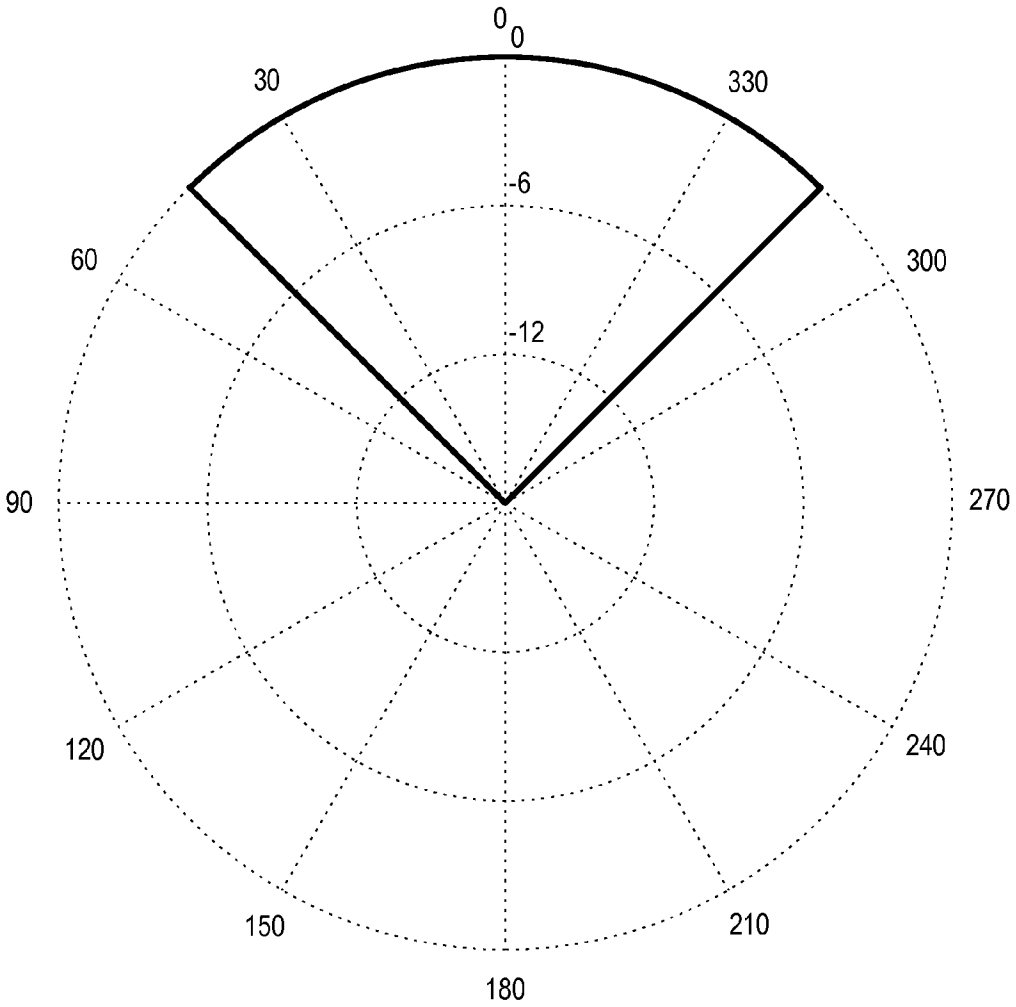
FIG. 15 illustrates a polar reception pattern of an ideal monaural conversation assistance array with an arbitrary pass angle width.

Consider the idealized polar response of an array of a conversation assistance system, shown in FIG. 15. If the output of this microphone array is played back monaurally, or equally to both ears, both ILD and IPD cues are zero even for sound sources well off-axis. Additionally, motional cues resulting from natural, time-varying movement of the listener's head, for example, would not cause interaural cues to vary. In both of these examples, interaural cues differ from those of natural hearing. Due to these differences, the monaural conversation assistance system may result in an unnatural spatial experience. Some listeners may describe this spatial experience as "in the head", meaning the perceived distance of sources from the listener is small. Other listeners may be troubled that off-axis talkers sound as if they are always at 0-degrees azimuth. The lack of binaural cues also eliminates binaural hearing, which further degrades speech intelligibility. Two-sided arrays present similar problems at frequencies where microphones on both sides of the head are active for both ears. Such behavior is evident below the cross-head corner frequency of approximately 1200 Hz in FIGS. 13A and 13B for the previous example seven-element array.

Figure 16:
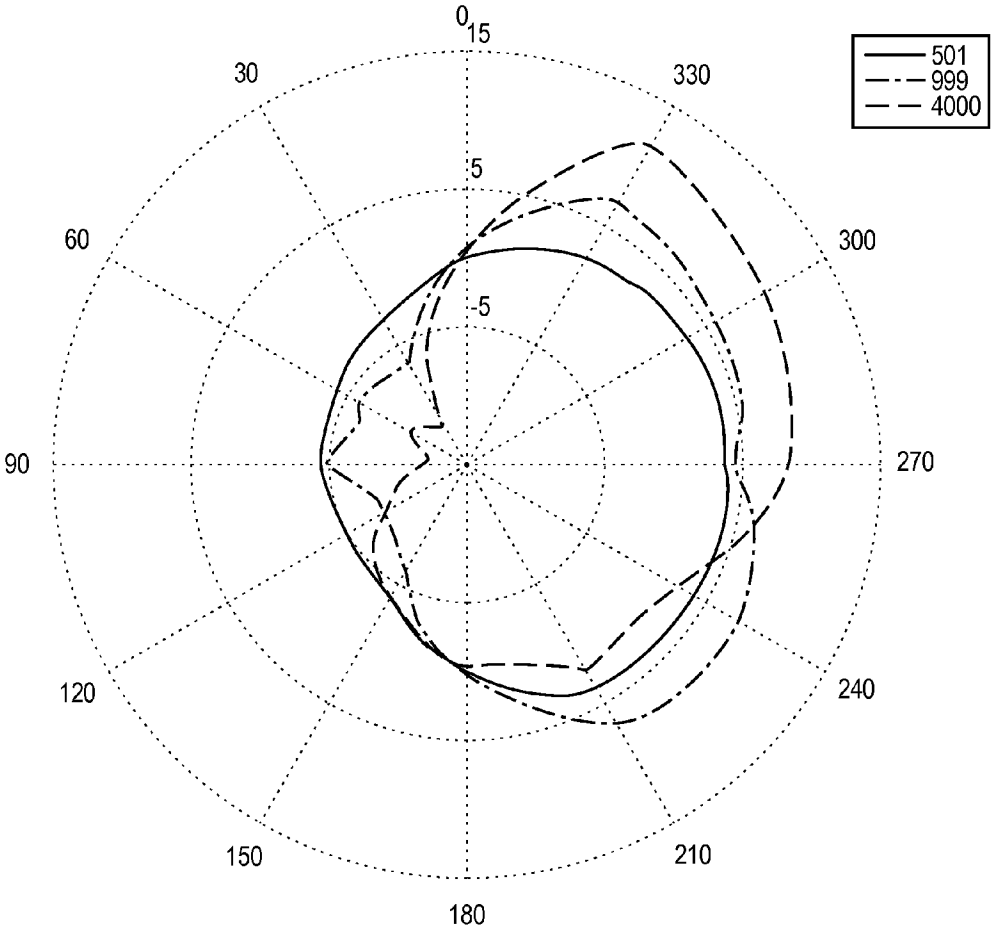
FIG. 16 illustrates the polar ILD of a binaural dummy.
Figure 17A:
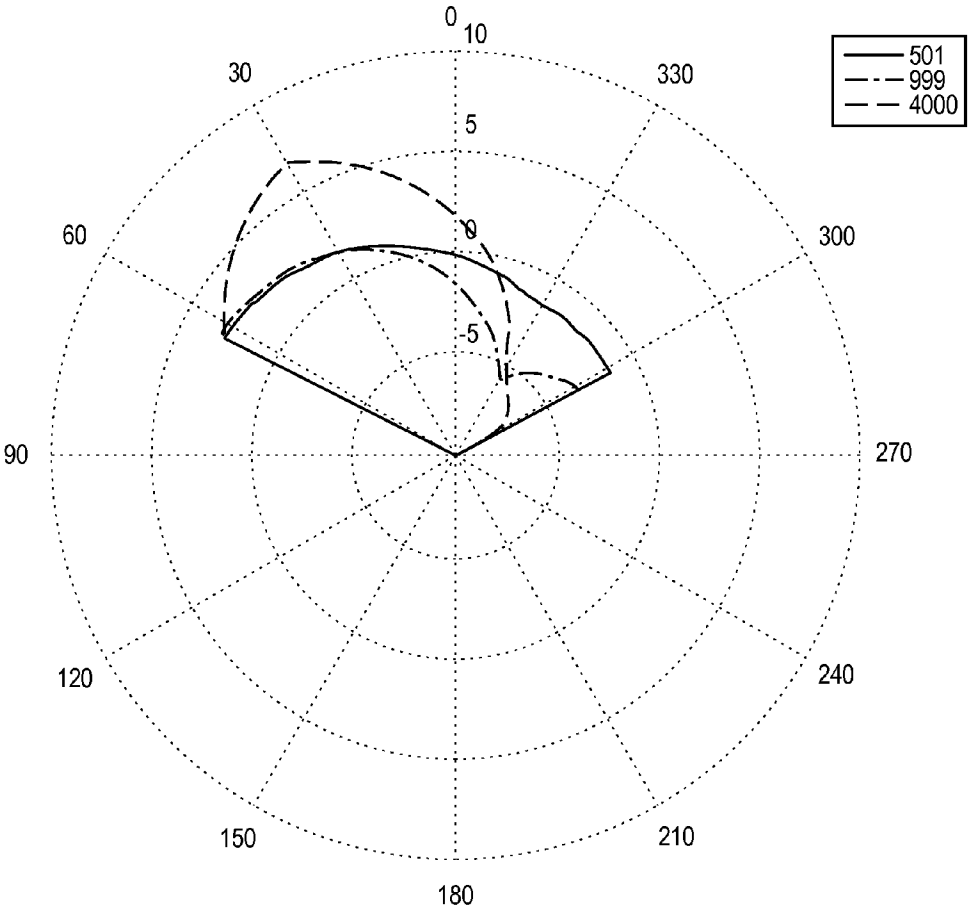
FIGS. 17A-D illustrate an example left (17A and B) and right (17 C and D) ear array specification in both magnitude (17A and C) and phase (17B and D).
Figure 17B:
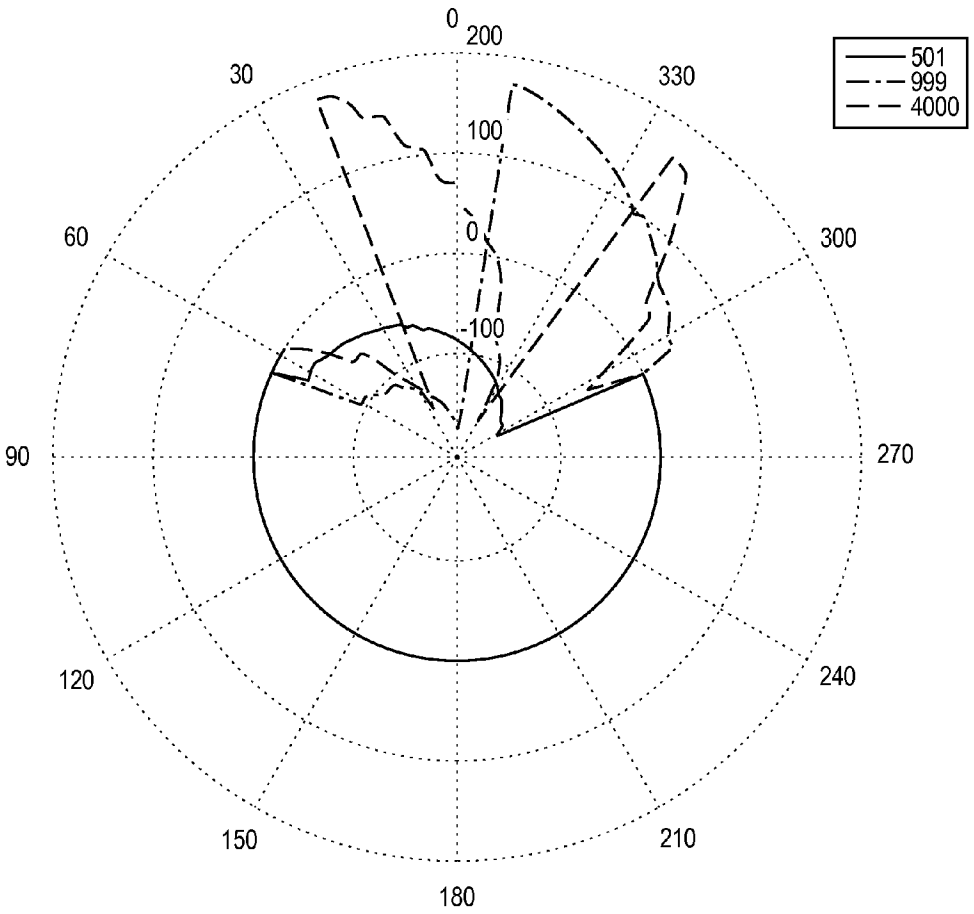
Figure 17C:
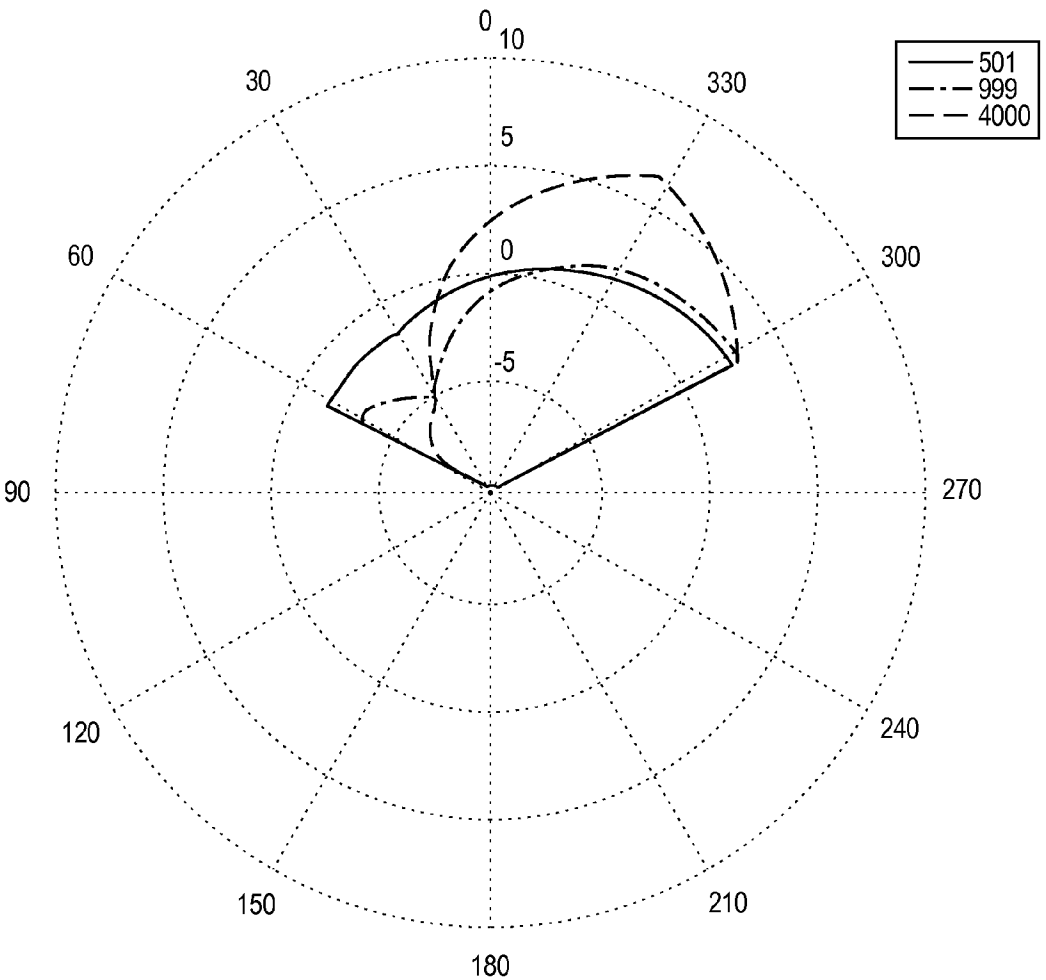
Figure 17D:
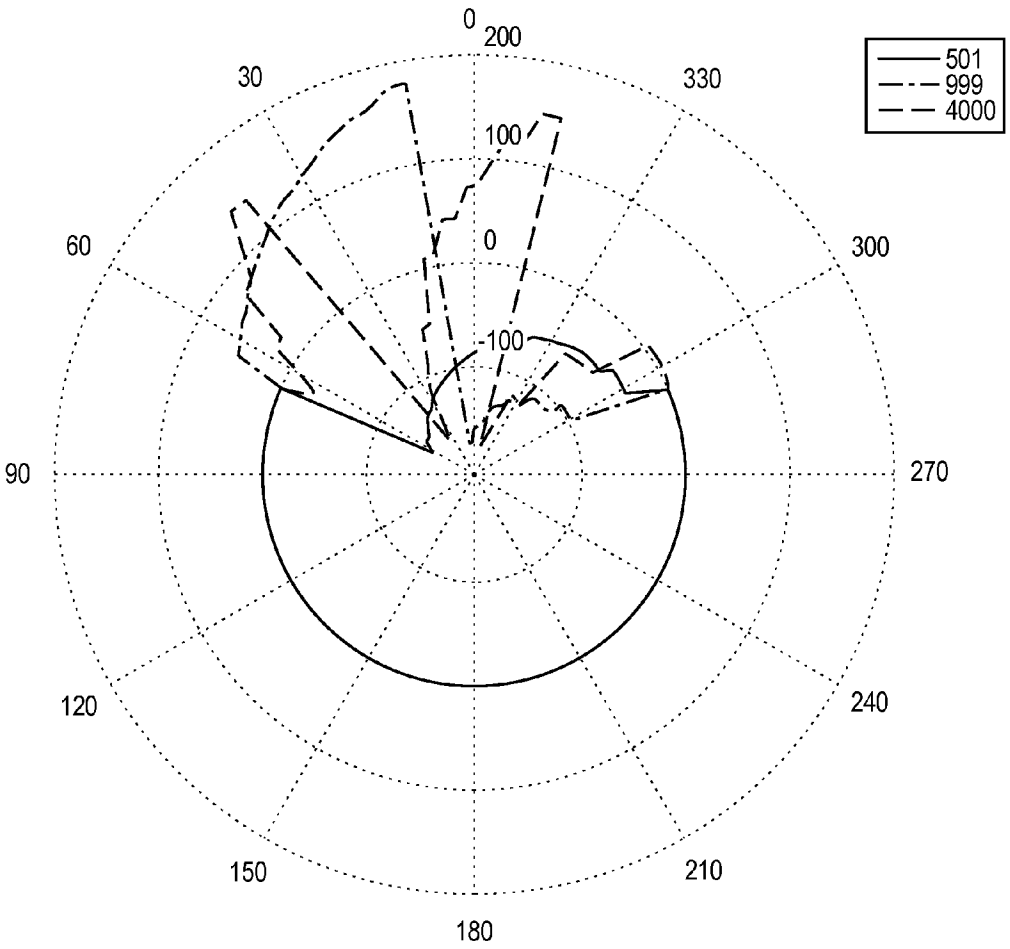

To illustrate the problem, consider the polar ILD of a binaural dummy in FIG. 16. This polar pattern is the dB difference between the right and left ear magnitudes. A similar plot of polar IPD (not shown) can be made based on the phase difference between the right and left ear phases. Both the ILD and IPD vary as a function of sound source angle. The monaural polar ILD and IPD, however, is simply a circle of zero dB ILD and zero degrees IPD since no interaural cues change as a function of sound source position.

Binaural beamforming is a method that can be applied to address the above interaural issues, while still preserving the high directivity and TNR gain and lower WNG of two-sided beamformed arrays. To accomplish this, binaural beamforming processes the microphone signals within the array to create specific polar ILDs and IPDs as heard by the user, and also attenuates all sound sources arriving from beyond a specified pass-angle, for example +/−45-degrees. To the user, a conversation assistance device utilizing binaural beamforming can provide two important benefits. First, the device can create a more natural and intelligible hearing assistance experience by reproducing more realistic ILDs and IPDs within the pass angle of the array. Second, the device can significantly attenuate sounds arriving outside of the pass angle. Other benefits are possible and will be discussed later.

Binaural beamformed arrays utilize an array filter design process that includes a complex-valued polar specification where both magnitude and phase of the desired array response are specified. The specification may describe each ear or an interaural relationship.

In one non-limiting example of binaural beamforming, the binaural array polar specification consists of a separate specification for each ear. The specifications are complex valued and based on polar head-related transfer function (HRTF) targets. In this example the target is obtained from polar HRTF's of each ear of a binaural dummy. Other methods for obtaining targets are contemplated herein, some of which are described below. In this example, the relative differences between the left- and right-ear array specifications match the binaural dummy IPD and ILD as in FIG. 16. FIGS. 17A-17D illustrate an example left- and right-ear array specification in both magnitude and phase (left ear magnitude and phase shown in FIGS. 17A and 17B, and right ear magnitude and phase shown in FIGS. 17C and 17D). For example, consider the specification at 30 degrees horizontal angle (at 0 degrees azimuth). The difference between the left ear and right ear specifications at 1 kHz is 7 dB in magnitude. This corresponds to the −7 dB ILD response at 30 degrees in FIG. 16. The magnitude specification (in FIGS. 17A and 17C) is completely attenuated (−infinite dB) beyond approximately +/−60 degrees. For angles where the magnitude specification is completely attenuated, both ILD and IPD are effectively undefined, since no energy is present at either ear. A wider pass angle than that of FIG. 15 is used for ease of illustration, but the specific pass angle is not a limitation of this disclosure.

In other applications of binaural beamforming, the binaural array polar specification may differ. For example, the specification may differ from natural interaural relationships defined by generalized HRTFs. Alternatively, specifications can be created based on individualized measurements on a given subject's head, a generalized spherical model, or a statistical sampling of several heads. Examples of other such applications are given later.

Figure 18A:
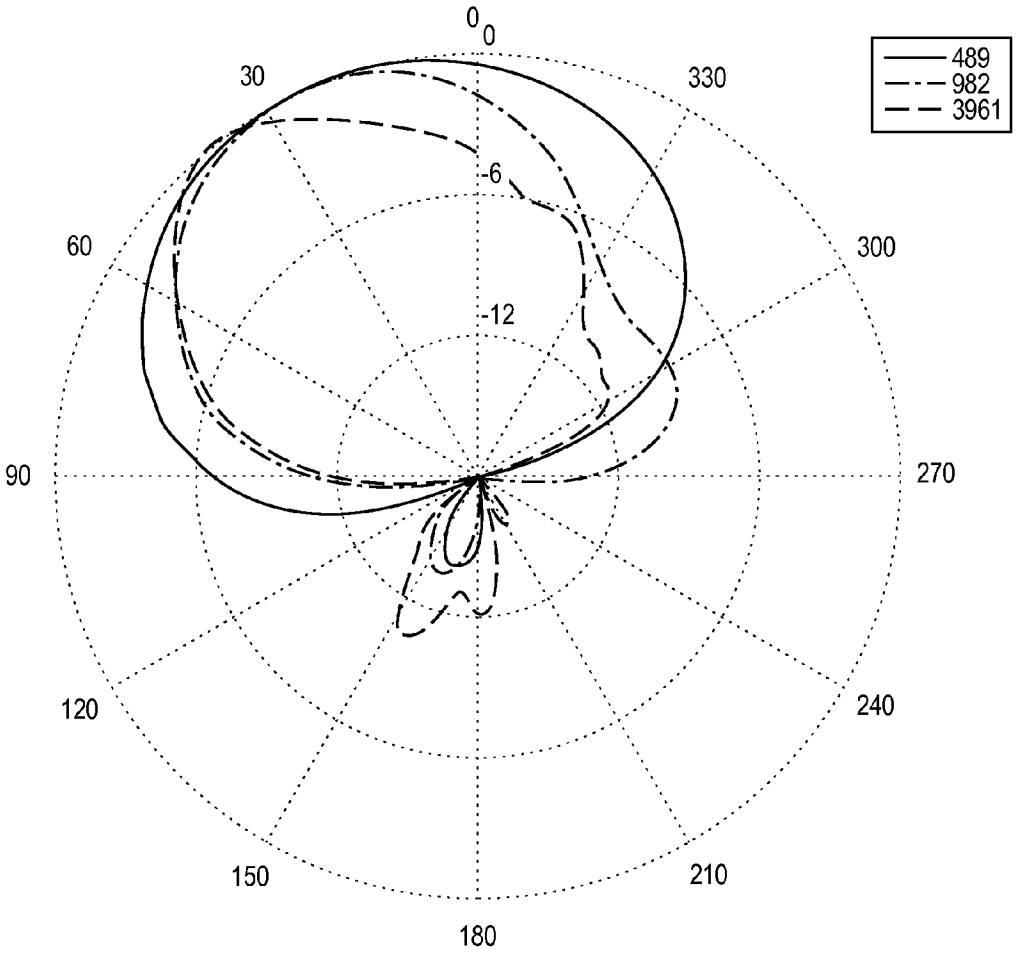
FIGS. 18A and 18B illustrate the left and right ear polar response of seven-element binaural array, using the specification of FIG. 17.
Figure 18B:
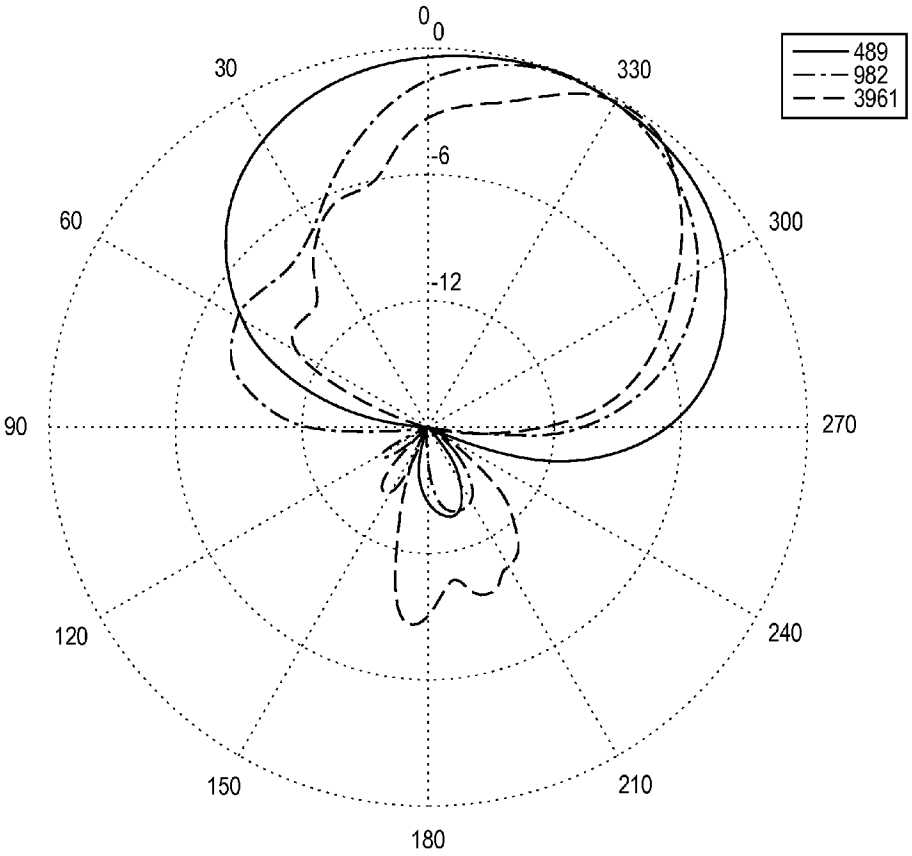
Figure 19A:
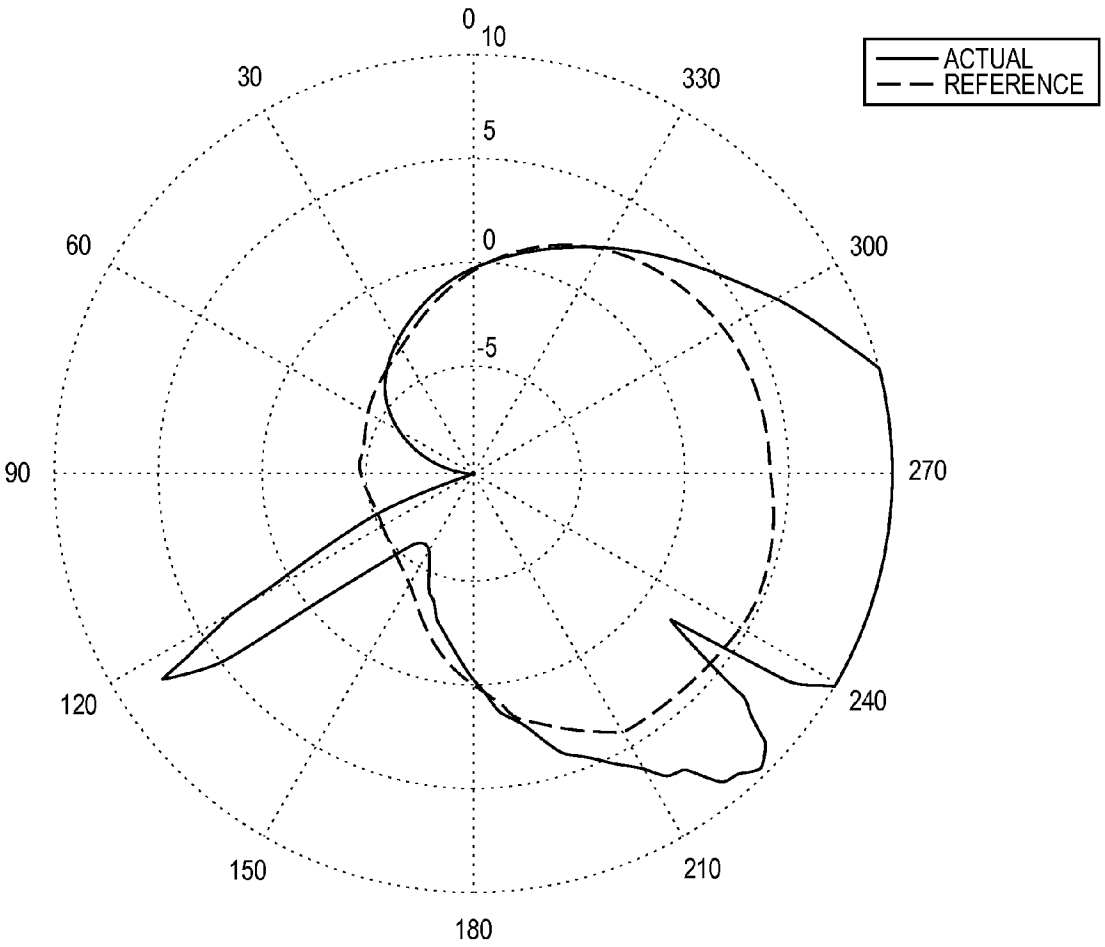
FIGS. 19A-19C illustrate the polar ILD of a seven-element, two-sided array at three frequencies (500, 1000 and 4000 Hz, respectively). Reference ILDs of an unassisted binaural dummy are also shown.
Figure 19B:
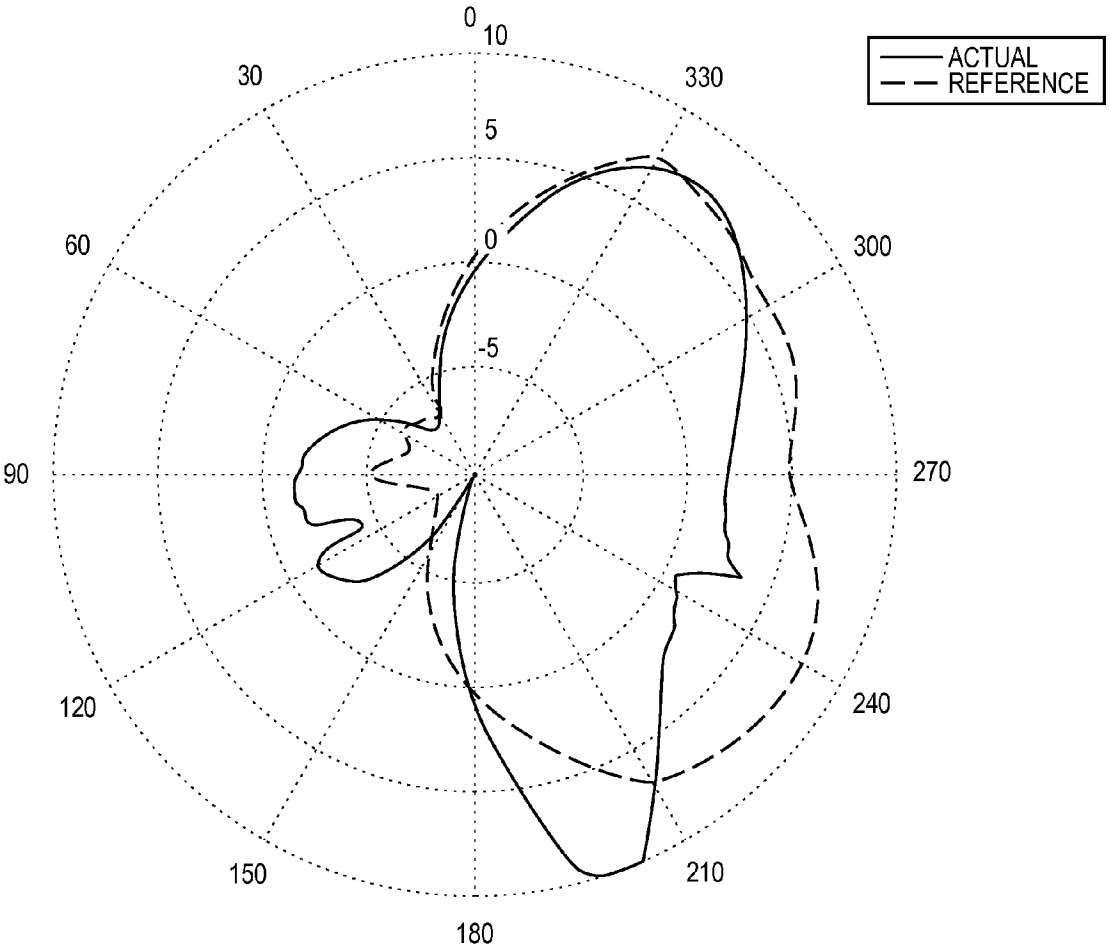
Figure 19C:
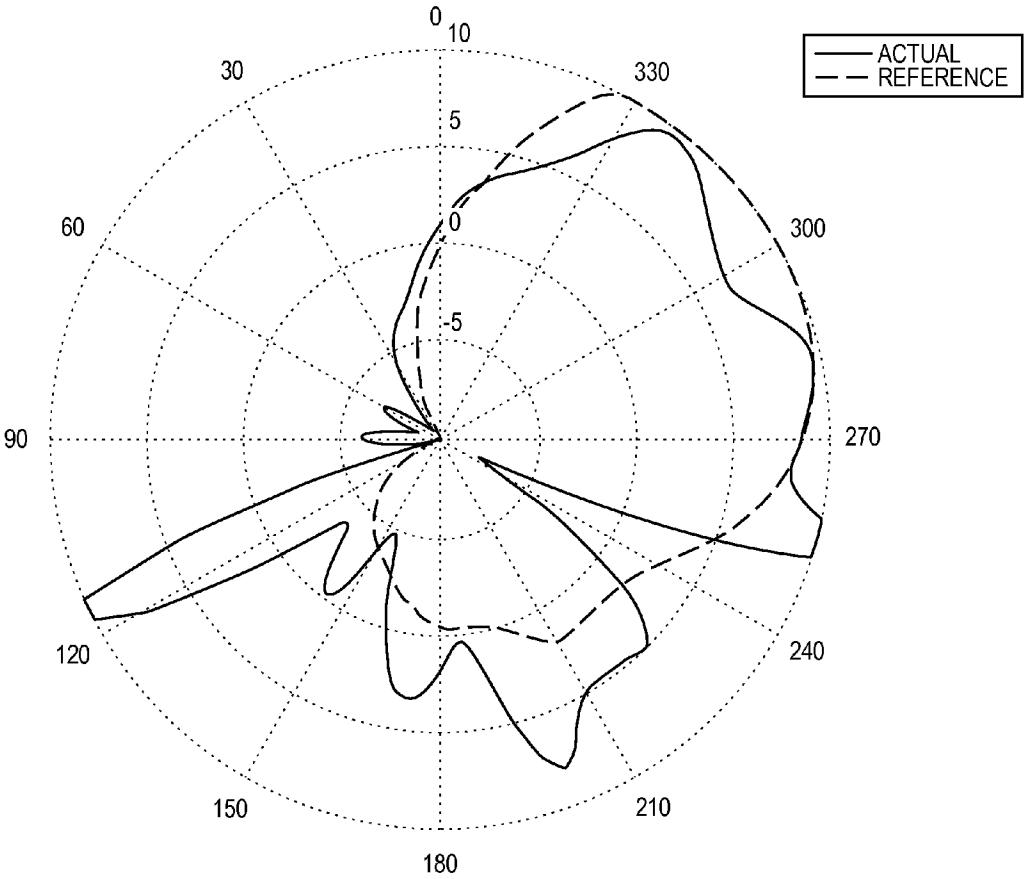
Figure 19D:
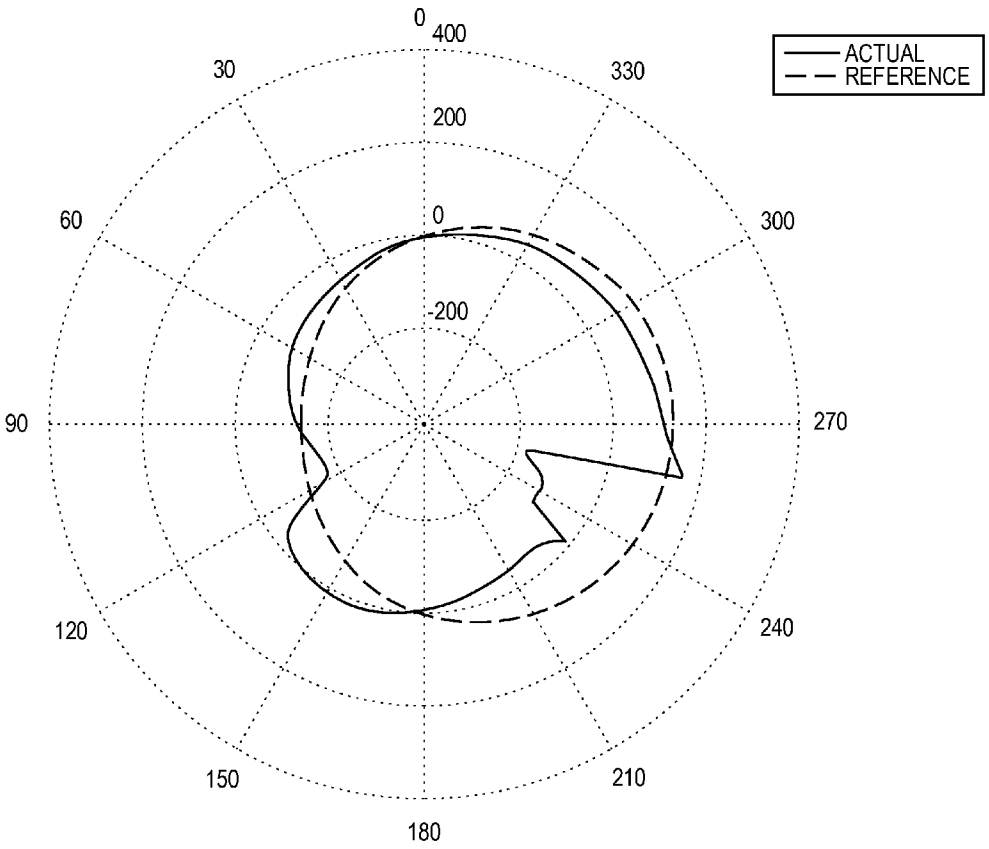
FIGS. 19D-19F illustrate the polar IPD of a seven-element, two-sided array at the same three frequencies. Reference IPDs of an unassisted binaural dummy are also shown.
Figure 19E:
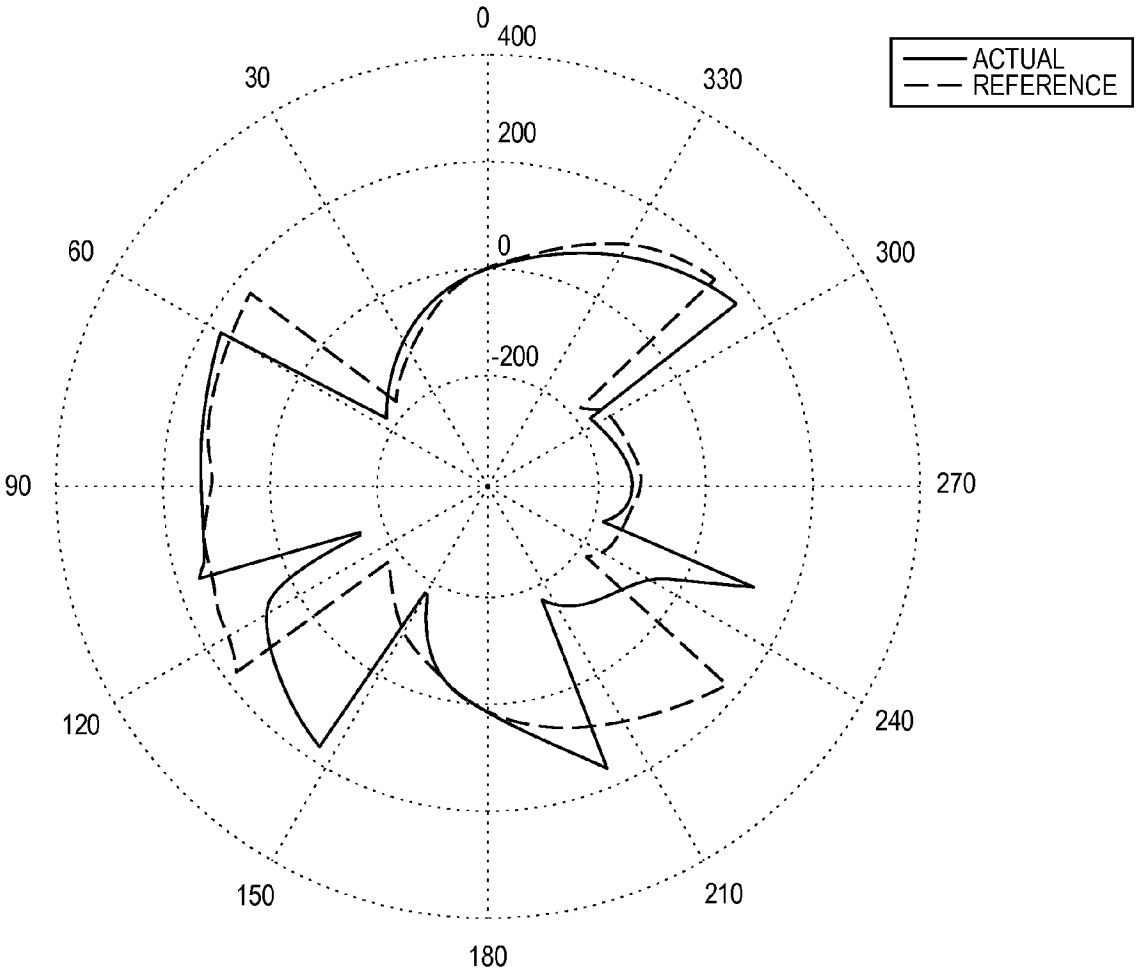
Figure 19F:
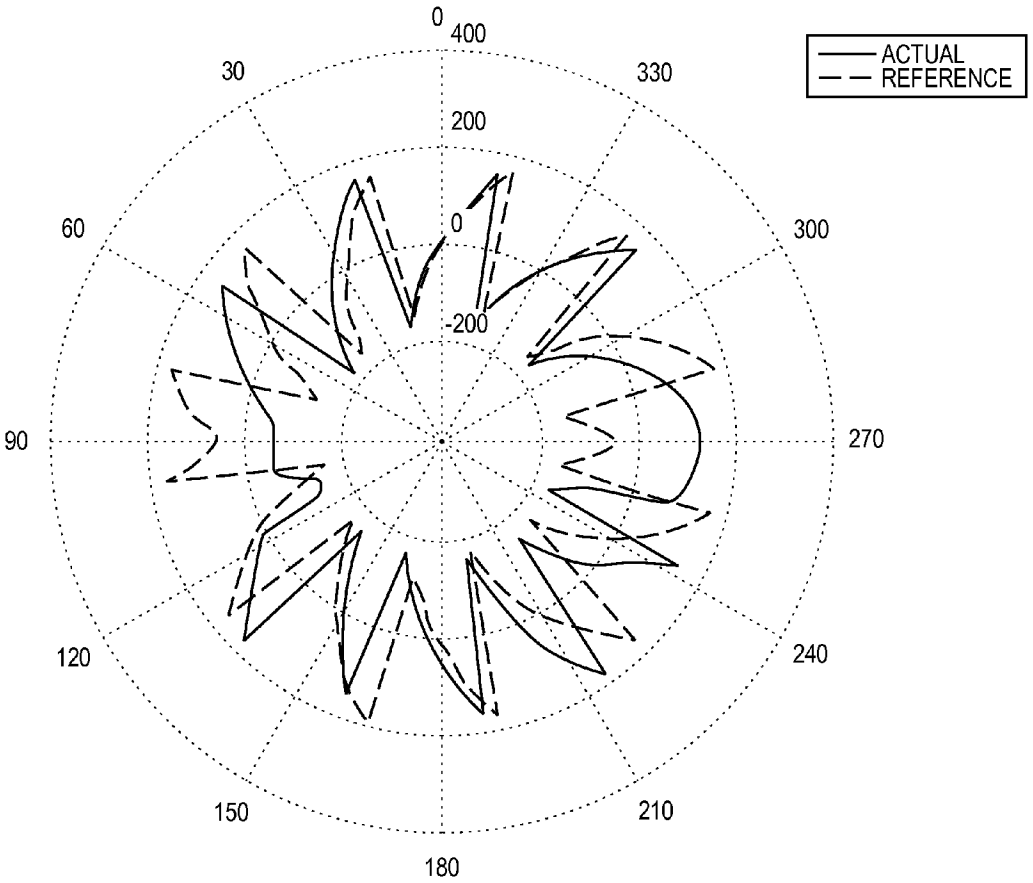

Given these specifications, array filters for both the left and right array microphone outputs are created using the array filter design process. FIGS. 18A and 18B show examples of the resulting binaural array polar response for the seven-element array of FIG. 6 using the specification of FIGS. 17A and 17B for the left ear and FIGS. 17C and 17D for the right ear.

Figure 20A:
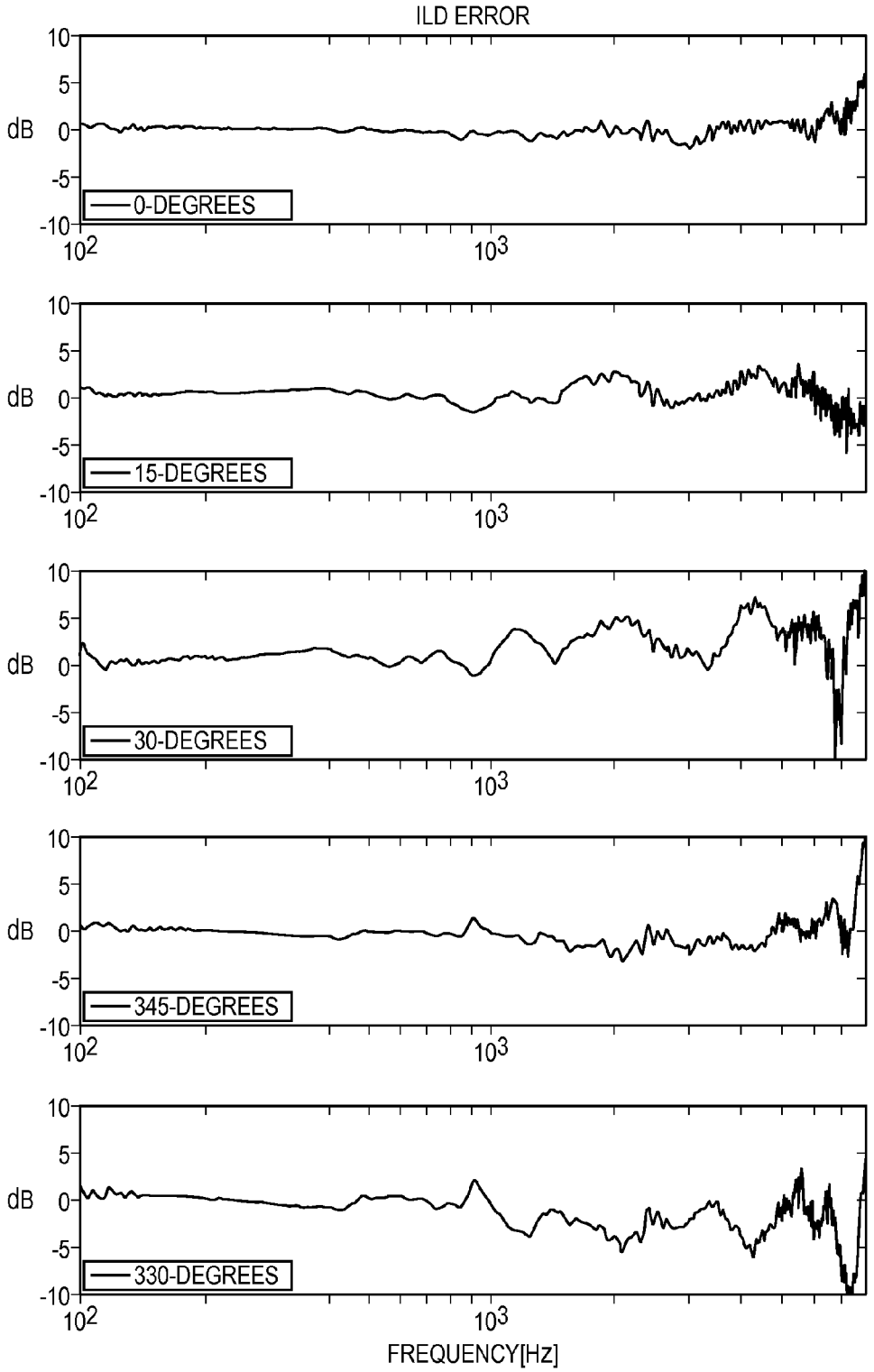
FIG. 20A shows the ILD and FIG. 20B shows the IPD binaural error between the target and the actual array at five azimuth angles, for the seven-element binaural array.
Figure 20B:
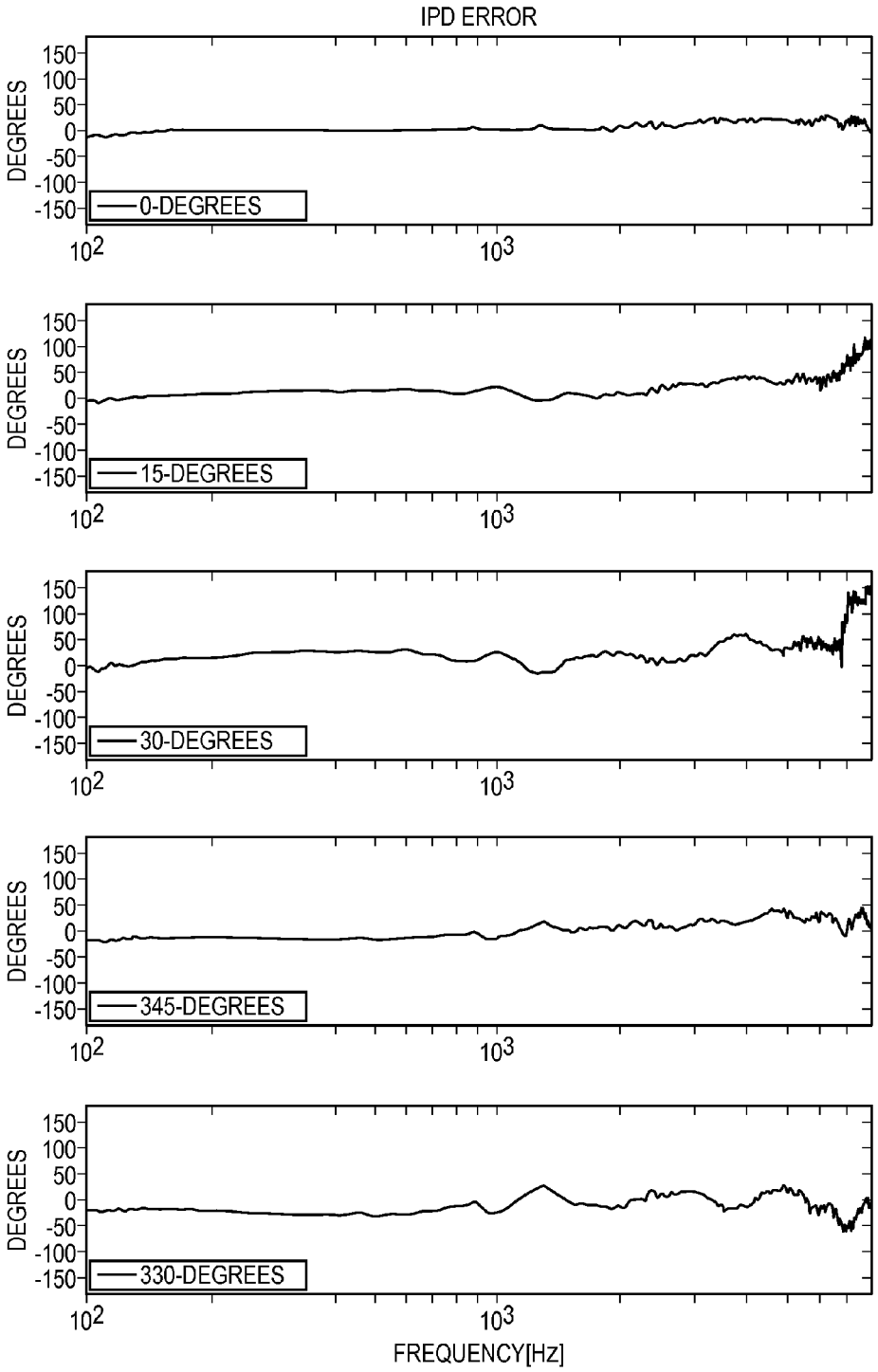
Figure 21A:
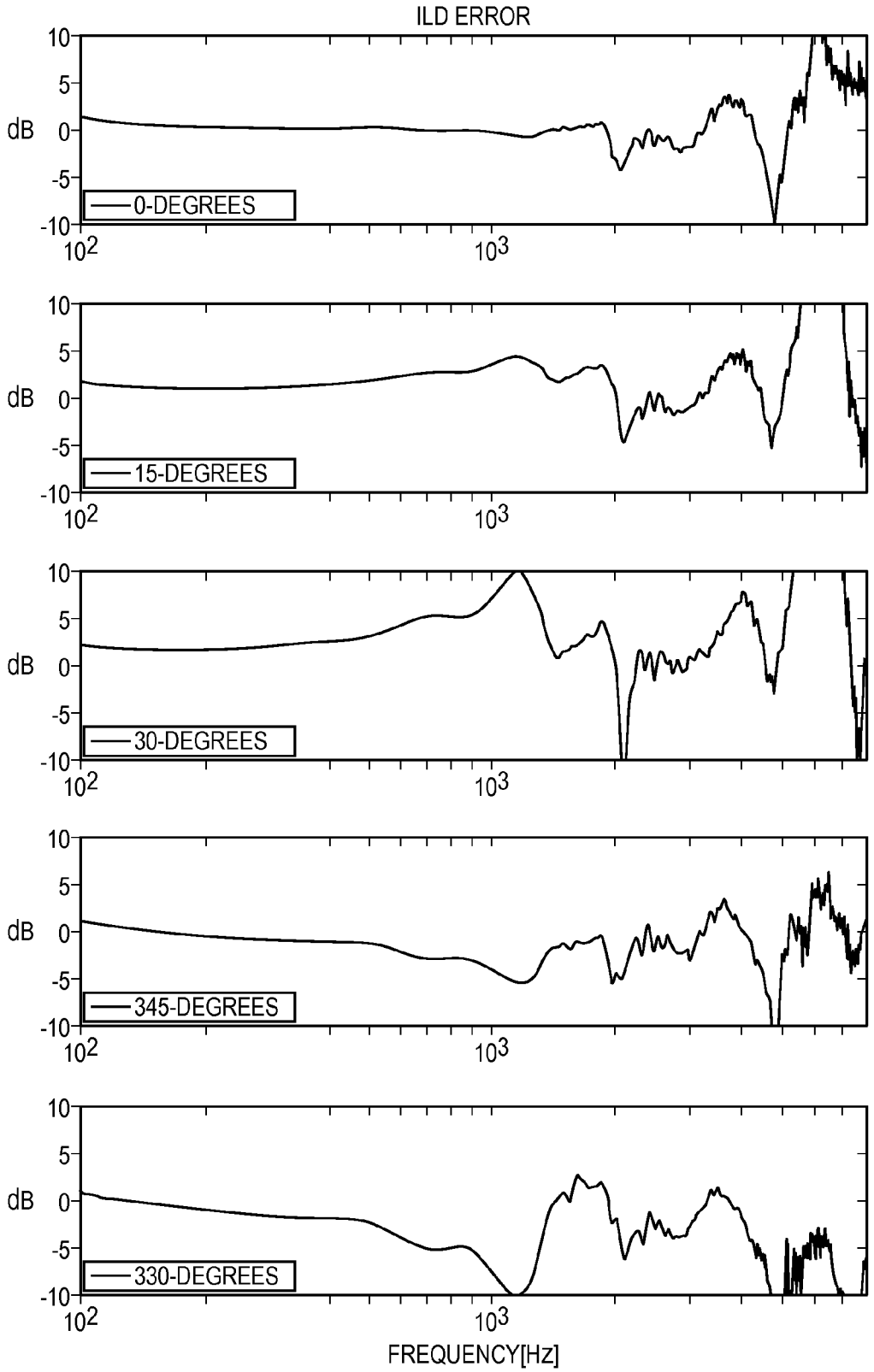
FIGS. 21A and 21B show the same error but without binaural beamforming.
Figure 21B:
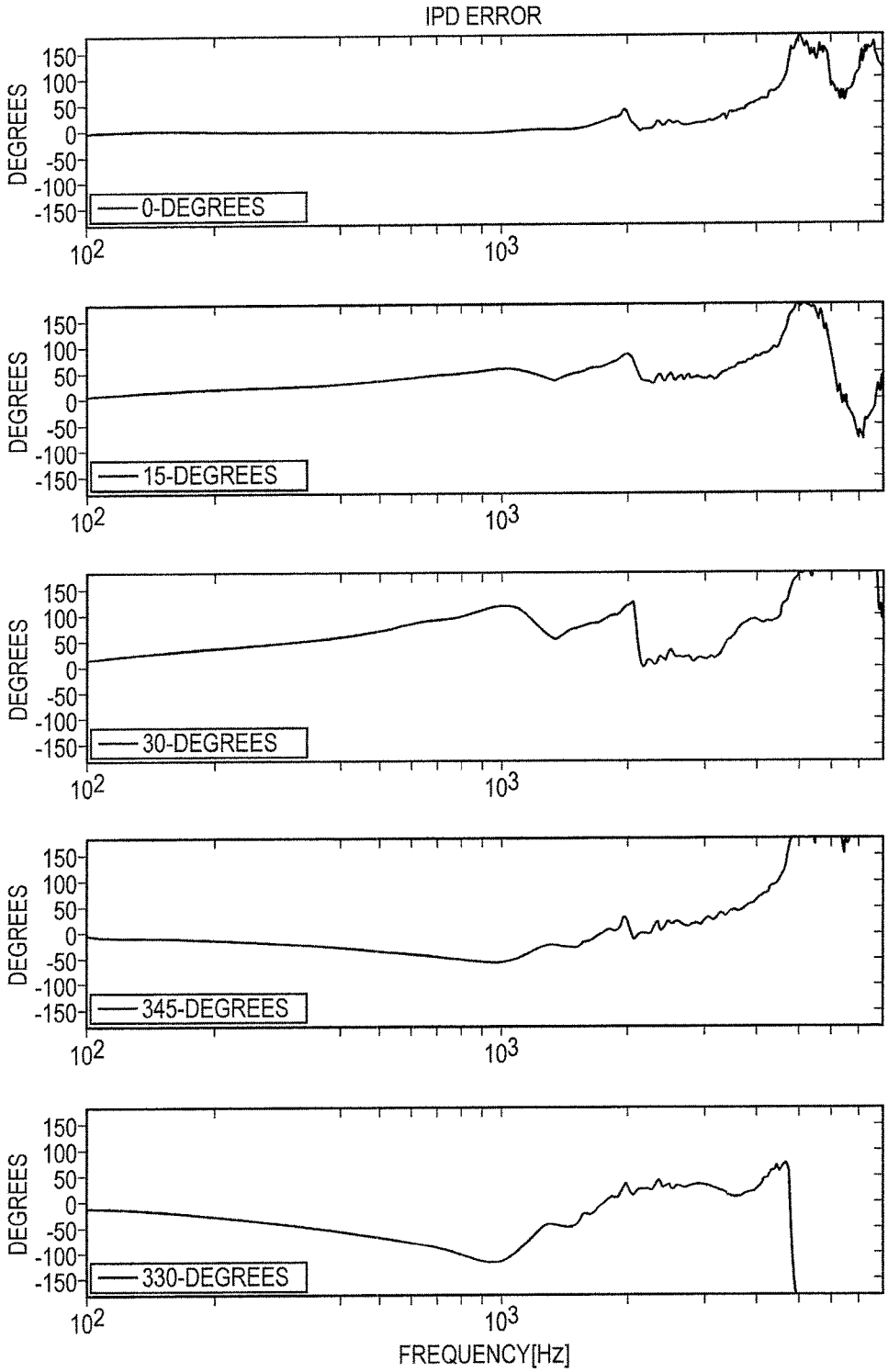

Playback of the left- and right-ear arrays through headphones creates the polar ILDs and IPDs shown in FIGS. 19A-19C and 19D-19F, respectively. FIGS. 20A and 20B show the ILD and IPD error, respectively, between the target and actual array performance. In contrast, FIGS. 21A and 21B show the ILD and IPD error, respectively, of a 7 element band limited two-sided array without binaural beamforming. Interaural characteristics that more closely resemble HRTFs resulting from application of binaural beamforming (e.g. decreased binaural ILD and IPD error) result in more natural and pleasing spatial performance of the array, as well as improved situational awareness and intelligibility.

Figure 22:
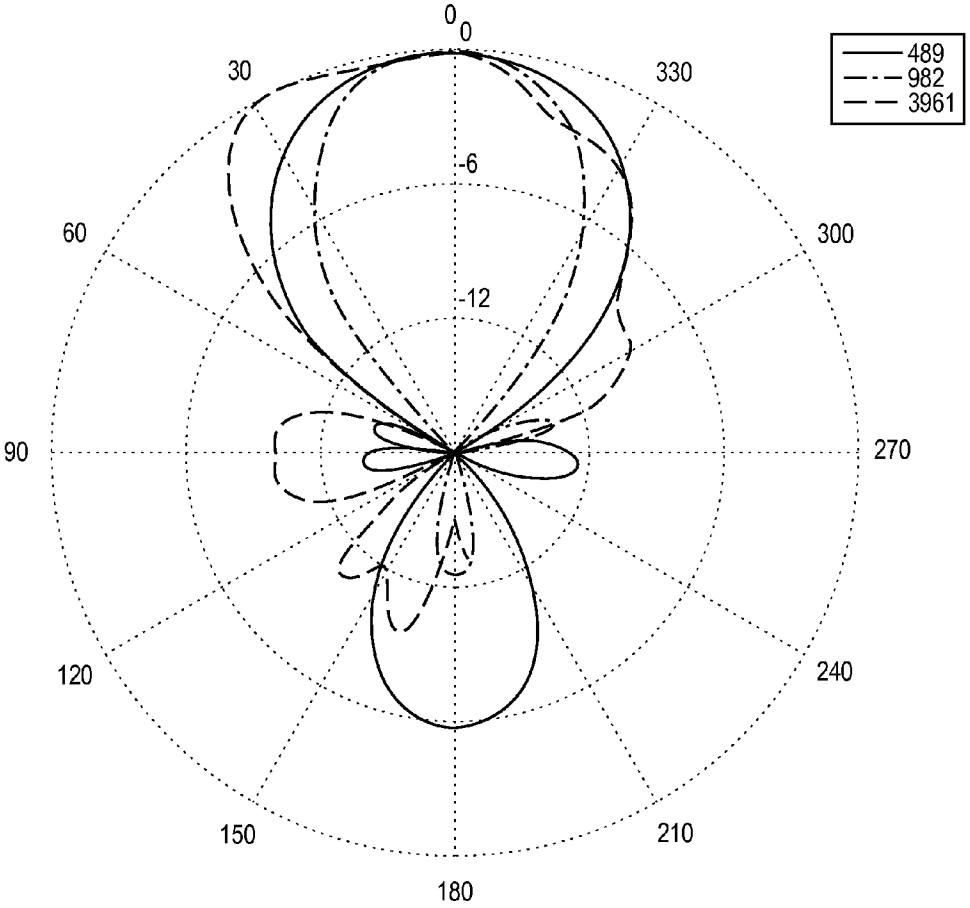
FIG. 22 illustrates the left-ear polar response of the two sided band limited seven-element array with a narrowed (+/−15-deg.) target specification.
Figure 23A:
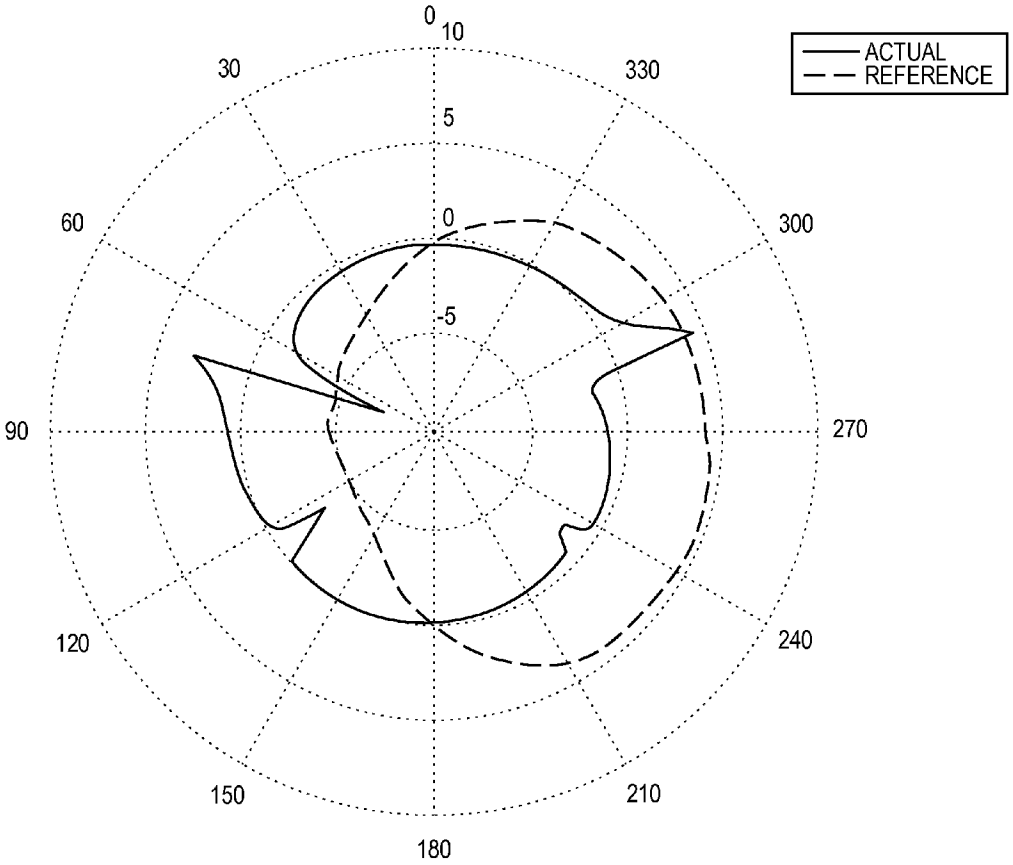
FIGS. 23A-23C illustrate the polar ILD of the seven-element array with narrowed (+/−15-deg.) target specification, at three frequencies (500, 1000 and 4000 Hz, respectively).
Figure 23B:
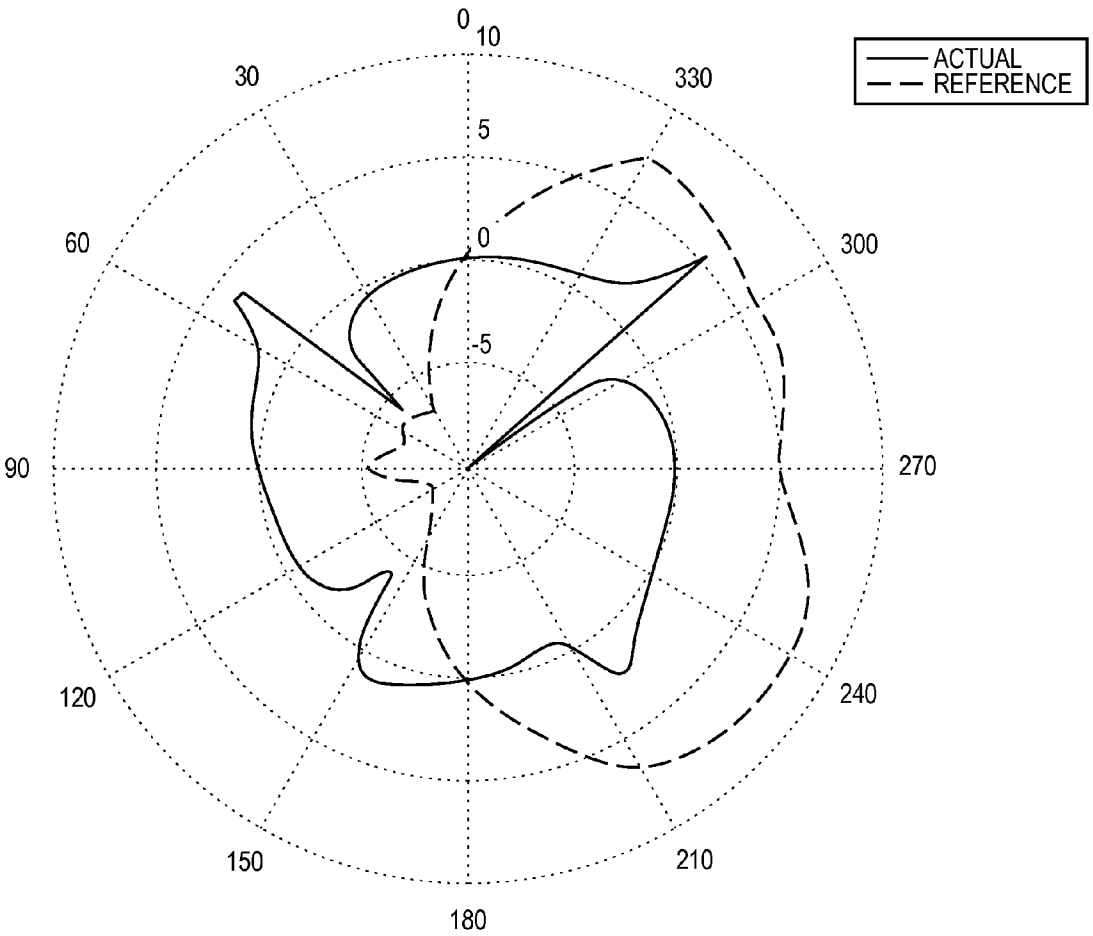
Figure 23C:
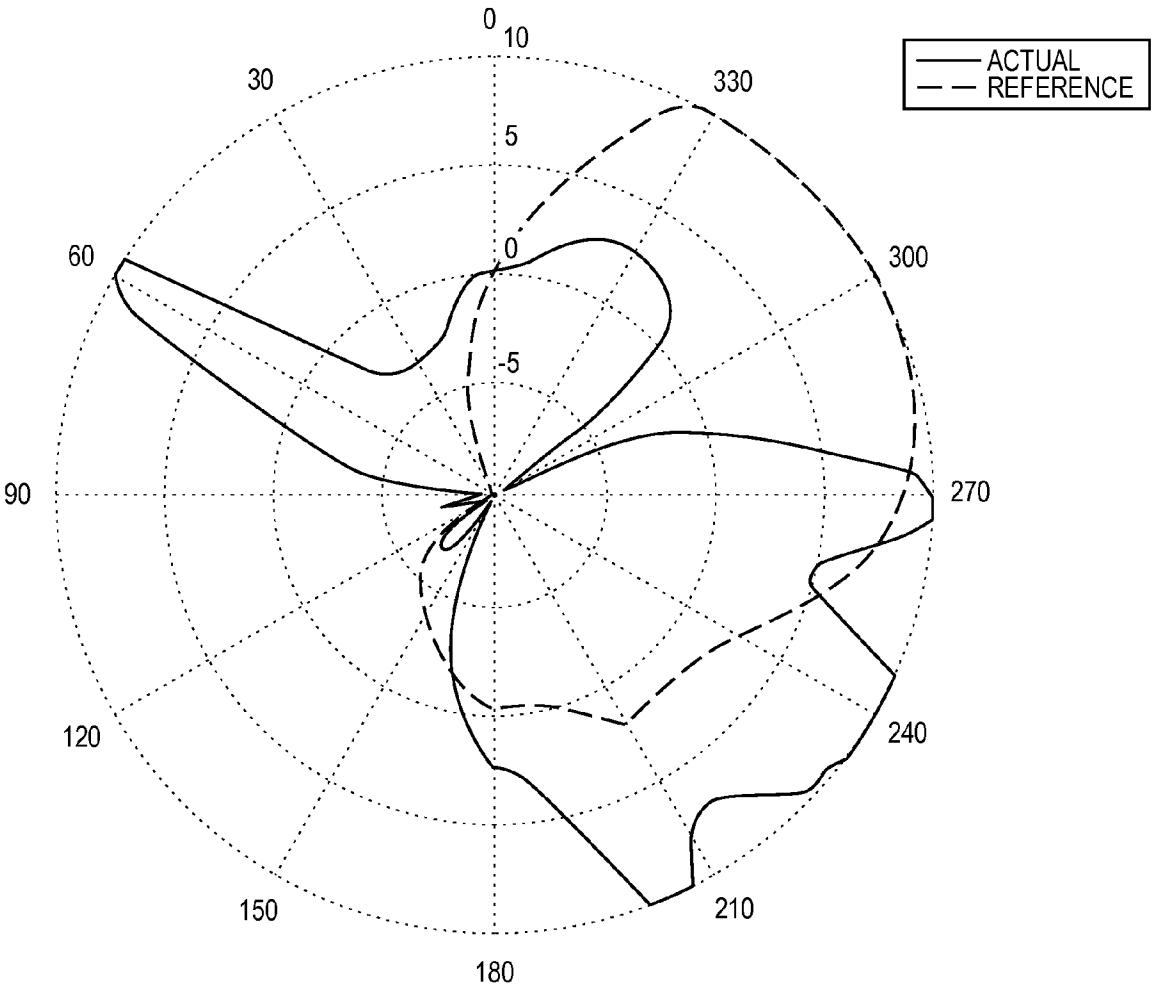
Figure 23D:
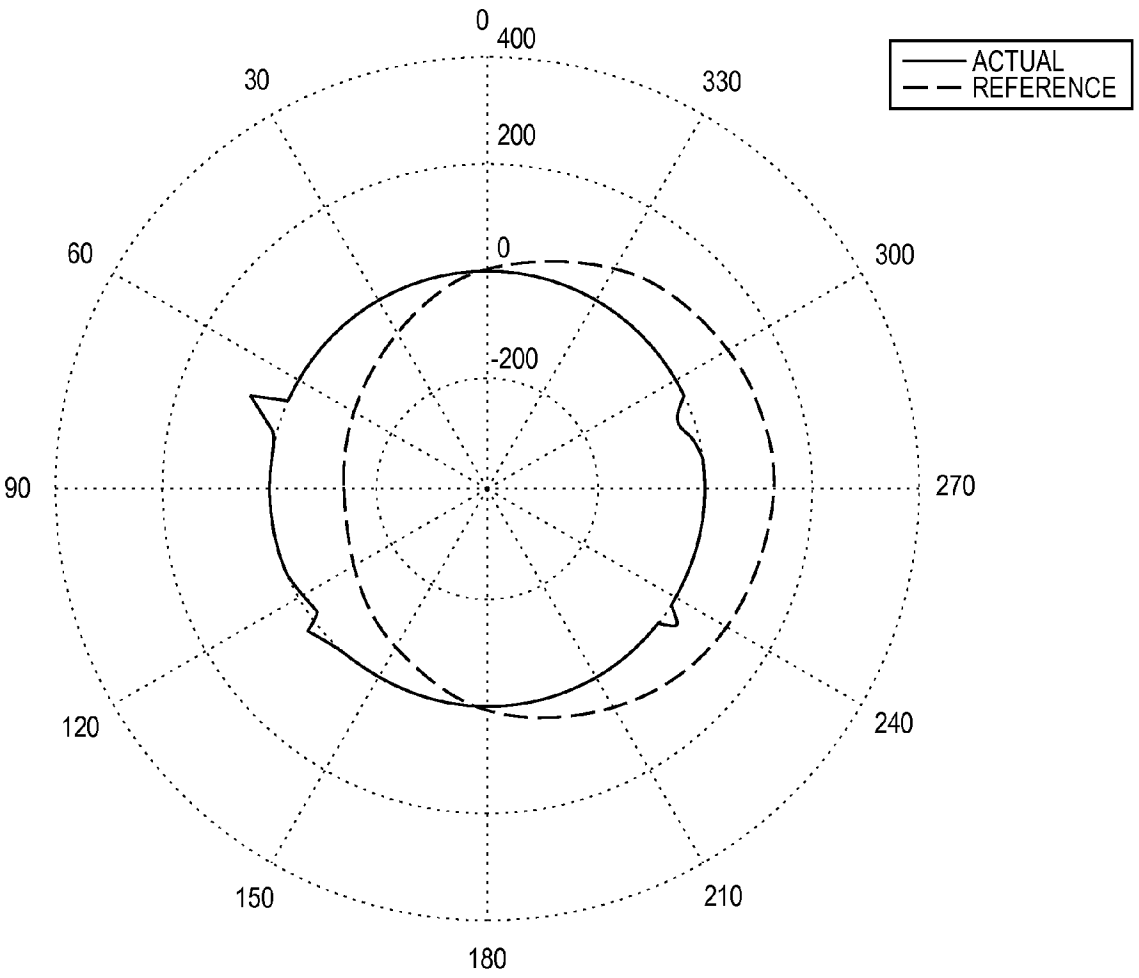
FIGS. 23D-23F illustrate the polar IPD of the seven-element array with narrowed (+/−15-deg.) target specification, at the same three frequencies.
Figure 23E:
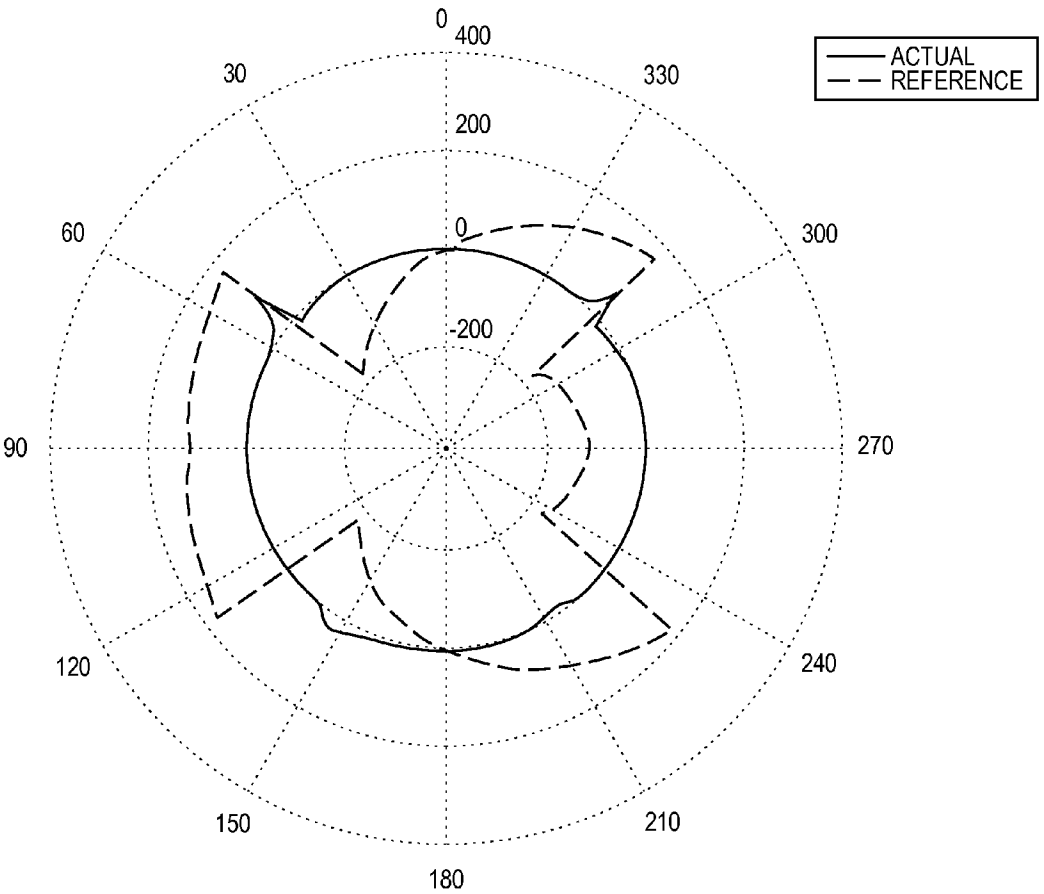
Figure 23F:
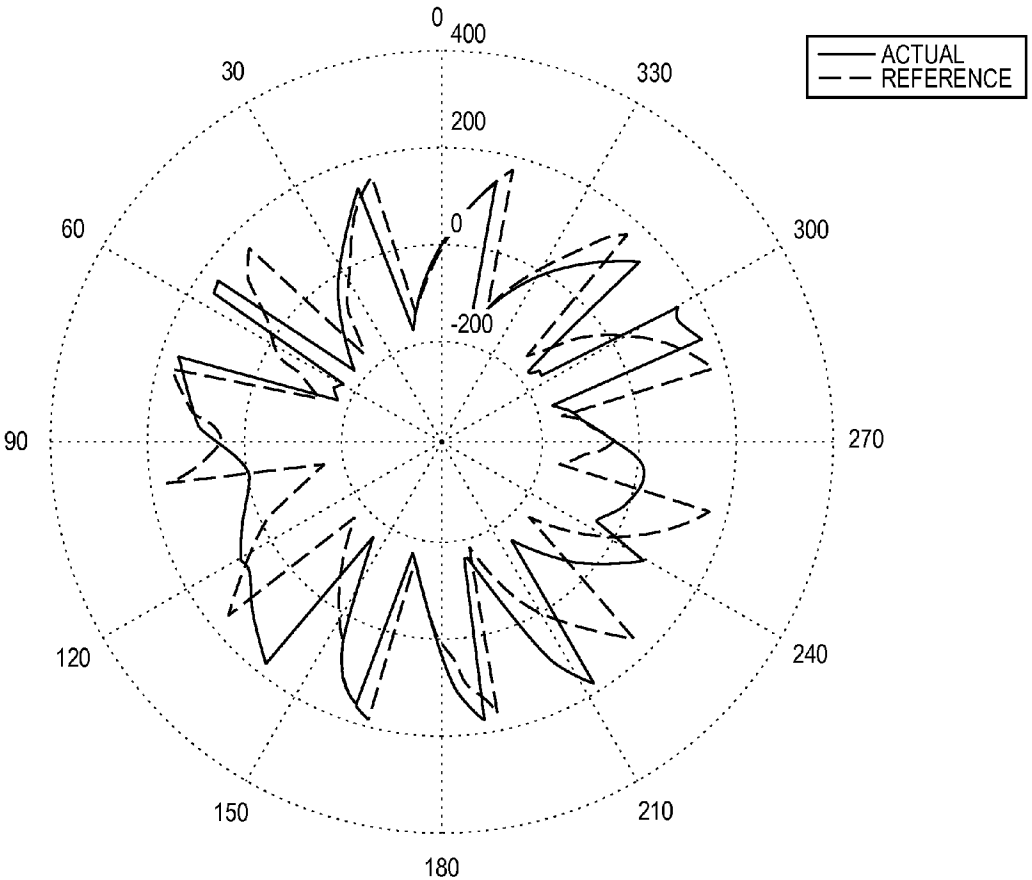
Figure 24A:
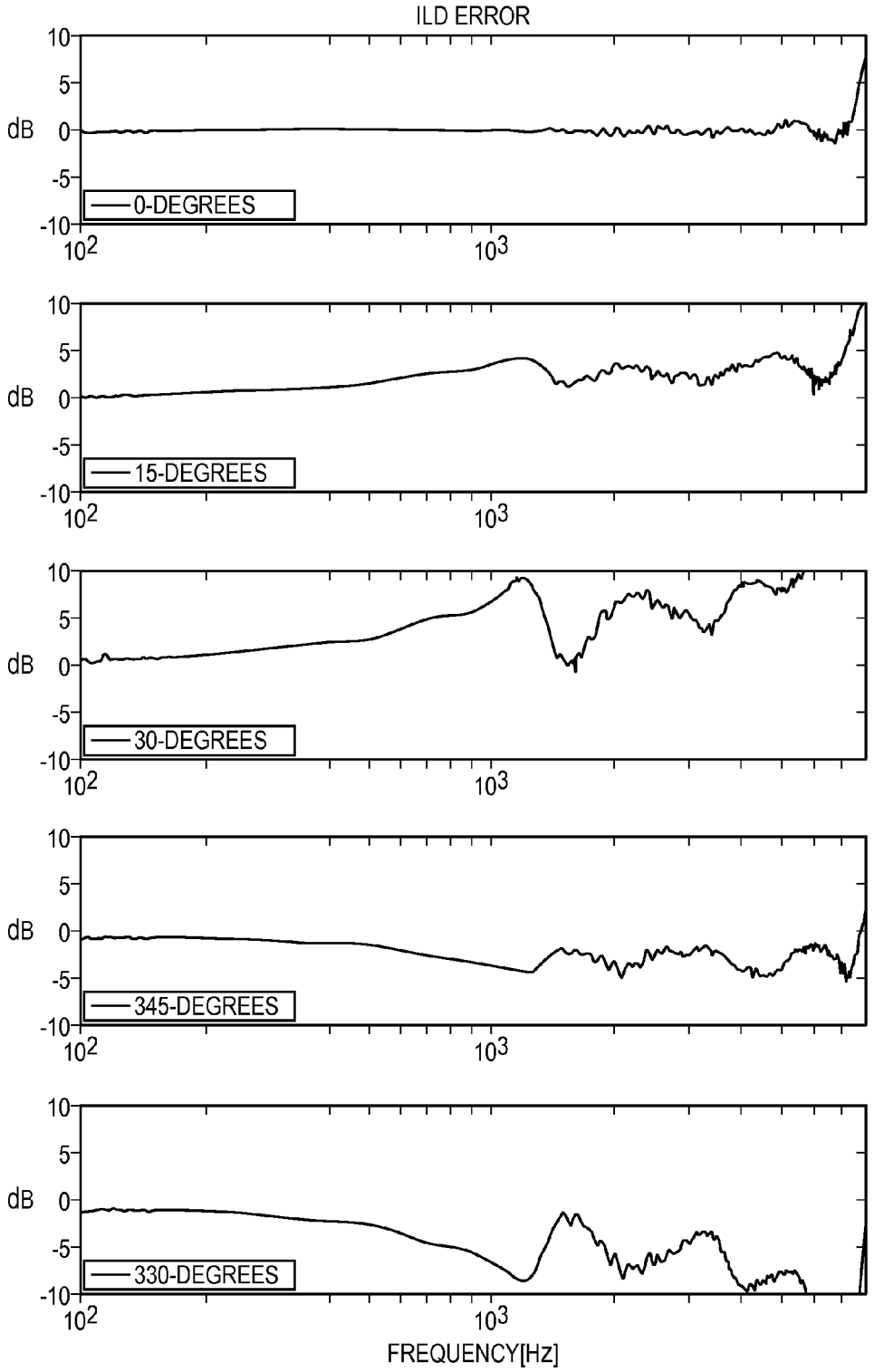
FIG. 24A illustrates the ILD error of the seven-element array with narrowed (+/−15-deg.) target specification, at five azimuth angles.
Figure 24B:
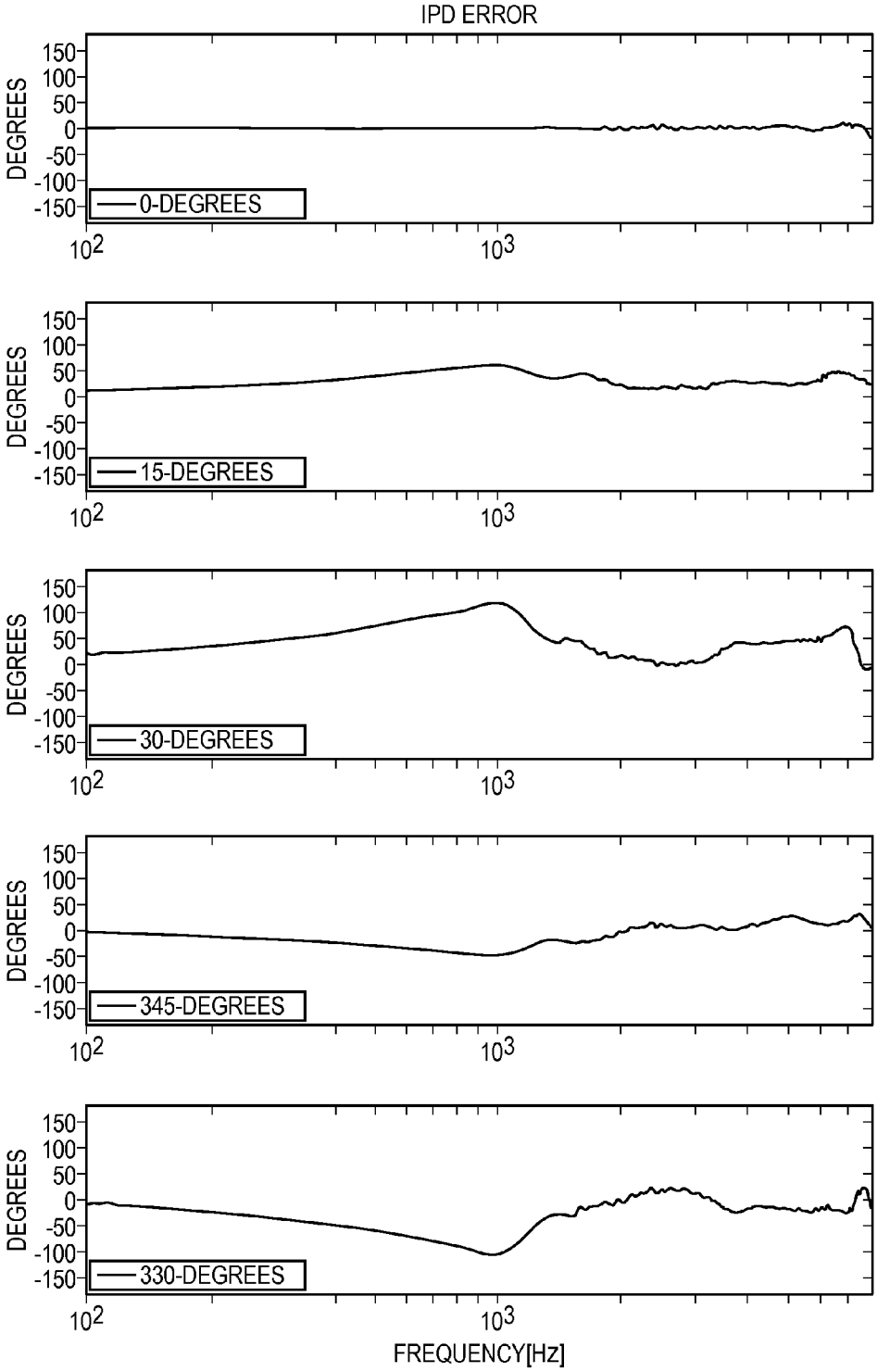
FIG. 24B illustrates the IPD error of the seven-element array with narrowed (+/−15-deg.) target specification, at five azimuth angles.
Figure 25:
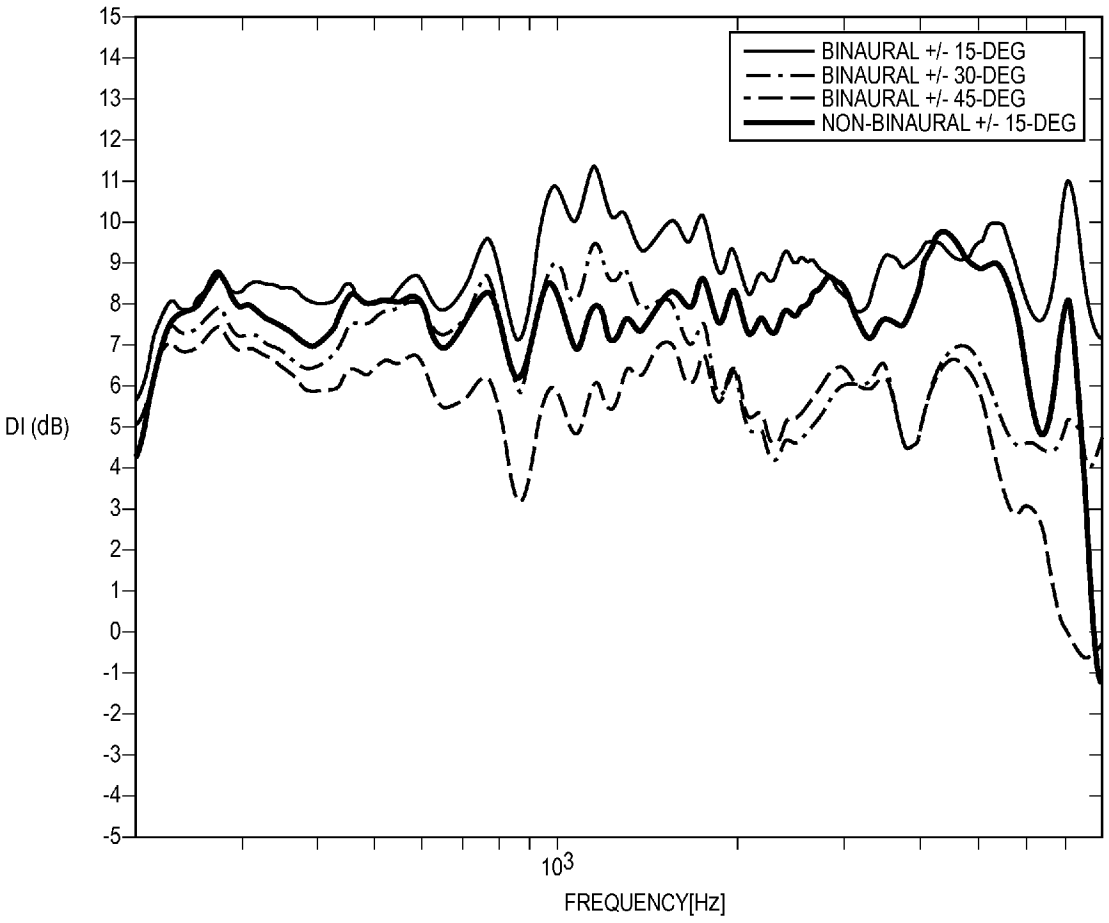
FIG. 25 illustrates a comparison of the 3D on-head directivity index of several seven-element arrays with different pass angles, with a non-binaural array included for comparison purposes. For the three binaural arrays, each curve represents the average DI of the respective left- and right-ear array.

For a critically narrow pass angle (i.e., one in which the directivity index approaches the maximum physically possible), the binaural target can be narrowed to +/−15 degrees. However, a very sharp polar target results, which is difficult to realize with a seven-element array. Thus the resulting ILD and IPD errors are relatively high. FIG. 22 shows the resulting polar response magnitude for the left-ear array. FIGS. 23A-23C and 23D-23F show the polar ILD and IPD, respectively, resulting from a seven-element binaural array with this narrower specification. FIGS. 24A and 24B show the ILD and IPD error, respectively, with respect to an unassisted binaural dummy. FIG. 25 compares the 3D, on-head DIs for several two-sided seven-element arrays with varying pass angle widths (15, 30 and 45 degrees), and illustrates an example of a non-binaural array at 15 degrees. Although such a narrow pass angle could be difficult to realize with only seven microphones in the array, increasing the number of microphones in the array would increase degrees of beamforming freedom and result in array performance more closely matching the specification.

The on-head seven-element binaural array with +/−15 degree pass angle has the highest directivity of any two-sided, cross head band-limited array discussed so far. DI differences between the narrowest seven-element binaural array and non-binaural array discussed in the two-sided beamforming section are due to on-head optimization. Binaural array filters are determined based on on-head polar data and include the shading and diffraction effects of the head, which results in array performance more closely meeting the polar specification. When devices employing array filters designed assuming free field (i.e., off head) conditions are located on head, the acoustic effects of the head cause the system to deviate from the free field performance. Such arrays have reduced performance. Arrays designed assuming free field conditions can perform significantly differently when used in a specific application such as an on head array or an array that is designed to be placed on a surface such as a table or desk.

Binaural arrays with very narrow pass angles can result in spatial performance approaching that of a monaural array, including "in the head" spatial impressions. This is due to the lack of energy in the array output from sound sources at non-zero azimuth angles. If such an array is used on-head, head tracking (described below) can be used to widen the receive pattern. For example, if the user is turning his head frequently to look at a number of talkers, the receive pattern could be widened so as to provide better binaural cues and spatial awareness. If the array is not head mounted, head tracking can be used to point the main lobe in the direction of the user's gaze, as described below. Even though narrow pass angles can greatly increase the TNR and intelligibility, the nearly monaural spatial presentation can degrade perceived naturalness of the conversation enhancement system and detract from the overall conversation assistance experience. The quality of spatial cues output from very narrow binaural arrays can be enhanced by manipulating the ILDs and IPDs.

One manner in which ILDs and IPDs can be manipulated is to exaggerate the spatial cues beyond those described by the natural HRTFs. For example, a sound source at 5-degrees may be reproduced by a binaural beamformer with IPDs and ILDs corresponding to 15-degrees, while for the same array sound sources at 0-degrees may be reproduced with IPDs and ILDs corresponding to 0-degrees. Exaggeration of interaural characteristics can be accomplished by warping the complex polar binaural specification used in binaural beam forming. Naturally occurring energy incident on the listener's location that would be perceived as having a first angular extent is received, processed, and rendered to a listener in a manner such that it is perceived to be spread over a second angular extent different from the first angular extent. The second angular extent may be larger than or smaller than the first angular extent. Additionally, the center of the angular extent is rendered such that it is perceived in the same location as it would be perceived without processing. Alternatively, an offset can be applied such that energy is perceived to be incident from a direction shifted by an offset angle with respect to its perceived arrival direction.

Figure 26A:
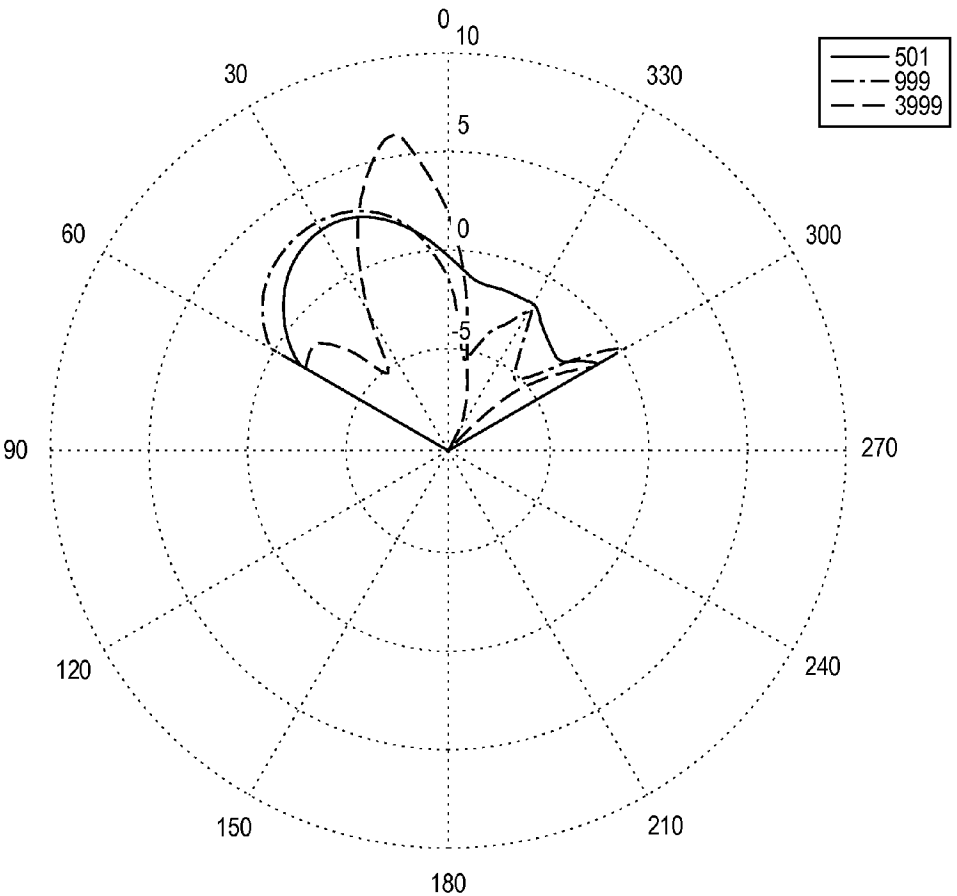
FIGS. 26A and 26B show the left and right ear magnitude specifications of FIGS. 17A and 17C, respectively, after warping the specification by a factor of three.
Figure 26B:
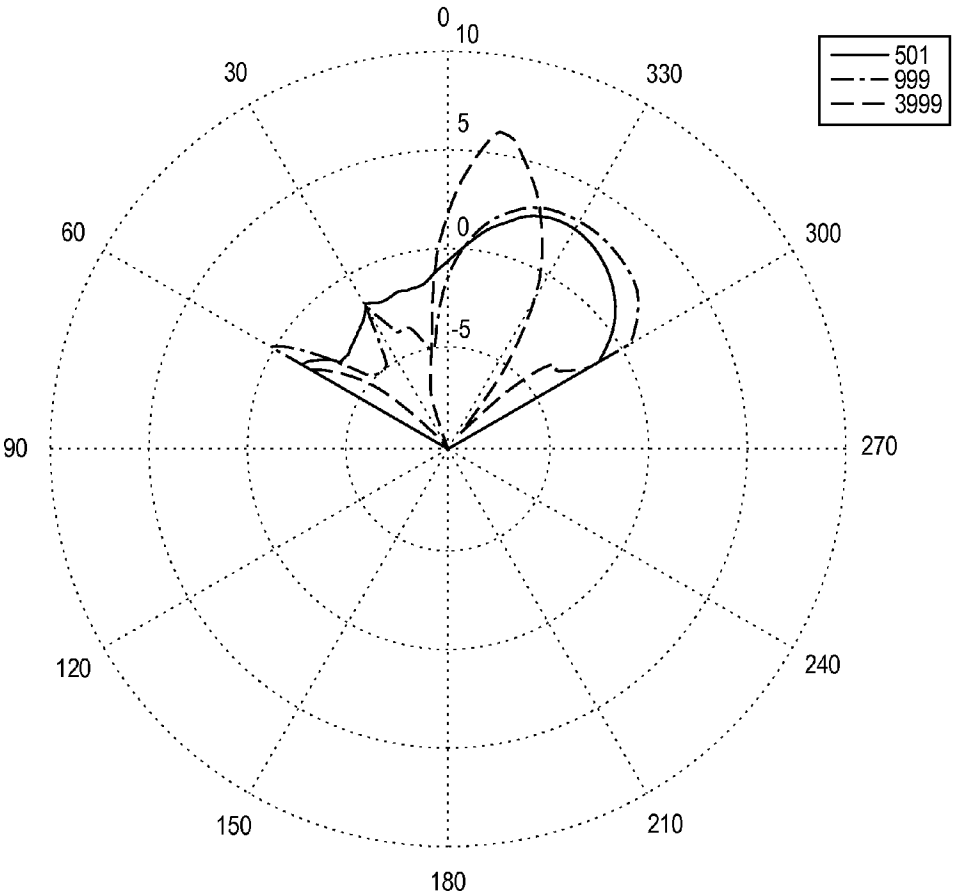

For the specific non-limiting example given above, the complex specification would be warped by a factor of three along the angle dimension, such that the warped specification at 15-degrees corresponds to an HRTF at 5-degrees. Although a factor of three is used in this example, warping factors different from three are also contemplated, and the examples are not limited in the degree of warping. Warping factors can be less than one or any amount greater than one. FIGS. 26A and 26B show the left and right ear magnitude specifications of FIGS. 17A and 17C, respectively, after warping the specification by a factor of three. Note that the total main-lobe width of the array is the same between the specifications (+/−60-degrees), however, the values in the specification are warped. In this way energy from a narrow binaural array can be spread out over a wider perceived range of azimuth angles to the listener without increasing the total energy through the array. This then maintains the TNR and intelligibility benefits of a very narrow binaural array, yet creates more pleasing spatial characteristics. The added IPD and ILD cues can also aid intelligibility, since the ear-brain system can take advantage of richer, intelligibility-enhancing binaural cues. Many other manipulations of spatial cues are possible, including but not limited to non-linear warping of cues and use of cues beyond those described by HRTFs, such as those associated with the well-established concept of time-intensity trading. In the case of time-intensity trading, for example, polar ILD and IPD targets could be generated using established trading rules resulting in a specification that differs from measurement-based specifications such as those of FIGS. 17A-17C but still produces similar spatial impressions for a listener.

An alternative manner in which the apparent spatial width can be increased without increasing the main lobe width is by non-linear, time-varying signal processing. One non-limiting example of such signal processing follows. The time-domain left and right ear signals after array processing are broken into blocks, which in one non-limiting example can be 128 samples long. Those blocks are transformed into the frequency domain, manipulated, transformed back into the time domain, and then reproduced to the user. A non-limiting exemplary block-processing scheme is as follows. Once in the frequency domain, an ILD and an IPD are generated at each frequency based on the difference between the left and right ear array magnitude and phase, respectively. A filter to warp the input ILD and IPD is then generated according to this rule: WarpLevel=ILDin*(ILDwarpfactor−1); WarpPhase=IPDin*(IPDwarpfactor−1). The "warpfactors" are equivalent in intent to the warp factor described above. WarpLevel and WarpPhase represent the magnitude and phase of the frequency-domain warping filter. The filter is frequency dependent and likely non-minimum phase. The filter is then applied to the input signal (multiplication in frequency domain) in order to create an output ILD and IPD that has been warped by IPDwarpfactor and ILDwarpfactor. In order to keep the system causal, the warping filter is applied to the ear signal which is delayed. For example if the input ILD and IPD at an arbitrary frequency are 3 dB and 15 degrees, and if both the ILDwarpfactor and IPDwarpfactor are 2, then the warping filter response at this frequency is 3 dB in magnitude and 15 degrees in phase. After applying the filter (multiplication in frequency domain), the output ILD and IPD are 6 dB and 30 degrees, which is double the input ILD and IPD. If the ILD and IPD are defined to be positive for sounds to the left of the listener, then the warping filter is applied to the right ear to keep the system causal since the right ear is delayed relative to the left to increase the IPD. Other methods exist to accomplish the above, for example by using a table lookup to relate input ILD and IPD to the output ILD and IPD instead of an ILDwarpfactor and IPDwarpfactor.

In some examples, it may be desirable to allow the directivity of the array to be varied in some manner. As the nature of the environment in which a conversation enhancement device is used changes, some alteration in operation of the device (for example varying array directivity) may be desirable. In some examples, a user-controlled switch may be provided to accomplish a functionality that allows the user to manually change the array directivity, e.g., by switching between various predetermined array directivities. In some examples, switching or altering array directivity may be done automatically, for example as a function of one or more sensed conditions.

In practice, conversation assistance arrays with an extremely narrow fixed (i.e., time-invariant) pass angle or main-lobe width, can degrade the conversation experience. When using such arrays, an assisted listener must substantially face the active talker, which can be burdensome and fatiguing. This problem is compounded when multiple people participate in a conversation, as the assisted listener must constantly rotate his or her head toward the active talker. This so-called "rubbernecking problem" can be highly frustrating for listeners. Additionally, an assisted listener may not see a talker speaking substantially off-axis. Without this visual cue, the listener may not turn toward the talker and may miss the conversation altogether. To address this issue, pass angles should maintain a minimum width. For a head-worn array experiments suggest a pass angle of approximately +/−45-degrees to be sufficient for increasing conversational understanding without causing excessive "rubbernecking". For a non-head mounted array a wider pass angle may be required depending on the angular position of the off-axis talkers relative to the array's location. An approximately +/−15-degree pass angle increases conversation intelligibility to a greater extent for an on-axis talker, but may result in excessive "rubbernecking". Thus it is considered in non-limiting examples that approximately +/−15-degrees is likely a minimum LTI pass angle and approximately +/−45-degrees is likely a reasonable trade-off between intelligibility gain and rubbernecking reduction.

Conversations are dynamic, as are the environments in which they occur. One moment the surroundings may be quiet, while minutes later the location may become noisy, for example a stream of noisy people may fill a room with noise. A conversation may be one-on-one or between several people. In the latter scenario talkers may interject at any moment, perhaps from one end of a table or another.

The dynamic nature of conversations presents a multitude of scenarios for conversation assistance devices. For one-on-one conversations in very noisy environments, a highly directional microphone array is desirable so as to improve intelligibility and ease of understanding. In less noisy environments, the highly directional array may remove too many ambient sounds of the surrounding environment, making the device sound unnatural and too obtrusive. When multiple talkers are involved in a single conversation around a table, a highly directional array may result in the user missing comments from those sitting off-axis.

In one example, a conversation assistance device may include some means (i.e., functionality) to accomplish time-varying, situation dependent array processing. One such means includes allowing the user to manually switch between different reception patterns. As one non-limiting example, the user may be given a simple, one-degree of freedom user interface control (e.g., a knob that is turned or a slider) related to array directivity. Such a "zoom" control may empower users to customize their hearing experience during conversations. This control could, for example, allow a user to increase the array directivity when the environment becomes very noisy and intelligibility challenged, but then decrease the directivity (thus returning more natural spatial cues and increased situational awareness) when the ambient noise level later decreases. This control could be used to change not only pass angle width but also the angle of orientation of the pass angle. A passenger in a car may, for example, desire the main lobe to point 90-degrees left toward the driver, allowing the conversation to be assisted without the passenger looking at the driver. Varying the main lobe direction and/or width could be accomplished by switching between discrete sets of predetermined array filters for the desired directions, for example. This user control can be implemented in one or more elements of the conversation assistance system. As one non-limiting example, if a smartphone is involved in the system (e.g., residing in the space shown in FIG. 14 or otherwise tied into the system control) the user control can be implemented on the cell phone. Such a user control may ameliorate some of earlier described problems when using narrow pass angles.

In addition to changing the pass angle width and angle of orientation, the user may selectively turn on or off multiple pass angles at different angles of orientation. The user may use a smartphone app (or an app on a different type of portable computing device such as a tablet) to accomplish such control. That control may, for example, present the user with a visual icons of their position and possible sound sources around them at every 30-degrees. The user would then tap one or more sound source icons to enable or disable a pass angle oriented in that direction. In this way, for example, the user could tap the sound source icons at 0-degrees and −90 degrees to hear talkers at those angles, while attenuating sound sources at all other angles. Each of the possible array orientation angles would comprise a binaural array with ILDs and IPDs that correspond to the orientation angle. In this way, a sound source from a given angle will appear to the user to be positioned at that given angle. If the array is head-worn, head tracking could be used to vary the orientation angles, ILDs, and IPDs as a function of head position to keep the apparent talker location fixed in space instead of varying with head position. In the case of an off-head array, head tracking could be used to vary the ILDs and IPDs to keep the apparent talker location fixed in space, while the orientation angles would not move since the array is not moving with the head.

Another form of time-varying processing relates to the physical orientation of the array. In one non-limiting example for an array comprising microphones located around the periphery of a smartphone case, the array may perform differently depending on if the device is horizontal (e.g., flat on a table) or vertical (e.g., in a pocket or hung around the neck with a necklace). In this example, the main lobe may point forward along the table when oriented horizontally, but then change to pointing normal to the surface of the smartphone screen when oriented vertically. In this way, the user benefits from directivity regardless of the orientation of the device and is thus free to place the device on a table or in a pocket/around the neck. This change in main lobe aiming angle can be accomplished by switching to a different set of array filters, where both sets of array filters can be designed using the processes described herein. Such switching can be automated using a signal from an accelerometer, perhaps one integrated within a smartphone. In another non-limiting example, the array may perform differently depending on if the device is being used for out-loud reception of other talkers or for near-field reception of the user's own voice such as in the case of telephony. In the latter case, the array filters can change to increase array sensitivity for the user's own voice relative to other sounds in the far-field. This increases the signal-to-noise ratio as heard by a listener on the remote end of a telephone conversation, for example. The same array filter design methodology described herein can accomplish this filter design by appending both near-field and far-field data into the acoustic responses (S) and specification (P). For a non-limiting head-worn array example, the filters resulting from such a design will increase the so-called proximity effect, hence increasing the ratio of the user's own voice to other far-field sounds. As an additional non-limiting example for an array integrated into a smartphone case, the filters resulting from such a design will aim the main lobe upward, parallel with the smart phone screen, toward the user's mouth, hence increasing the energy received from the user's voice relative to other sounds.

Figure 1:
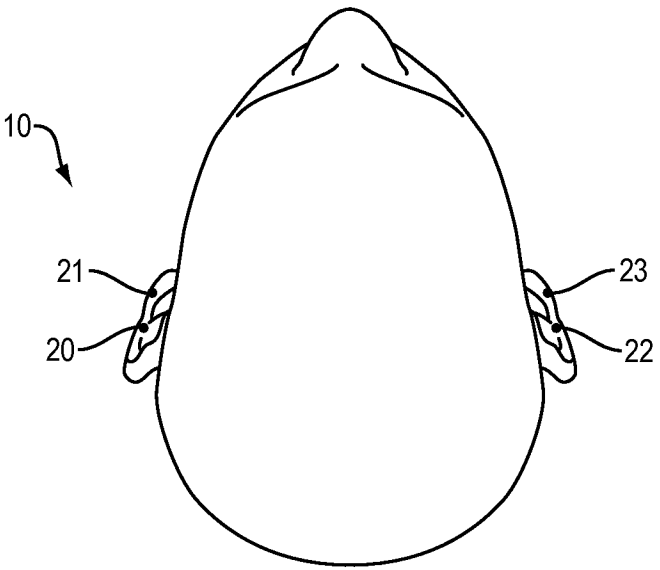
FIG. 1 schematically illustrates an example left and right two-element array layout for a conversation assistance system, where the microphones (illustrated as solid dots) are located next to the ears and are spaced apart by about 17.4 mm.
Figure 27:
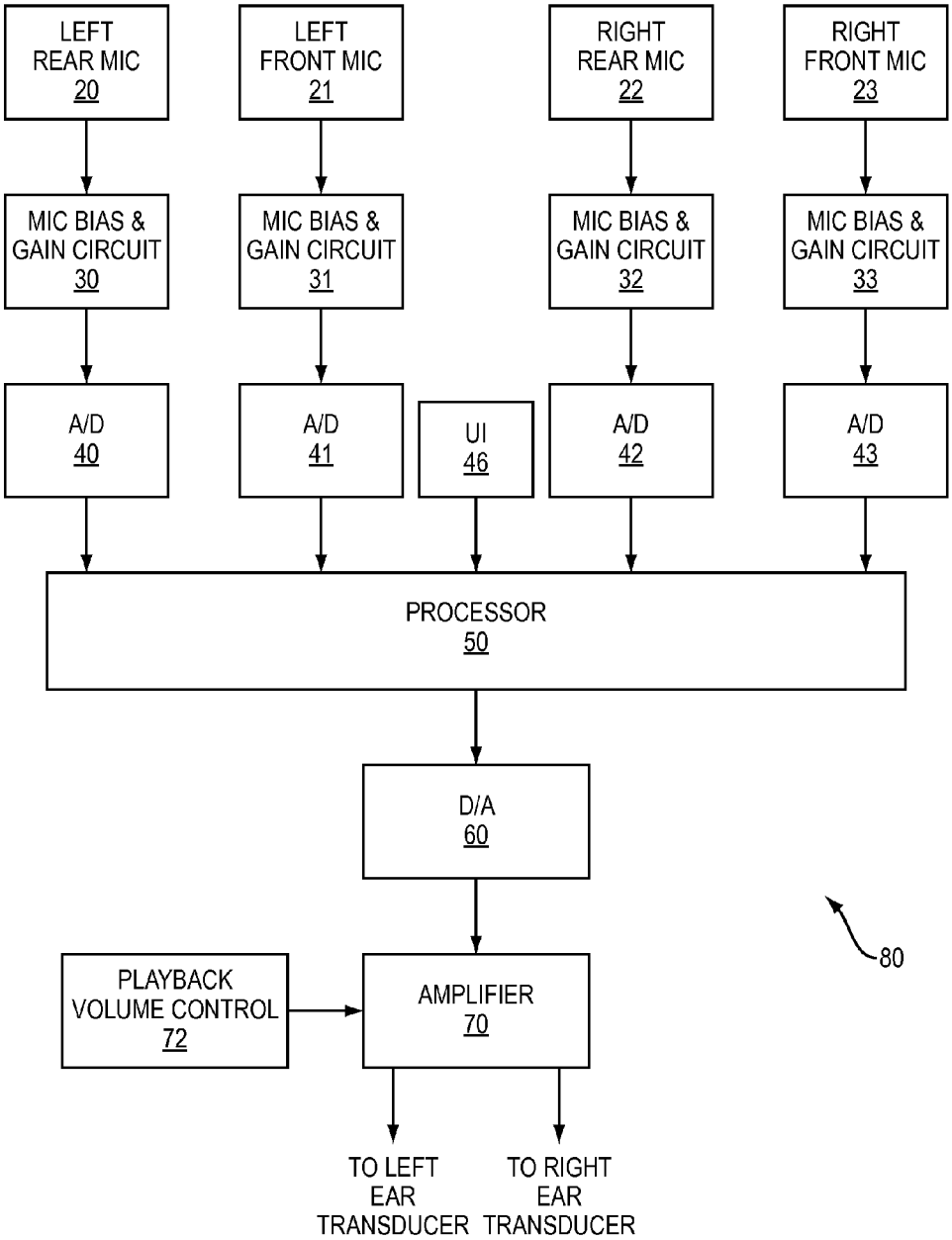
FIG. 27 is a simplified schematic block diagram of a conversation assistance system comprising a four element array.

FIG. 27 illustrates conversation assistance system 80 comprising the four element array 20-23 as in FIG. 5 and arranged as in FIG. 1. The output of each microphone is passed through a gain circuit that includes a mic bias and an analog gain circuit (30-33, respectively) and then digitized by A/D (40-43, respectively). The digitized signals are input to digital signal processor 50, which implements the filters described above. A user interface (UI) 46 may be included. The UI can, for example, include a type of display to provide status information to the user and/or allow for user input such as the manual switching described above. The outputs are turned back into analog signals by D/A 60, and the two channel D/A output is then amplified by amplifier 70 and provided to headphones (not shown). Playback volume control device 72 may be included to provide a means of allowing the user to control the signal volume. If active noise reduction is included as part of the system, it could be accomplished via processor 50, or implemented separately as is known in the field. Active noise reduction sensors and circuitry may be incorporated directly into the headphones.

The conversation assistance system preferably utilizes headphones, earphones, earbuds or other over ear, on ear or in ear electroacoustic transducers to transduce the electrical microphone array output signals to a pressure signal input into the user's ears. Electroacoustic transducers that are passive noise isolating (NI) or utilize active noise reduction (ANR), or are both passive and active, will also attenuate environmental noise within the user's ears. If the system utilizes NI and/or ANR electroacoustic transducers, and if the electroacoustic transducers attenuate the environmental noise at the user's ears to a level well below that of the transduced microphone array output signal, the user will substantially hear only the array output signal. Thus, the user will take full advantage of the TNR improvements of the array. If non-isolating, acoustically transparent electroacoustic transducers are instead used in the system, the user will hear a combination of environmental noise and the array signal. The effective TNR depends on the relative level of the environmental noise and array signal reproduced at the user's ears. The effective TNR will approach the array TNR as the array level is increased above the environmental noise. In a high-noise environment without NI or ANR electroacoustic transducers, the array level may need substantial amplification above the environmental noise to provide the full, array-based TNR improvement. This, however, may create high sound pressure levels in the user's ears and create significant discomfort or hearing damage. Thus in some non limiting examples it can be desirable for a conversation assistance system when used in high noise environments to include NI and/or ANR electroacoustic transducers. In some non limiting examples, the amount of noise reduction provided (e.g., by passive NI, ANR functionality in electroacoustic transducers, or a combination of both) should be equal to or greater than the directivity index of the array, such that diffuse background noise transmitted through the array will be roughly equivalent in level to the diffuse background noise passing through the electroacoustic transducers (ANR or passive NI). In some non limiting examples, the amount of noise reduction provided by the electroacoustic transducers is equivalent to the greatest attenuation of the microphone array across angle, which may be on the order of anywhere between 10 and 25 dB. In general, as noise levels in the environments increase, increased noise reduction from the electroacoustic transducers is desirable. It is possible to vary in a controlled manner the amount of noise reduction provided by ANR electroacoustic transducers more easily than it is to vary the noise reduction provided by passive NI devices. The quantity of noise reduction can be controlled in a desired manner. In typical feedback-based ANR devices a loop compensation filter is used to shape the feedback loop response so as to obtain maximum ANR performance while remaining stable. To first order the gain in this filter can be reduced in order to reduce the amount of ANR. A more complex system might shape the filter response rather than reducing gain, though this is not necessary.

For low noise environments, acoustically transparent headphones may be used. Alternatively, the noise reduction of an ANR headphone may be varied as a function of background noise level. For noisy environments, full ANR may be utilized. For quieter environments, ANR may be reduced or turned off. Further, in low-noise situations the ANR headphone may pass environmental sounds through to the ear via an additional or integral microphone on the outside of the ear cup or ear bud. This pass-through mode thus increases environmental awareness without necessarily modifying the array signal.

For an off-head array, without further modification, using mics on both sides of the device (e.g., the "space" of FIG. 14) for both the left and right ear signals will increase directivity but also cause the array to be monaural below the cutoff frequency. Also, narrow spacing (for example, the dimensions of a typical smart phone) and lack of acoustic shading due to a head between the left and right sides will cause the left ear and right ear signals to be substantially similar. Both of these issues can cause array spatial performance to be nearly monaural.

In order to both recreate accurate spatial cues and also attenuate off-axis sounds, binaural beamforming can be used. The acoustics of the microphones including any device on which they are mounted (such as a smart phone) are included in the least squares design of the array filters (which is described below). Also, the target spatial performance for the array is defined using a binaural specification, likely derived from a binaural dummy. Off-head binaural beamforming differs from that discussed above in that there is no head between the left and right side. Nonetheless, the design method will recreate binaural cues (e.g. ILDs and IPDs) as accurately as possible in the least squares sense even though no head exists between the two sides. Another benefit for off-head design is that the user's own voice can be better separated from other talkers, reducing the amplification of the user's own voice. This is due to the decreased proximity of the mic array to the user and angular separation between the user's mouth and talkers' mouths of an off-head array relative to an on-head array. Specifically, the array design method can be modified to steer a null backward toward the user's mouth to reduce amplification of the user's voice, while also performing other binaural beamforming tasks above. In addition to reducing the magnitude of the user's voice as received by the array, placement of the array may increase proximity to desired talkers, for example a talker in front of the user, hence increasing the TNR.

When the array is head mounted, the orientation angle of the array will correspond to the orientation of the desired talked with respect to the user because the user and the array are co-located. When the remote array and the user are not co-located, the ILD and IPD cues of the remote array output can be warped to better match the physical orientations of desired talkers to the user.

The main lobe need not be steered in the forward direction. Other target angles are possible using binaural beamforming. A main lobe could be steered toward the user's immediate left or right side in order to hear a talker sitting directly next to the user. This main lobe could recreate binaural cues corresponding to a talker at the left or right of the user, and also still reject sounds from other angles. With an array placed on a table in front of the user, a talker 90-degrees to the left of the user is not 90-degrees to the left of the array (e.g., it may be at about −135 degrees). Accordingly the spatial target must be warped from purely binaural. In this example, the target binaural specification of the array for a source at −135 degrees should recreate ILDs and IPDs associated with a talker at 90-degrees to the left of the user.

Figure 28:
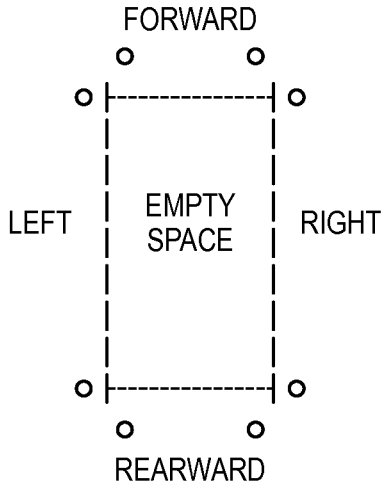
FIG. 28 is an example of an array that can be used in the conversation assistance system.
Figure 29:
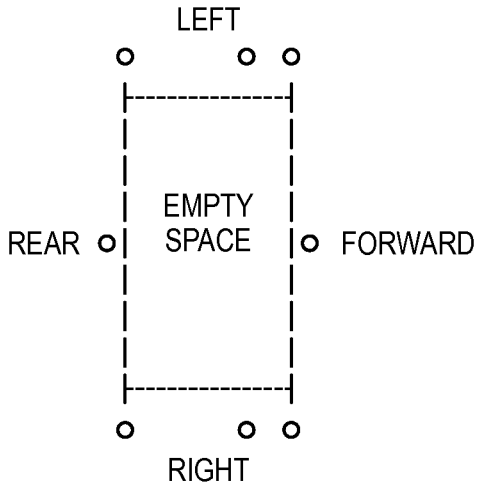
FIG. 29 is an example of an array that can be used in the conversation assistance system.

Microphone positions that differ from those shown in FIG. 14 may perform better depending on the embodiment and spatial target. Other non-limiting hypothetical microphone configurations are shown in FIGS. 28 and 29, in which the microphone position is indicated by a small circle. The pairs of microphones adjacent to each of the four corners of the space in FIG. 28 can provide better steering control of the main lobes at high frequency. Placement of microphones determines the acoustic degrees of freedom for array processing. For a given number of microphones, if directional performance (e.g., DI, preservation of binaural cues) is more important at some angles of orientation instead of others, placing more microphones along one axis instead of another may yield more desirable performance. The array in FIG. 14 biases array performance for the forward looking direction, for example. Alternatively, the array in FIG. 28 biases array performance for multiple off-axis angles. The array in FIG. 29, for example, biases performance for the forward looking direction for the array rotated 90-degrees. The quantity of microphones and their positions can be varied. Also, the number of microphones used to create each of the left and right ear signals can be varied. The "space" need not be rectangular. More generally, an optimal microphone arrangement for an array can be determined by testing all possible microphone spacings given the physical constraints of the device(s) that carry the array. WNG can be considered, particularly at low frequencies.

Off-head arrays do not mechanically follow the "look" angle of the user since they are not attached to the head. To account for this, the camera on a smart phone could be used to track the angle of the user's head and send the look angle to the DSP, where the array parameters are changed in real-time to rotate ILDs and IPDs corresponding to the new look angle. To illustrate, if the camera detected a −90-degree (left) rotation of the user's head, the array parameters would be modified to re-render the previously 0-degree array response to +90 degrees (right).

The choice of main lobe angle could be controlled by the user (for example through a user interface (UI) on a smartphone app—e.g., by tapping the position of the talker toward which the main lobe is steered), or the main lobe angle could be controlled adaptively (for example, by enabling spatial inputs that have high modulation energy indicating a strong nearby (hence desired) talker). The beam pattern could be adapted using an inertial sensor such as an accelerometer that can be used to track the direction in which the wearer is facing. For example the accelerometer can be coupled to the user's head (e.g., carried by a device worn by the user) so that it can be used to determine the direction in which the wearer is facing, and the beam pattern can be adapted accordingly. A head mounted sensor would need to communicate its output information to the device performing the signal processing for adapting the ILDs and IPDs; examples of devices that are involved in the signal processing are described elsewhere herein. The device could alternatively use face tracking or eye tracking to determine which direction the user is looking. Methods of accomplishing face and/or eye tracking are known in the art. The use of a head mounted sensor or other sensor for tracking the direction of the user's gaze would create different beam patterns than when the array was placed flat on a table.

At a system level, there are some unique attributes of the examples of off-head arrays relative to the on-head arrays. First, examples may be built around a cell/smart phone, cell/smart phone case, eyeglass case, watch, pendant, or any other object that is portable. One motivation for the embodiment is that it looks innocuous when placed on a table in a social setting. A phone case that surrounds the phone on all four edges could carry multiple microphones spaced as shown in the drawings or spaced in other manners. The phone case can be decoupled from a surface on which it is placed and/or the microphones can be mechanically decoupled from the phone case. This decoupling can be accomplished in a desired fashion, such as by using a soft material (e.g., a foam rubber or soft elastomer) in the mechanical path between the case and the surface and/or microphones so as to inhibit transfer of vibrations to the case and/or the microphones.

The conversation assistance system would likely comprise a digital signal processor (DSP), analog to digital and digital to analog converters (AD/DA), battery, charging circuitry, wireless radio(s), UI, and headphones. Some or all of the components (except the headphones) could be built into a specially designed phone case, for example, with minimal impact to the overall phone function or esthetic. Headphones (e.g., ear buds) could be wired or wireless, noise-reducing or non-noise reducing. Noise reducing headphone signal processing could be accomplished with components mounted in the phone case. Some or all of the microphones could be carried by ear buds, in place of or in addition to microphones in the phone case or other carried object. Functionality could also be built directly as part of the phone. The phone processor can accomplish some or all of the required processing. Microphones would need to remain exposed if the phone were used with a phone case. Thus, the system can be distributed among more than one physical device; this is explained in more detail below.

The UI to control the function of the array could exist on a cell phone, and the UI settings could be transmitted wirelessly or via a wire to the DSP conducting the array processing. In the case of a wired connection, an analog audio connection could transmit control data via FSK encoding. This would enable a cell phone without a Bluetooth radio to control the DSP, for example. The DSP could also perform hearing aid signal processing such as upward compression, or a smartphone could perform some of these tasks. Some of the processing could be accomplished by the phone. The special phone case could have its own battery, and that battery could be enabled to be charged at the same time as the phone battery.

Array Filter Design

Microphone beamforming is a process whereby electrical signals output from multiple microphones are first filtered then combined to create a desirable pressure reception characteristic. For arrays containing only two microphones in the free field, design of array filters can be deterministic. Simple mathematical relationships well known in the art can define complex array filter coefficients in terms of the positional geometry of microphones and a desired pressure reception characteristic such as a cardioid or hypercardioid. However, the design of array filters for arrays containing more than two microphones, not in the free field, requiring a non-trivial reception characteristic, requiring additional constraints for sufficient performance, or a combination thereof is not trivial. These complexities arise when designing arrays for use in conversation assistance. The need for high directivity to increase TNR and intelligibility, for example, necessitates the use of more than two microphones. Additionally, use of the conversation assistance system on a user's head introduces deleterious acoustic effects unlike the free field. There are deleterious effects from any structures located between or near the microphones. Array design needs to take these effects into account, whether due to a head or some other object. Additionally, binaural beamforming requires not only a specific magnitude but also phase characteristic of the polar pressure receive pattern.

One method to design array filters for conversation assistance is described below. The inputs are first described. All inputs are discrete functions in the frequency domain, but frequency is dropped from the notation for simplicity. Instead, it is understood that each input is supplied for each frequency, and each mathematical operation is conducted independently for each frequency unless otherwise specified. The desired spatial performance of the array is given as a polar specification, P, which is a 1×M vector of M discrete polar angles. The acoustic response of each microphone in the array is given as S, which is a L×M matrix corresponding to L microphones and M discrete polar angles. These acoustic responses can be based on measurements or theoretical models. The acoustic responses, S, can be measured in-situ (such as on a binaural dummy head) in order to include acoustic effects of nearby baffles or surfaces in design of array filters, which results in improved array performance as described previously. The maximum desired WNG is given as E, which is a scalar. The maximum desired filter magnitude is given as G, which is a 1×L vector of real values corresponding to L microphones. The maximum filter magnitude specification can be used to implement a low-pass of the array response, a high-pass of the array response, prevent digital clipping of the array processing on the DSP, or implement cross-head band-limiting of two-sided arrays as discussed above. An error weighting function, W, determines the relative importance of each polar angle in the array filter solution. W is an M×M matrix with non-zero entries along the diagonal corresponding to the error weights of the M polar angles and zeros elsewhere. Weighting polar angles can help the designer achieve better polar performance if, for example, noise sources reside at known angles relative to the array where a better fit to the polar target at the expense of performance at other angles would help overall array performance.

In all of the above definitions, the M-dimension may more generally correspond to any set of positions and not necessarily polar angles. Thus the below method could be used to create array filters based on arbitrary measurements in space instead of azimuth angles, for example. Furthermore, the L-dimension may correspond to loudspeakers and not microphones, whereby the below method could be used to create array filters for loudspeaker arrays instead of microphone arrays via acoustic reciprocity, which is well known in the art.

The array filters can be found using an iterative method where initial specifications for WNG, maximum gain, and complex polar performance are provided, a filter solution is generated using, for example, the method of least squares along with the acoustic response data, the WNG and filter magnitudes are computed and compared to desired specifications, the importance of WNG and maximum filter gain specifications relative to the polar specification are then respectively modified depending on the comparison, and a new filter solution is then calculated. This process continues until a solution is found that does not exceed the WNG nor maximum filter magnitude specifications, yet meets the complex polar specification, for example, in the least squares sense. Various other optimization methods can be applied to guide the iterative process, as are known in the art.

Other filter design methods exist. In an alternative method, both the left and right arrays may be solved jointly. In this method, the left and right array polar targets are given as $P_l$ and $P_r$, respectively. An interaural target, $P_i$, is then formed from the ratio of $P_r/P_l$. The left array filters are solved using the above procedure and the $P_l$ specification, resulting in array polar performance $H_l$. The polar target for the right array, $P_r$, is then offset by the actual polar performance of the left array, such that $P_r=P_i*H_l$. The right array filters are then solved using the updated $P_r$ specification, resulting in array polar performance $H_r$. The left array specification is then offset by the actual polar performance of the right array, such that $P_l=H_r/P_i$. The left array filters are then solved using the updated $P_l$ specification. This iterative process continues, designing the left array filters, updating the right array specification, designing the right array filters, updating the left array specification, and so on, until the target interaural performance is within a specified tolerance.

EXAMPLES

Figure 30:
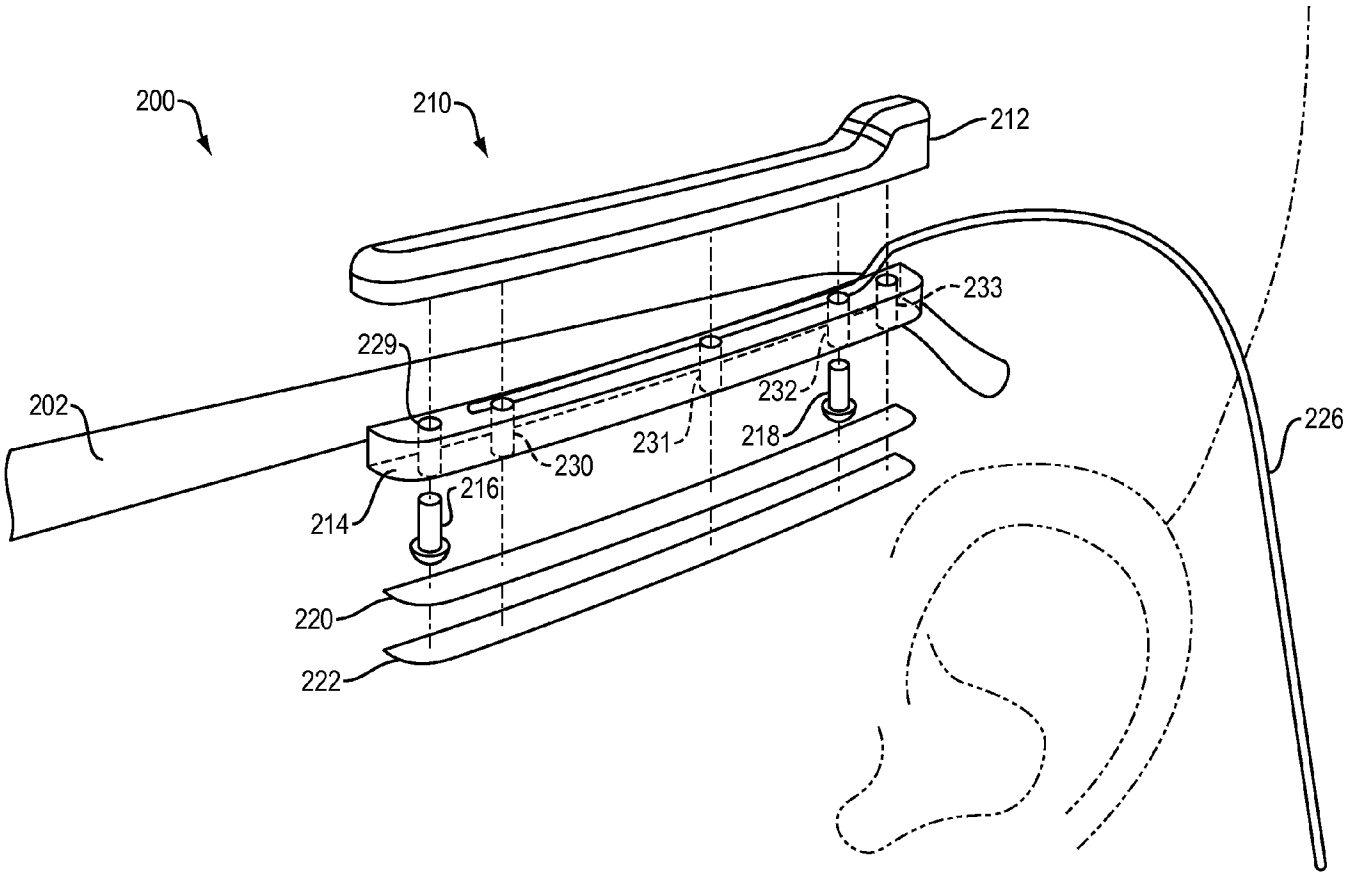
FIG. 30 illustrates a conversation assistance system with the elements mounted to eyeglasses.
Figure 31:
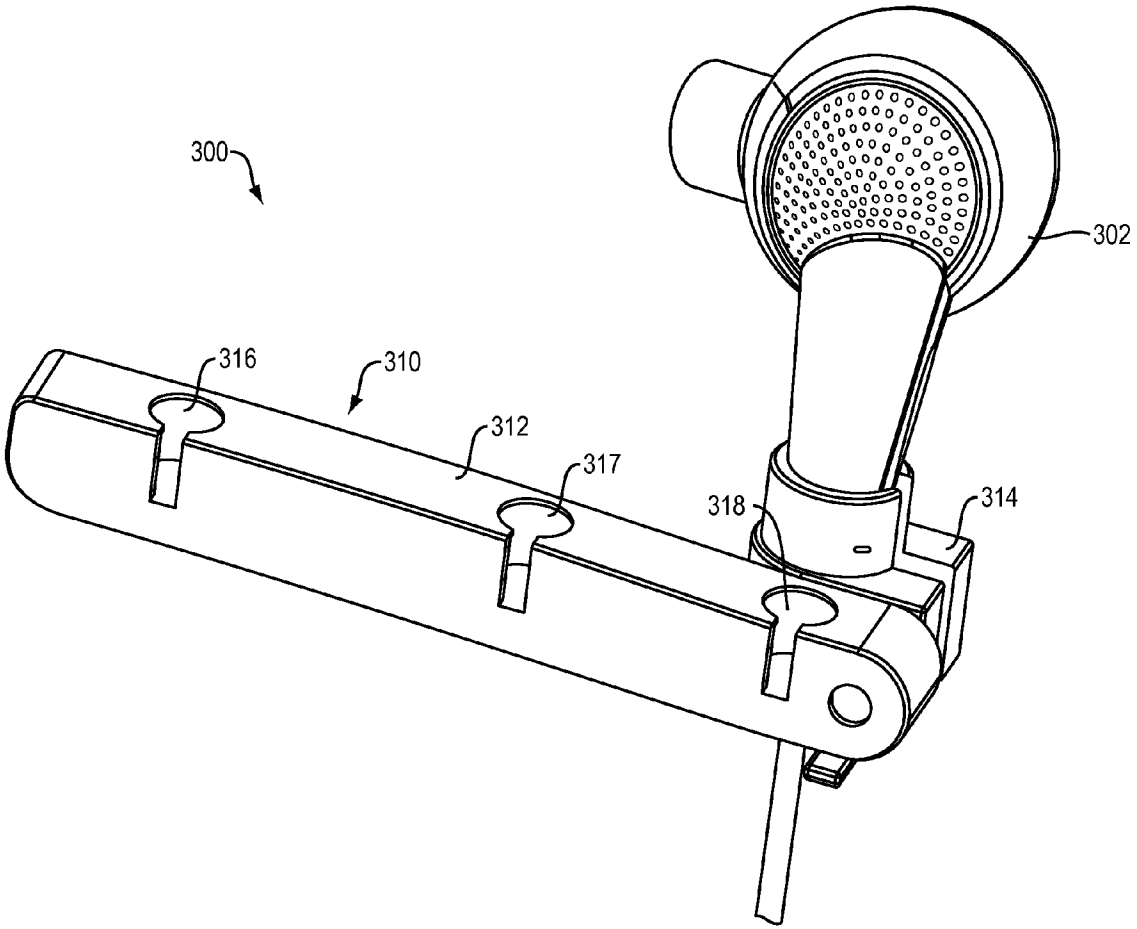
FIG. 31 illustrates a conversation assistance system with the elements that are on the sides of the head carried by an ear bud.

Non-limiting examples illustrating some of the numerous possible ways of implementing the conversation assistance system are shown in FIGS. 30 and 31. Assembly 200, FIG. 30, affixes the elements of the left side of the array to left eyeglasses temple portion 202. Housing 210 includes upper housing half 212 and lower housing half 214 that fit over temple 202 and are held together by fasteners 216 and 218 that fit into receiving openings 229 and 233. The microphone elements 230, 231 and 232 fit in cavities in lower half 214. Grille 220, which may be a perforated metal screen, covers the microphones so as to inhibit mechanical damage to them. Fabric mesh cover 222 has desirable acoustic properties that help to reduce noise caused by wind or brushing of hair against the mics. Conductor 226 carries mic signals. A similar arrangement would be used on the right side of the head.

Assembly 300, FIG. 31, adds the arrays to an ear bud 302. Housing 310 is carried by adapter 314 that fits to the ear bud. Cavities 316-318 each carry one of three microphone elements of a six-element array. A seventh element (if included) could be carried by a nape band, or by a head band, for example. Or it could be carried on the bridge of the eyeglasses.

Figure 32:
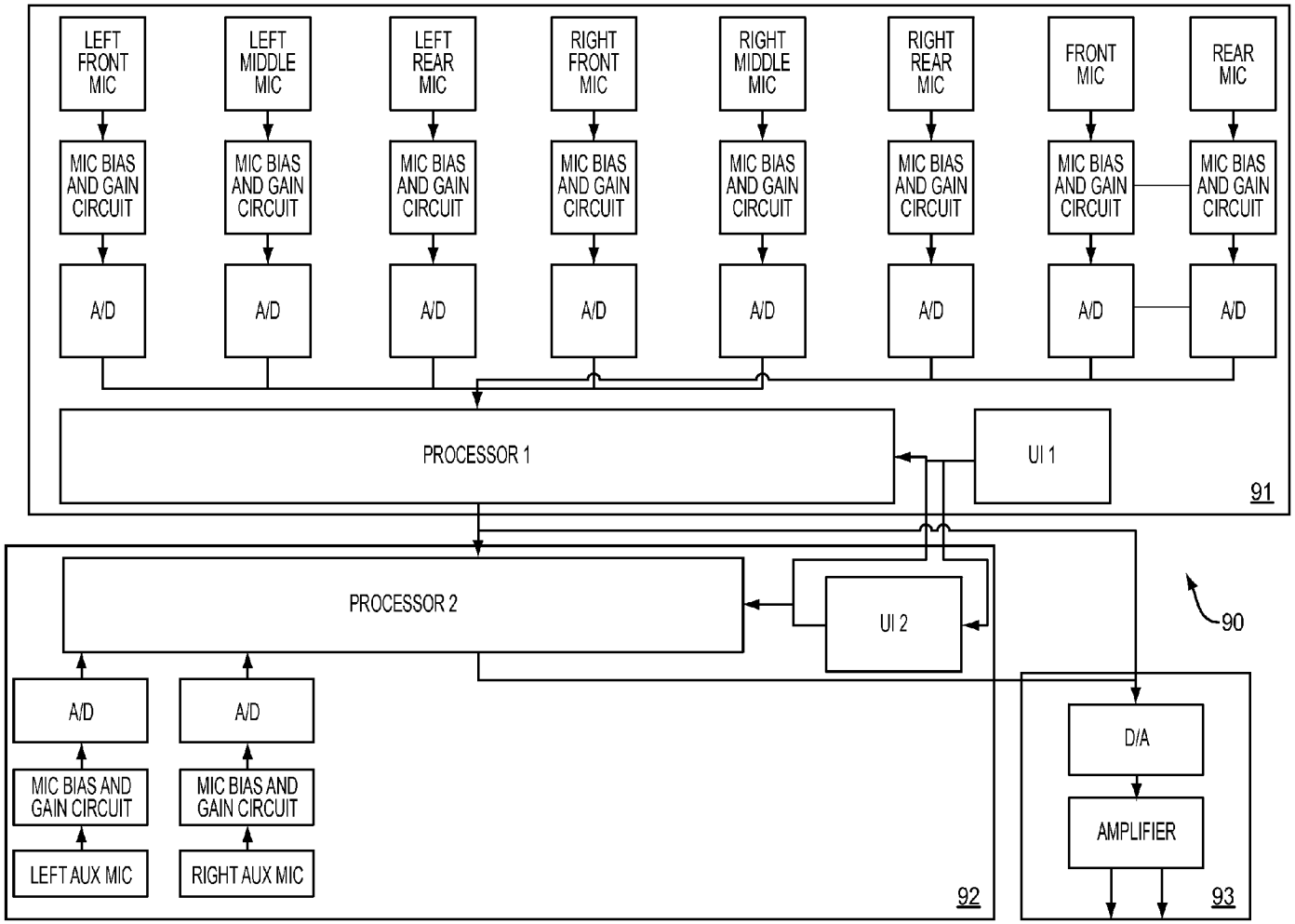
FIG. 32 is a simplified schematic block diagram of a conversation assistance system comprising two or more separate, networked devices.

Conversation assistance system 90, FIG. 32, illustrates aspects of system functionality, and distribution of the functions among more than one device. First device 91 includes the array microphones, a processor and a UI. Device 91 may be a phone case but need not be; the following discussion applies generally to any remote (i.e., non head-mounted) array system. After each microphone passes through the bias, gain, and A/D circuitry, the digital signals are passed into a first signal processor 1. Signal processor 1 may perform signal processing such as array processing, equalization, and dynamic range compression. UI 1 connects to processor 1 to control certain parameters such as those of the array processing algorithm. The output of processor 1 is then passed to a second signal processor 2 that is part of separate device 92, which may for example be headphones worn by the user. Signal processor 2 may perform signal processing such as array processing, equalization, and dynamic range compression. A second UI 2 is connected to second processor 2. Both the first and second user interfaces (UI 1 and UI 2) may also connect to both the first and second processors to control parameters on both processors. The first processor may be contained in a first device 91, while the second processor may be contained in a second device 92.

The digital data passed from the first processor to the second processor may be transmitted via a wired connection or via a wireless connection such as over a Bluetooth radio. Control data passed from either user interface may be transmitted via a wired connection or wirelessly such as over a Bluetooth radio. Algorithms running on the processors may be organized such that processes requiring high computational complexity are run on a processor in a device with more substantial battery capacity or larger physical size. The first processor in the first device may bypass the second processor and second device and output digital audio directly to a third device 93 containing a D/A and audio amplifier. Device 93 may be but need not be an active ear bud with a wireless link to receive digital signals from devices 91 and 92. The functionality of device 93 could also be included in device 91 and/or device 92. In this way, additional signal processing and user interface features may be available to the user if they choose to use the second device 92. If the user does not choose to use the second device 92 including processor 2 and UI 2, then processor 1 and UI 1 will continue to provide some functionality. This flexibility can allow the user to utilize advanced functionality only available in device 92 only when needed.

In one example, the directional processing and equalization may be done on processor 1 and controlled by UI 1, but when processor 2 and UI 2 are connected via the second device 92, the user would enable hearing-aid upward compression and control of that algorithm via a smart phone. In this example, the first device 91 may be head-worn array and the second device 92 may be a smart phone.

In another example Processor 1, UI 1, and connected microphones and circuitry may perform array processing in a first device 91, while a second device 92 may perform upward compression and other hearing-aid like processing. In this example, the second device 92 comprises processor 2, UT 2, left and right AUX mics and circuitry, A/D, and amplifier. In this example, the second device 92 may be a head-worn device (e.g., ear buds) that performs hearing-aid like signal processing in the absence of the first device 91, but when the first device 91 is connected by the user over a wireless link, array processing would then occur in the first device 91 with the array processed signal output to the second device 92 for playback. This example is beneficial in that the user could use a small, head-worn device 92 for hearing assistance, but then connect a remote device 91 (e.g., a phone case embodiment) with array processing for added hearing benefit when in noisy situations.

Another non-limiting example of the conversation assistance system involves use of the system as a hearing aid. A remote array (e.g., one built into a portable object such as a cell phone or cell phone case, or an eyeglass case) can be placed close to the user. Signal processing accomplished by the system (on one or more than one device, as described above) accomplishes both microphone array processing as described above and signal processing to compensate for a hearing deficit. Such a system may but need not include a UI that allows the user to implement different prescriptive processing. For example the user may want to use different prescriptive processing if the array processing changes, or if there is no array processing. Users may desire to be able to adjust the prescriptive processing based on characteristics of the environment (e.g., the ambient noise level). A mobile device for hearing assistance device control is disclosed in U.S. patent application Ser. No. 14/258,825, filed on Apr. 14, 2014, entitled "Hearing Assistance Device Control", the disclosure of which is incorporated herein in its entirety.

A number of implementations have been described. Nevertheless, it will be understood that additional modifications may be made without departing from the scope of the concepts described herein, and, accordingly, other embodiments are within the scope of the following claims.

What is claimed is:

1. A conversation assistance system, comprising:

a bi-lateral array of microphones arranged externally of a space that does not include any array microphones, where the space has a left side, a right side, a front and a back, the array comprising a left side sub-array of multiple microphones and a right side sub-array of multiple microphones, where each microphone has a microphone output signal;

active noise reducing (ANR) electroacoustic transducers associated with each of the left side sub array and the right side sub array and having a controlled amount of ANR provided; and a processor that creates from the microphone output signals a left-ear audio signal and a right-ear audio signal;

wherein:

the left-ear audio signal is created based on the microphone output signals from one or more of the microphones of the left-side sub-array and one or more of the microphones of the right-side sub-array;

the right-ear audio signal is created based on the microphone output signals from one or more of the microphones of the left-side sub-array and one or more of the microphones of the right-side sub-array;

the bi-lateral array has a directivity index (DI); and the ANR transducers are controlled such that the amount of noise reduction provided by the ANR transducers is equal to or greater than the DI of the bi-lateral array.

2. The conversation assistance system of claim 1 wherein the processor comprises a filter for the output signal of each microphone that is involved in the creation of the audio signals.

3. The conversation assistance system of claim 2 wherein the filters are created using at least one polar specification comprising the magnitude and phase of idealized output signals of one or both of the left-side sub-array and the right-side sub-array as a function of frequency.

4. The conversation assistance system of claim 3 comprising separate polar specifications for each sub-array.

5. The conversation assistance system of claim 3 wherein a polar specification is based on polar head-related transfer functions of each ear of a binaural dummy.

6. The conversation assistance system of claim 3 wherein a polar specification is based on polar head-related transfer functions of each ear of a person's head.

7. The conversation assistance system of claim 3 wherein a polar specification is based on a model.

8. The conversation assistance system of claim 1 wherein the processor creates both the left- and right-ear audio signals based on the microphone output signals from one or more of the microphones of the left-side sub-array and one or more of the microphones of the right-side sub-array, but only below a predetermined frequency.

9. The conversation assistance system of claim 8 wherein above the predetermined frequency the processor creates the left-ear audio signal based only on the microphone output signals from microphones of the left-side sub-array and creates the right-ear audio signal based only on the microphone output signals from the microphones of the right-side sub-array.

10. The conversation assistance system of claim 1 wherein the left side sub-array is arranged to be worn proximate the left side of a user's head and the right side sub-array is arranged to be worn proximate the right side of the user's head.

11. The conversation assistance system of claim 1 wherein the left side sub-array microphones are spaced along the left side of the space and the right side sub-array microphones are spaced along the right side of the space.

12. The conversation assistance system of claim 11 wherein the array of microphones further comprises at least one microphone located along either the front or back of the space.

13. The conversation assistance system of claim 1 wherein the processor is configured to attenuate sounds arriving at the microphone array from outside of a predetermined pass angle from a primary receiving direction of the array.

14. The conversation assistance system of claim 13 further comprising functionality that changes the predetermined pass angle.

15. The conversation assistance system of claim 14 wherein the predetermined pass angle is changed based on tracking movements of a user's head.

16. The conversation assistance system of claim 1 wherein the processor is configured to process the microphone signals to create specific polar interaural level differences (ILDs) and specific polar interaural phase differences (IPDs) between the left and right ear audio signals.

17. The conversation assistance system of claim 1 wherein the processor is configured to process the microphone signals to create specific polar ILDs and specific polar IPDs in the left and right ear audio signals, as if the sound source was at an angle that is different than the actual angle of the sound source to the array.

18. The conversation assistance system of claim 1 wherein the microphone array has a directivity that establishes the primary receiving direction of the array, and wherein the conversation assistance system further comprises functionality that changes the array directivity.

19. The conversation assistance system of claim 18 further comprising a user-operable input device that is adapted to be manipulated so as to cause a change in the array directivity.

20. The conversation assistance system of claim 19 wherein the user-operable input device comprises a display of a portable computing device.

21. The conversation assistance system of claim 18 wherein the array directivity is changed automatically.

22. The conversation assistance system of claim 21 wherein the array directivity is changed based on movements of a user.

23. The conversation assistance system of claim 18 wherein the array can have multiple directivities, and wherein the system comprises a binaural array with ILDs and IPDs that correspond to the orientation angle for each array directivity.

24. The conversation assistance system of claim 1 wherein the left side sub-array is coupled to the left side of a cell phone case that is adapted to hold a cell phone, and the right side sub-array is coupled to the right side of the cell phone case.

25. The conversation assistance system of claim 1 wherein the array is constrained to have a maximum white noise gain (WNG).

26. The conversation assistance system of claim 1 wherein the DI is controllable, and wherein the DI and the amount of noise reduction accomplished with the electroacoustic transducers are both controlled such that the amount of noise reduction is kept equal to or greater than the DI of the array.

27. The conversation assistance system of claim 1 comprising at least two separate physical devices each with a processor, where the devices communicate with each other via wired or wireless communication.

28. A conversation assistance system, comprising:

a bi-lateral array of microphones arranged externally of a space that does not include any array microphones, where the space has a left side, a right side, a front and a back, the array comprising a left side sub-array of multiple microphones and a right side sub-array of multiple microphones, where each microphone has a microphone output signal;

active noise reducing (ANR) electroacoustic transducers associated with each of the left side sub array and the right side sub array and having a controlled amount of ANR provided; and a processor that creates from the microphone output signals a left-ear audio signal and a right-ear audio signal;

wherein:

the left-ear audio signal is created based on the microphone output signals from one or more of the microphones of the left-side sub-array and one or more of the microphones of the right-side sub-array, but only below a predetermined frequency; and the right-ear audio signal is created based on the microphone output signals from one or more of the microphones of the left-side sub-array and one or more of the microphones of the right-side sub-array, but only below a predetermined frequency;

above the predetermined frequency the processor creates the left-ear audio signal based only on the microphone output signals from microphones of the left-side sub-array and creates the right-ear audio signal based only on the microphone output signals from the microphones of the right-side sub-array;

the processor is configured to process the microphone signals to create specific polar interaural level differences (ILDs) and specific polar interaural phase differences (IPDs) between the left and right ear audio signals;

the bi-lateral array has a directivity index (DI); and the ANR transducers are controlled such that the amount of noise reduction provided by the ANR transducers is equal to or greater than the DI of the bi-lateral array.

29. A conversation assistance system, comprising:

a bi-lateral array of microphones that are coupled to a portable device and arranged on the portable device, the array comprising a left side sub-array of multiple microphones and a right side sub-array of multiple microphones, wherein the microphone array has a directivity that establishes the primary receiving direction of the array, and wherein each microphone has a microphone output signal;

active noise reducing (ANR) electroacoustic transducers associated with each of the left side sub array and the right side sub array and having a controlled amount of ANR provided;

a processor that creates from the microphone output signals a left-ear audio signal and a right-ear audio signal;

wherein:

the left-ear audio signal is created based on the microphone output signals from one or more of the microphones of the left-side sub-array and one or more of the microphones of the right-side sub-array, but only below a predetermined frequency;

the right-ear audio signal is created based on the microphone output signals from one or more of the microphones of the left-side sub-array and one or more of the microphones of the right-side sub-array, but only below a predetermined frequency;

above the predetermined frequency the processor creates the left-ear audio signal based only on the microphone output signals from microphones of the left-side sub-array and creates the right-ear audio signal based only on the microphone output signals from the microphones of the right-side sub-array;

the processor is configured to process the microphone signals to create specific polar interaural level differences (ILDs) and specific polar interaural phase differences (IPDs) between the left and right ear audio signals;

the bi-lateral array has a directivity index (DI); and the ANR transducers are controlled such that the amount of noise reduction provided by the ANR transducers is equal to or greater than the DI of the bi-lateral array; and a user-operable input device that is adapted to be manipulated so as to cause a change in the array directivity.

* * * * *